US010414613B2

(12) United States Patent
Talken et al.

(10) Patent No.: US 10,414,613 B2
(45) Date of Patent: Sep. 17, 2019

(54) STACKER LOAD CHANGE CYCLE

(71) Applicant: GEO. M. MARTIN COMPANY, Emeryville, CA (US)

(72) Inventors: Daniel J. Talken, Lafayette, CA (US); Jonathan R. Ames, El Sobrante, CA (US); Grant J. Kimzey, Berkeley, CA (US); Charles Rizzuti, Martinez, CA (US)

(73) Assignee: Geo. M. Martin Company, Emeryville, CA (US)

( * ) Notice: Subject to any disclaimer, the term of this patent is extended or adjusted under 35 U.S.C. 154(b) by 0 days.

(21) Appl. No.: 15/724,880

(22) Filed: Oct. 4, 2017

(65) Prior Publication Data

US 2018/0099833 A1 Apr. 12, 2018

Related U.S. Application Data

(60) Provisional application No. 62/405,766, filed on Oct. 7, 2016.

(51) Int. Cl.
*B65H 29/18* (2006.01)
*B65H 29/34* (2006.01)
(Continued)

(52) U.S. Cl.
CPC ..... *B65H 29/18* (2013.01); *B65H 29/34* (2013.01); *B65H 29/50* (2013.01); *B65H 31/20* (2013.01);
(Continued)

(58) Field of Classification Search
CPC ..... B65H 29/18; B65H 29/34; B65H 29/36; B65H 29/50; B65H 31/3009;
(Continued)

(56) References Cited

U.S. PATENT DOCUMENTS 3,419,266 A 12/1968 Martin
3,804,403 A 4/1974 Vogt
(Continued)

OTHER PUBLICATIONS

Extended European Search Report dated Feb. 26, 2018 in European Patent Application No. 17195268.2.
(Continued)

*Primary Examiner* — Jeremy R Severson
(74) *Attorney, Agent, or Firm* — Vierra Magen Marcus LLP

(57) ABSTRACT

An automated sheets processing system has a vertical stacks accumulating region (SAR) into which sheets are uninterruptedly fed to build vertical stacks for pre-specified loads including completed loads and newly building nascent loads. A tiltable Stacking Deck has a downstream discharge end from which the sheets can be fed at different elevational levels into the stacks accumulating region. A nascent sheets accumulator system has a plurality of support surfaces that are retractably interjectable into the stacks accumulating region for defining a separation gap between the top of a completed load and the bottommost sheet of a nascent new load. At least one of the support surfaces is retractably interjectable in an upstream direction into the stacks accumulating region while at least two others of the support surfaces are retractably interjectable in a downstream direction into the stacks accumulating region. One of the support surfaces has an anti-scuff feature.

20 Claims, 82 Drawing Sheets

(51) Int. Cl.

| | |
|---|---|
| ***B65H 29/50*** | (2006.01) |
| ***B65H 31/32*** | (2006.01) |
| ***B65H 31/20*** | (2006.01) |
| ***B65H 31/30*** | (2006.01) |

(52) U.S. Cl.
CPC ..... *B65H 31/3054* (2013.01); *B65H 31/32* (2013.01); *B65H 31/3018* (2013.01); *B65H 2301/4212* (2013.01); *B65H 2301/42172* (2013.01); *B65H 2301/422615* (2013.01); *B65H 2404/2641* (2013.01); *B65H 2405/322* (2013.01); *B65H 2601/251* (2013.01); *B65H 2701/1762* (2013.01)

(58) Field of Classification Search
CPC ..... B65H 31/3018; B65H 31/32; B65H 2301/42261; B65H 2301/422615; B65H 2405/35; B65H 2405/351; B65H 2405/354; B65H 31/3054; B65H 31/38; B65H 2405/1134
See application file for complete search history.

(56) References Cited

U.S. PATENT DOCUMENTS

| | | | | | |
|---|---|---|---|---|---|
| 4,500,243 | A * | 2/1985 | Ward, Jr. | B65H 31/18 | 271/197 |
| 4,547,112 | A * | 10/1985 | Steinhart | B65H 31/3018 | 414/788.3 |
| 4,632,378 | A | 12/1986 | Sardella | | |
| 4,740,193 | A | 4/1988 | Frost et al. | | |
| 5,026,249 | A | 6/1991 | Shill | | |
| 5,493,104 | A | 2/1996 | Wilson | | |
| 5,980,196 | A * | 11/1999 | Roth | B65H 29/6618 | 198/462.3 |
| 6,042,108 | A | 3/2000 | Morgan et al. | | |
| 6,234,473 | B1 | 5/2001 | Morgan et al. | | |
| 6,446,962 | B1 * | 9/2002 | Taffertshofer | B65H 29/70 | 271/312 |
| 6,986,635 | B2 * | 1/2006 | Talken | B65H 29/50 | 198/592 |
| 7,052,006 | B2 * | 5/2006 | Stauber | B65H 33/04 | 270/58.31 |
| 9,003,964 | B2 * | 4/2015 | Roth | B65B 63/02 | 100/215 |
| 9,221,645 | B2 * | 12/2015 | Onishi | B65H 31/24 | |
| 9,327,920 | B2 | 5/2016 | Roth et al. | | |
| 9,365,369 | B2 | 6/2016 | Roth et al. | | |
| 2010/0190626 | A1 | 7/2010 | Taketsugu et al. | | |
| 2012/0319344 | A1 * | 12/2012 | Nakamichi | B65H 29/52 | 270/58.07 |

OTHER PUBLICATIONS

Response to Search Opinion filed Oct. 11, 2018 in European Patent Application No. 17195268.2.

* cited by examiner

A
A
33
41
65
46
47

33
41
69
65
70
47
72
46
72
47
71

STACKER LOAD CHANGE CYCLE

CROSS REFERENCE

The present application claims benefit of provisional application U.S. 62/405,766 filed Oct. 7, 2016 on behalf of Daniel J. Talken et al. under the title of "Improved Stacker Load Change Cycle" where the disclosure of said provisional application is incorporated herein by reference in its entirety.

BACKGROUND

Manufacturers of corrugated paper products, known as Box Makers, produce both foldable boxes which have been folded and glued at the factory and die cut flat sheets which may be used either in their flat state or folded into desired shapes. These will be referred to as folded boxes and flat boxes respectively. The term "boxes" alone can refer to both folded and flat boxes. However, for the purposes of this patent application, boxes will refer to such before folding and gluing. Any reference to box length is understood to mean a distance in the material flow direction and any reference to box width is understood to mean a distance in a direction substantially perpendicular to the material flow direction.

Both the folded boxes and the flat boxes are produced by Converting machinery which processes the Corrugated Sheet Stock produced by the machinery known as a Corrugator. The Corrugated Sheet Stock is corrugated material cut to a specific rectangular size. However, the corrugated sheet stock has not been cut or notched to the detail typically required to produce the final foldable boxes or the flat boxes.

Often customized printing is required on boxes which may be done by 1) using a preprinted material integrated into the corrugated sheet stock on the Corrugator, 2) using flexographic printing during the Converting process or 3) applying ink or labels post Converting through various techniques.

During the Converting process the Corrugated Sheet Stock is transformed into a desired box configuration by performing additional cutting and optionally adding scoring and printing. There are multiple possible purposes for the additional cutting of the Corrugated Sheet Stock. Many of these cutting operations will result in pieces of the original Corrugated Sheet Stock being completely separated from the final box. These pieces are in general referred to as Scrap. The cutting can often result in notches within the box surface and along the edges. The result is that there are often variable width distances from cut edge to edge depending on where one measures the across the box in the cross flow direction.

In the conversion of the Corrugated Sheet Stock into Boxes the material is fed through machinery. The Lead Edge for both Corrugated Sheet Stock and Boxes refers to the first edge encountered as the stock or box travels downstream through the machine whereas the Trailing Edge refers to the last edge encountered as the stock or box travels downstream through the machine. The Corrugated Sheet Stock may be cut completely through in the cross-machine direction in one or more locations to create two or more boxes as counted in the through-machine direction. These are referred to as Ups. The Corrugated Sheet Stock may alternatively or additionally be cut completely apart in the through-machine direction in one or more locations to create two or more boxes in the cross-machine direction. These are referred to as Outs. (See briefly, FIGS. 38A-38B.)

There are multiple methods by which the cutting of the Corrugated Sheet Stock may be accomplished during the Converting process. One example method for cutting Corrugated Sheet Stock is known as Rotary Die Cutting. A typical configuration of a Rotary Die Cutter, known as Rule and Rubber, uses of a pair of cylinders where the lower cylinder, known as the Anvil, is covered in a firm rubber material and the top cylinder is mounted with a Die Board. The Die Board is normally a curved plywood base in which are embedded a customized set of steel Rules, which protrude from the plywood base and when rotated with the Anvil will cut and score the Corrugated Sheet Stock into the desired cut/scored box. An alternate configuration of the Rotary Die Cutter swaps the locations such that the Anvil is the top cylinder and the Die Board is mounted to the lower cylinder. The transportation speed of the box, as determined by the effective linear speed at the nip of the Die Board and Anvil, is known as Line Speed.

A Stacking Apparatus is positioned downstream of the Rotary Die Cutter to accept the cut/scored boxes and to ultimately form neat stacks of the cut/scored (and optionally printed on) boxes. If short stacks of individual Outs are produced, they are known as Bundles. If short stacks are output and the Outs are still connected with perforated cuts they are known as Logs. If taller stacks are output they are known as Full Stacks. These stacks, regardless of type, are referred to herein as Loads.

The Box Makers has both fixed and variable costs associated with running of their business. The number of boxes produced in a given time period determines the Average Production Rate. A higher Average Production Rate is desirable. There are multiple factors that can affect the Average Production Rate. The integral of the rotational speed of the Rotary Die Cutter and the amount of time Corrugated Sheet Stock is actually being fed through the machine, Feed Time, determines the Average Production Rate. Focusing on the Feed Time, there are four primary reasons sheets are not continuously being fed during operating hours. First is the time for maintenance or repairs required for the machinery. Second is setup time where the operators are changing from one order to another. Third is clearing of Jams. Forth is when operation of a Stacking Apparatus calls for creation of a gap in the flow of the boxes at a discharge end of the machinery that feeds the Stacking Apparatus in order to perform what is referred to as a Load Change Cycle. A Load Change Cycle is an operational phase when formation (e.g., stacking) of one Load is completed and must be discharged from the end of the Stacking Apparatus and when the formation (e.g., stacking) of a next Load is to be started. Creating such a gap in the flow of boxes entering the Stacking Apparatus can be done by interrupting the Feed Table for a length of time known as a Feed Interrupt Time. It would be desirable to not interrupt the Feed Table that feeds boxes (sheets) into the Stacking Apparatus. Having a Load Change Cycle that allows for Zero Feed Interrupt Time can desirably increase the Average Production Rate for the Box Maker.

The quality of the box surface and print quality at the output of the Stacking Apparatus are important factors to the Box Maker. There are two classes of Rotary Die Cutters, ones that print on the top surface and ones that print on the bottom surface. Care should be taken by the Stacking Apparatus during the Load Change Cycle to not Scuff (e.g., abrade) the printed or other fine surfaces of the Box.

The downstream processing units after the Rotary Die Cutter generally comprise four functional modules.

The first functional module at the receiving end of the post-Die Cutter apparatus is typically referred to as the Layboy Function. Its function is the receiving of the boxes from the Rotary Die Cutter and assisting in the removing of the scrap from the boxes. Often speed variations are implemented in this section in preparation for the second functional module.

The second functional module will be referred to as the Shingling Function. This is a widely used option in the post-Die Cutter processing and stacking operations where the boxes can be changed from Stream Mode to Shingle Mode. Stream Mode is where the boxes are being conveyed without overlap at higher speed. Shingle Mode happens with a transition to conveying means that are running slower than Line Speed and thus the boxes are caused to partially overlap one another and thus create what is known as shingle of boxes. The speed variations referred to in the Layboy Function may be higher than Line Speed to pull gaps between the boxes in order to allow the creation of the Shingle of boxes.

The third functional module after Die Cutting will be referred to as the Stacking Function. The boxes are now conveyed in either Stream Mode or Shingle Mode to where respective stacks of boxes are being created. One style is for the discharge end of a Stacking Conveyor to change in elevation in order to accommodate the growing stack of boxes such that the conveyed boxes are deposited on the top of a currently being formed stack. This is known as an Up Stacker which an example of can be seen in prior art U.S. Pat. No. 7,954,628. An alternative method is for the discharge end of the Stacking Conveyor to remain at a fixed elevation and the Stack Support Surface which is disposed under the growing stack of boxes moves down, again as more of the conveyed boxes are deposited on the top of the growing stack. This is known as a Down Stacker which an example of can be seen in prior art U.S. Pat. No. 5,026,249. An additional alternative is a combination where both of the discharge end of the Stacking Conveyor and the Stack Support Surface are changing respective elevations.

Up Stackers and Down Stackers both have advantages and challenges. Up Stackers have the advantage that it is more convenient for the operator to be able to walk onto a low level floor conveyor upon which the stack of the Up Stacker is being built, but it has the engineering challenge in that the angle of the deck of the Stacking Conveyor changes as the growing load is being created. Near the discharge end of a Straight Up Stacking Deck, (see briefly 33 of FIG. 2), the Linear Space in the horizontal direction under the pulleys at the discharge end of the deck becomes smaller as the incline angle of the Straight Up Stacking Deck increases. A Curve Down Stacking Deck as in FIG. 2 of U.S. Pat. No. 5,026,249, has substantial Linear Space under the pulleys near the discharge end, as do multitude of Straight Down Stacking Decks, as an example FIG. 3 of U.S. Pat. No. 4,359,218. Problems due to lack of substantial Linear Space for a Straight Up Stacking Deck may be seen in FIG. 4 of prior art U.S. Pat. No. 6,234,473. This lack of substantial Linear Space associated with Straight Up Stacking Decks along with inability to provide reliable operation at the maximum Rotary Die Cutter Speed is one of a number of problems that can be overcome by aspects of the present disclosure of invention.

When respective stacks are being formed by the boxes falling off the discharge end of the Stacking Conveyor and onto a vertical stacks accumulating region, there is a potential downside of having the Stacking Conveyor at a substantial downward angle when first starting a new stack. Depending on the cutouts required to make the box, when the consecutive sheets are pressured downward onto the top of the stack, the cutouts can catch on edges of previously stacked boxes and cause jams. As a result, and in accordance with one aspect of the present disclosure, a solution is provided of avoiding having a Stacking Deck operating without a substantial downward angle for its incoming boxes.

In order to perform the Load Change Cycle, the Shingle of Boxes should be selectively separated based on the order settings in order to get the correct count in each Load. The Box Maker and their customers expect the box count in the Loads to be consistently accurate, this being an aspect enabled by the present disclosure of invention.

The fourth functional module downstream of the Die Cutter will be referred to as the Hopper Function. This is an area where the full stack of boxes or bundles of boxes are formed by means stacking and it generally includes an Accumulation means and it performs part of the Load Change Cycle. The optimal Load Change Cycle is one that can operate at the maximum speed capabilities of the Rotary Die Cutter, can accumulate enough boxes to allow for the variable time it takes to discharge a completed Load from the Stacker, can handle both Stream Mode and Shingle Mode operations, can reliably split Loads between any of the Ups at an accurate count, does not Scuff (e.g., abrade) the printed or other fine surfaces of the boxes, makes a nicely tamped stack of boxes and does not necessarily call for a Feed Interrupt Time (thus enabling ZFI).

Some Stacking Apparatus require the individual boxes, Outs, to be separated laterally across the machine in order to output individual side by side Bundles or Full Stacks from the Hopper Function. This can be performed during the Layboy Function as describe by U.S. Pat. No. 3,860,232, the Singling Function or the Stacking Function as described by U.S. Pat. No. 5,026,249. In the Hopper Function, making a clean separation between these side by side Bundles or Full Stacks may be performed by the Stacking Apparatus both during the building of the stack and during the Load Change Cycle.

BRIEF SUMMARY

An improved Load Change Cycle Apparatus is disclosed that can operate at the maximum speed capabilities of the Rotary Die Cutter, can accumulate enough boxes to accommodate for the variable time it takes to discharge a Load, can handle both Stream Mode and Shingle Mode operations, can reliably split Loads between any of the Ups at an accurate count, does not Scuff (e.g., abrade) the printed or other fine surfaces of the boxes, makes a nicely tamped stack of boxes, avoids having a Stacking Deck operating without a substantial downward angle for in-feeding boxes and does not require a Feed Interrupt Time.

DETAILED DESCRIPTION

Figure 1:
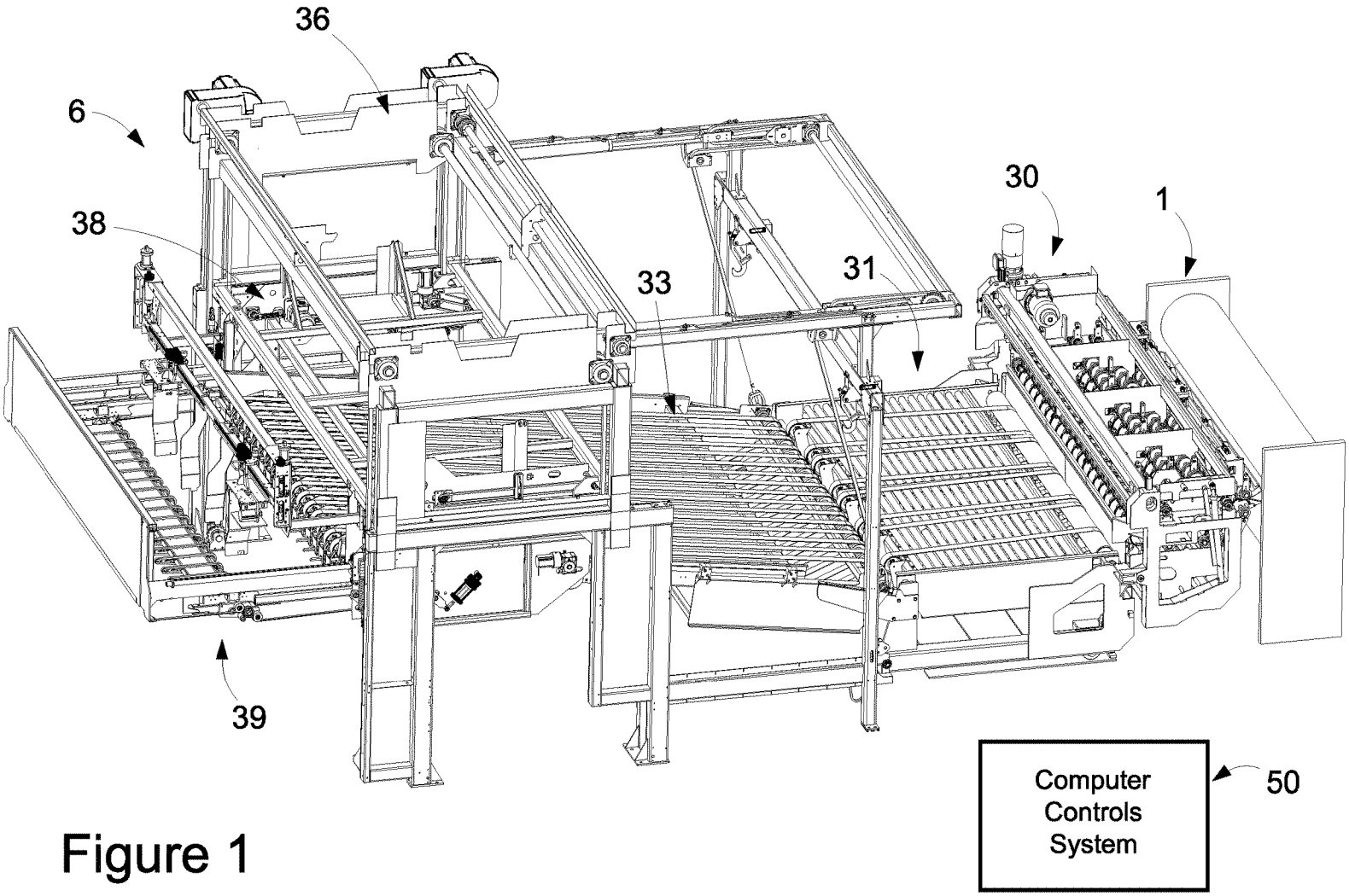
FIG. 1 depicts a perspective view of a Die-Cutting and Stacking Apparatus including an embodiment of an Improved Stacker Load Change Cycle Apparatus (ISLCCA) in accordance with the present disclosure.

FIG. 1 is an assembled perspective view of an Improved Stacker Load Change Cycle Apparatus 6 (ISLCCA 6) in accordance with the present disclosure where the ISLCCA 6 is shown within the context of a complete Die-Cutting and Stacking Apparatus 183. The Die Cutter 1 is the first apparatus in a sequential series of apparatuses. Downstream of the Die Cutter 1, shown is a Wheel Style Layboy 30 which performs the Layboy Function 2. The next apparatus is a Diverting Transfer Deck 31 which can perform the Shingling Function 3 and the Separation Function 7. The next apparatus is a Stacking Deck 33 which helps perform the Stacking Function 4. The next illustrated apparatus is the Improved Stacker Load Change Cycle Apparatus 6 (IS-LCCA 6) which performs the Load Change Function 5 and which is closely integrated into the Stacking Deck 33 and operatively connected to a Gantry 36 as well as being operatively coupled to a Computers Control System 50. The Improved Stacker Load Change Cycle Apparatus 6 is made up by two major sub-assemblies, the Deck Lift Assembly 38 and the Accumulator Assembly 39. Of importance, the Deck Lift Assembly 38 and the Accumulator Assembly 39 are configured to be able to rise and lower independently of one another. As already implied, the Computer Control System 50 is operatively coupled to various sensors and actuators (e.g., motors) in the system and thus is able to control various movements including controlling the respective elevations of the Deck Lift Assembly 38 and the Accumulator Assembly 39 independently of one another such that the spacing between these two major assemblies can be varied or electronically geared by the Computer Control System 50 to achieve desired coordinated motions as will be further described below.

Figure 2:
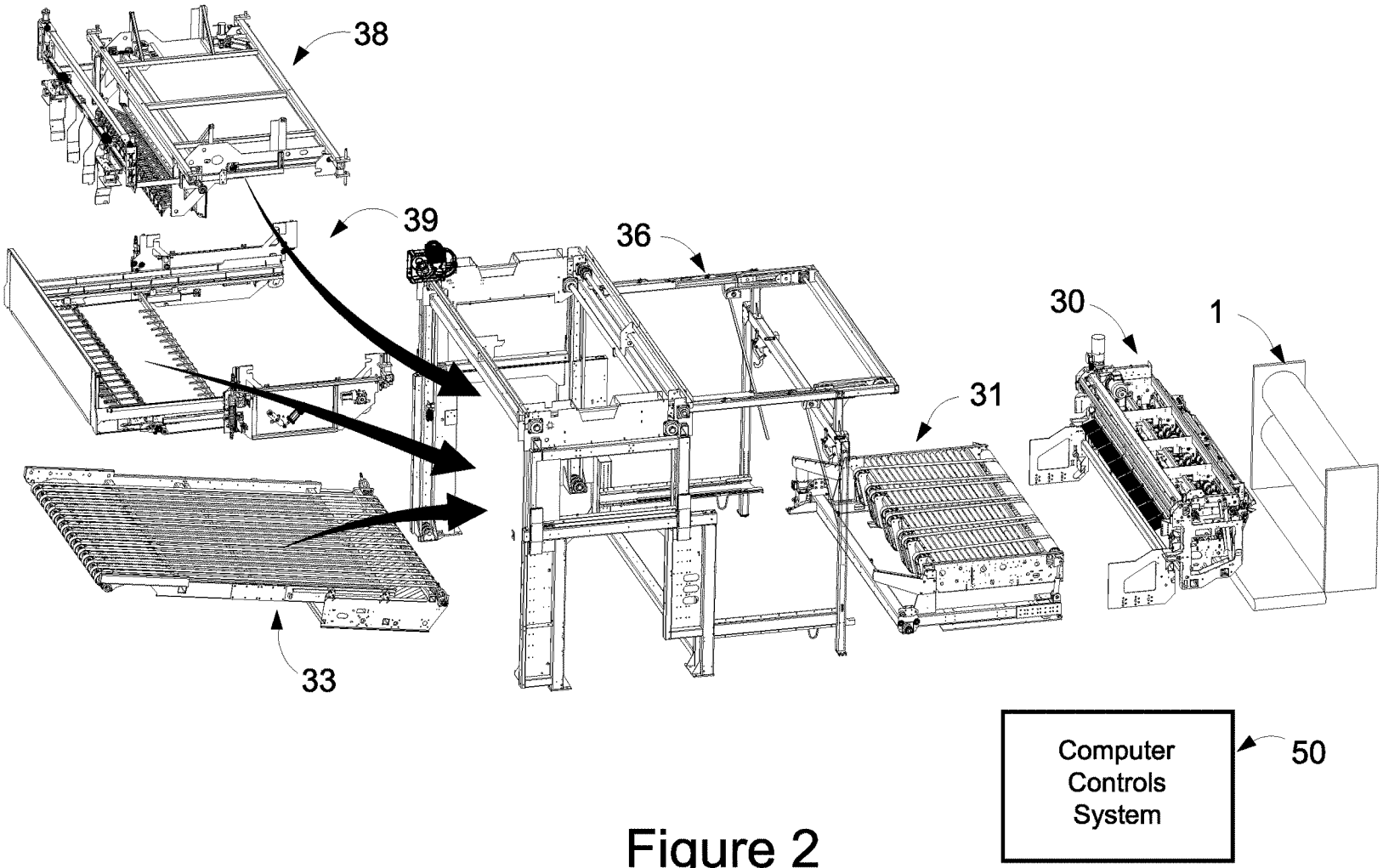
FIG. 2 depicts an exploded perspective view of various parts of the Die-Cutting and Stacking Apparatus of FIG. 1.

FIG. 2 is an exploded perspective view of the various apparatus in FIG. 1 for clarity. Although the Accumulator Assembly 39 is shown spaced above the Stacking Deck 33 in FIG. 2, it will being understood later below that a Linear Space 29 (see briefly FIGS. 10A-10B) is defined under a box discharging end of the illustrated Stacking Deck 33 where the Linear Space 29 can serve as a parking space accommodating an Accumulator Fingers Assembly 129 (see briefly FIG. 18) and an Trail Edge Comb Assembly 130 of the Accumulator Assembly 39 where the accommodated assemblies 129 and 130 can emerge from the parking space (Linear Space 29) to provide temporary underneath support for a forming nascent stack of boxes (e.g., 14''' of FIG. 4) while a previously completed other stack 14" still resides below prior to being conveyed away. In other words, the Stacking Deck 33 and Accumulator Assembly 39 combine to form a scissor-like structure with some part of the Accumulator Assembly 39 (e.g., 129 and 130 of FIG. 18) residing below the discharge end (e.g., 45) of the Stacking Deck 33 and some parts (e.g., Backstop 63 of FIG. 4) extending to be above the discharge end (e.g., 45).

Figure 3:
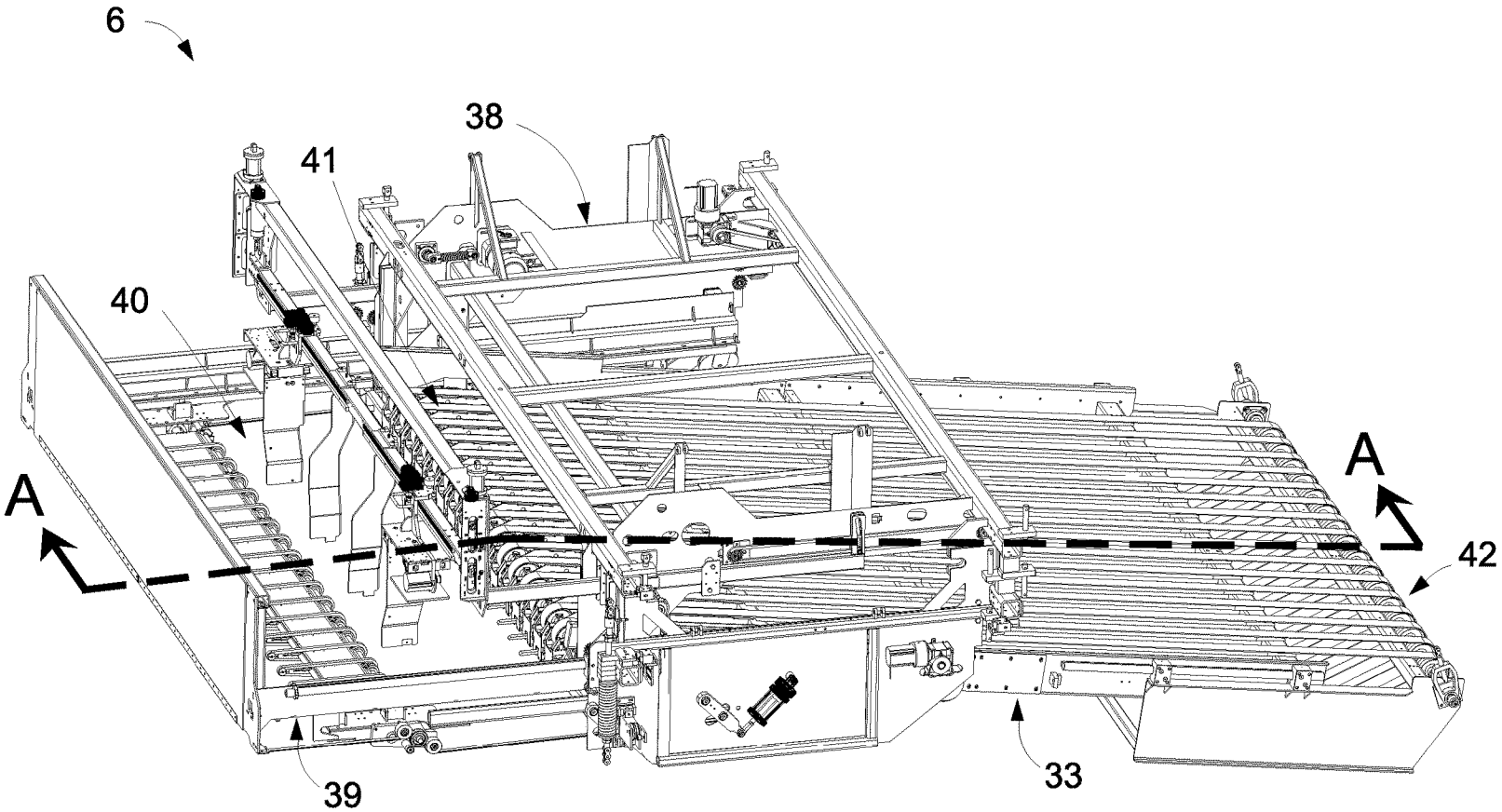
FIG. 3 depicts a perspective view of major sub-assemblies related to the Improved Stacker Load Change Cycle Apparatus of FIG. 1, with the Deck Lift Assembly in close proximity of the Accumulator Assembly creating a small Hopper Size

FIG. 3 is a perspective view of the major sub-assemblies related to the Improved Stacker Load Change Cycle Apparatus 6. The Deck Lift Assembly 38 is connected to the Stacking Deck 33 which has a Stacking Deck Discharge End 41 at a downstream end of the Stacking Deck 33 and a Stacking Deck Entry End 42 at an upstream end of the Stacking Deck 33. Vertical reciprocal motion of Deck Lift Frame 38 enables the Stacking Deck 33 to build stacks of boxes by raising the Stacking Deck Discharge End 41, which raising motion is commonly referred to as Up Stacking. An alternate configuration would be to limit the vertical motion of the Deck Lift Frame 38, even to zero motion and raise and lower the Load Conveyor 73 relative to the Deck Lift Frame 38 which is commonly referred to as Down Stacking. The Accumulator Assembly 39 is not mechanically fixedly connected to the Deck Lift Assembly 38 nor to the Stacking Deck 33 but rather is operatively connected to Gantry 36 (see briefly FIG. 17A). The Gantry 36 and means for controlling the elevation of Deck Lift Assembly 38 and Accumulator Assembly 39 have been removed from FIG. 3 for clarity. A Dynamic Hopper 40 which is a region where boxes of a nascent stack (e.g., 14''' of FIG. 4) accumulate is shown as being smaller in the illustrated state of FIG. 3 where the Deck Lift Assembly 38 and the Accumulator Assembly 39 have been respectively moved elevationally to be in close proximity to each other.

Figure 4:
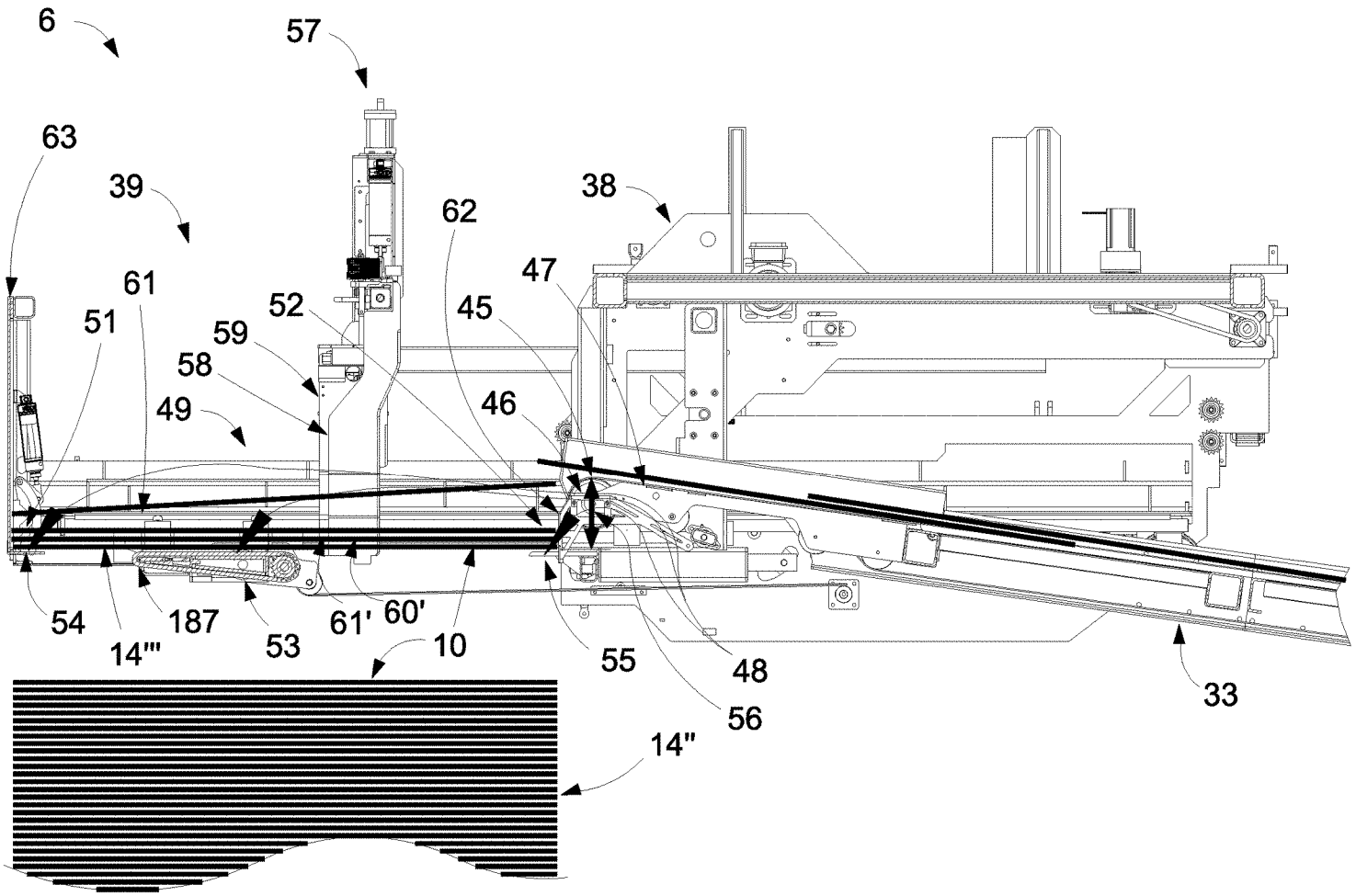
FIG. 4 depicts a cross section, partial view taken along line A-A of FIG. 3 and showing a completed first stack of boxes as well a nascent second stack being supported by one of a plurality of Accumulator Fingers interposed between the first and second stacks.
Figure 38A:
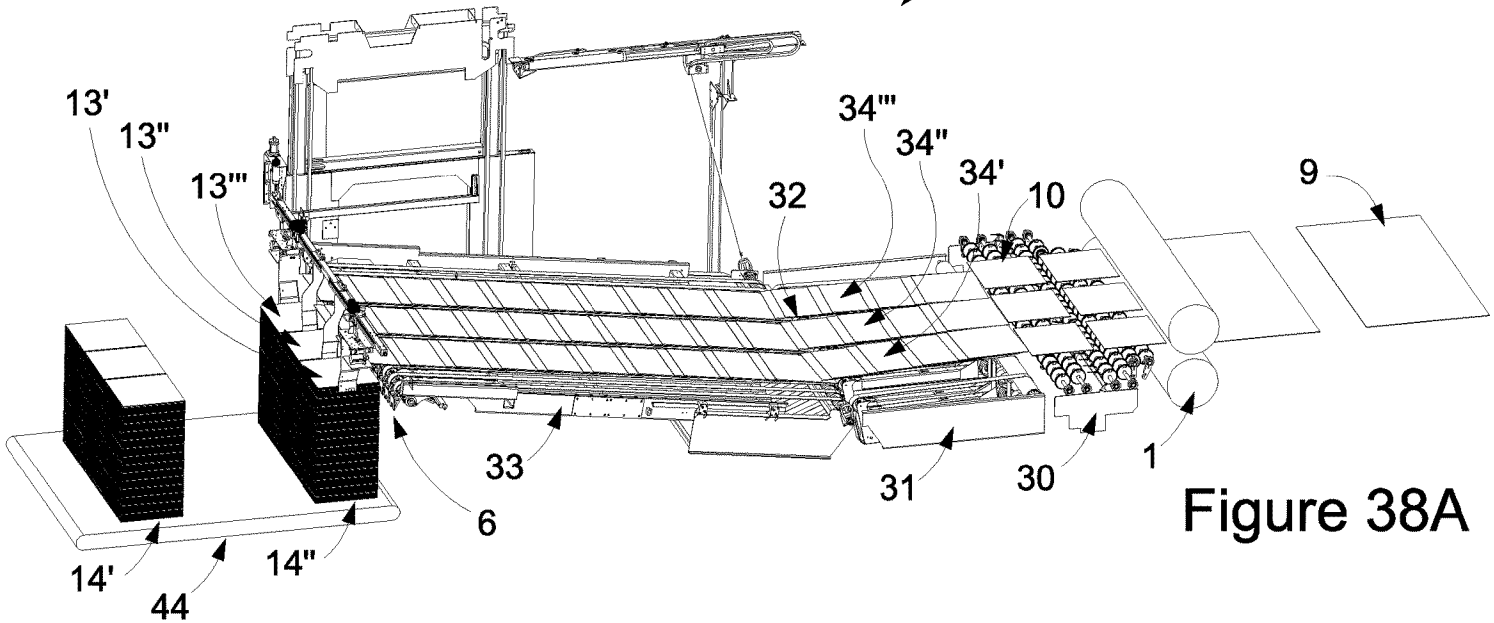
FIG. 38A shows a simplified perspective view of an Up Stacker with just the mechanical elements that convey its Boxes shown in order to illustrate and define some of key ideas.

FIG. 4 is a cross section, partial view A-A from FIG. 3 focusing on the elements which make up the Improved Stacker Load Change Cycle Apparatus 6 while in a state where a nascent second stack 14''' of boxes is beginning to accumulate above an already completed first stack 14" of boxes before the first stack 14" is conveyed away (see briefly floor conveyor 44 of FIG. 38A). In other words, FIG. 4 shows a state where Boxes 10 of respective first and second stack or Loads, 14" and 14''' have been added. Three Boxes 10 for the new nascent Load 14''' are shown already accumulated in the Dynamic Hopper 49 with a fourth box falling into position. A portion of the completed first stack or Load 14" (top portion only shown) is still disposed under the Accumulator Assembly 39 awaiting to be conveyed away further downstream in order to clear out a deposition spot on a not-shown conveyor (see briefly floor conveyor 44 of FIG. 38A) for the nascent but growing nascent new Load 14". The key illustrated elements include a Stacking Deck Discharge Surface 45 which in this case is the top of the Stacking Deck Belt 47 which wraps around the top crown of the Stacking Deck Discharge Pulley 46. An Accumulation Sheet Support System 48 is created by at least three elements, namely, a downstream-wise retractable lead edge support (also referred to in one embodiment as the Backstop Lip 54), an upstream-wise retractable trail edge support (also referred to in one embodiment as the Trail Edge Comb 55) and an upstream-wise retractable center support (also referred to in one embodiment as the Accumulator Fingers 53). These three support surfaces only need to be roughly planar relative to one another as the Boxes 10 of the supported growing nascent new Load 14''' are flexible. The Backstop Lip 54 provides lead edge support to the Box Lead Edge 51 of the lowermost or first box in the nascent second stack 14'''. The Trail Edge Comb 55 provides trail edge support to the Box Trail Edge 52 of the lowermost or first box in the nascent second stack 14'''. The Accumulator Fingers 53 provide center underneath support to the Boxes 10 of the nascent new Load 14''' . The Accumulator Fingers 53 each have an Accumulator Finger Lead Edge 187 (see briefly the kinematic snapshot of FIG. 52) where that Finger Lead Edge 187 is first to enter the Hopper area when a new stack 14''' is to be formed as being separated from a previous stack 14". A vertical dimension referred to as the Hopper Size 56 is defined as the vertical distance from the Stacking Deck Discharge Surface 45 to the planar support surface defined by the Accumulation Sheet Support System 48 (e.g., by bottom box contact elements 53, 54 and 55).

Figure 5:
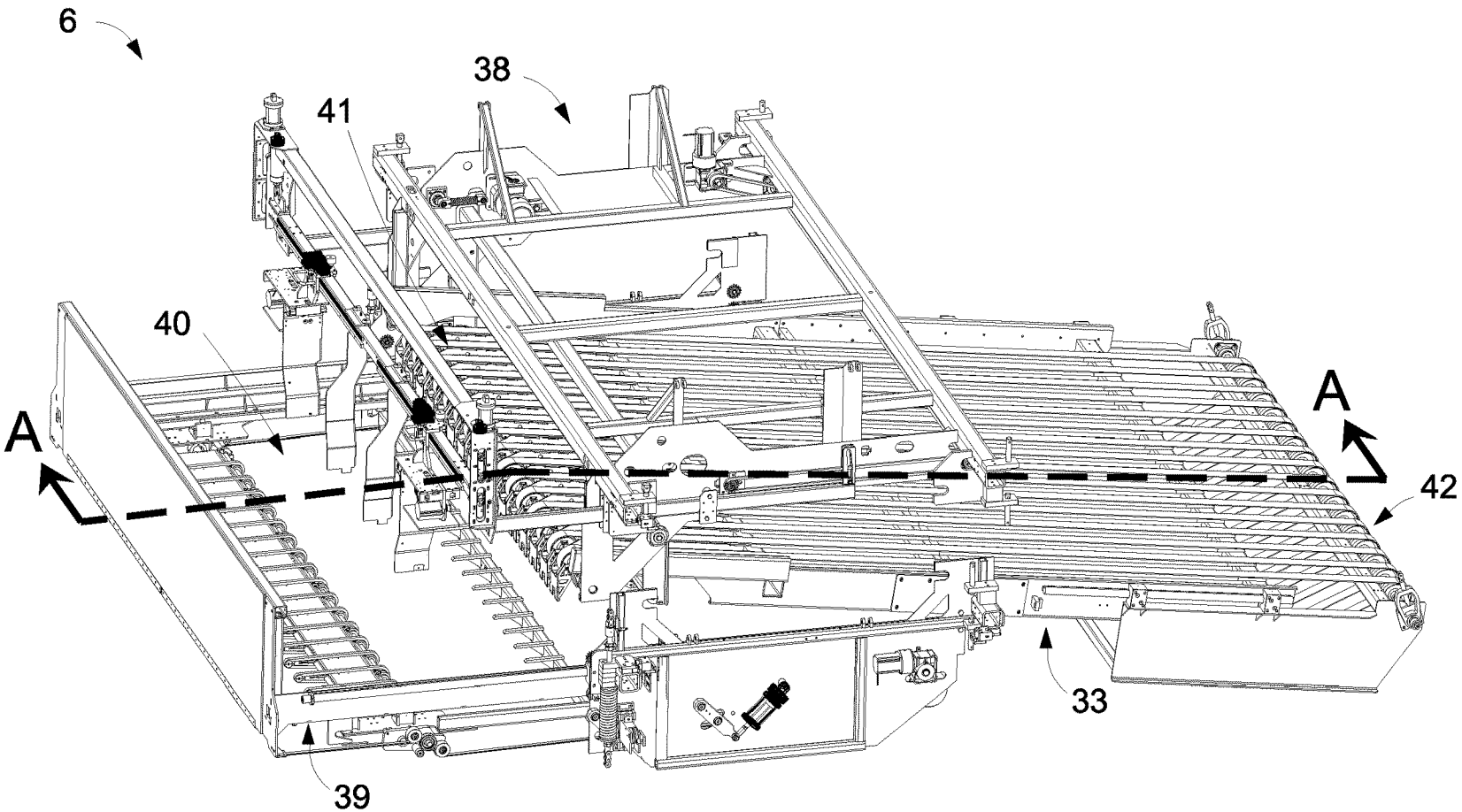
FIG. 5 depicts a perspective view of major sub-assemblies related to the Improved Stacker Load Change Cycle Apparatus of FIG. 1, with the Deck Lift Assembly with a greater separation from the Accumulator Assembly creating a larger Hopper Size

FIG. 5 is a perspective view illustrating key major sub-assemblies related to the Improved Stacker Load Change Cycle Apparatus 6 similar to FIG. 3 except that in the illustrated state, the completed Load 14" has been conveyed away from the area and the Hopper Size 56 of the Dynamic Hopper 40 is larger in this view since the Deck Lift Assembly 38 and the Accumulator Assembly 39 are respectively elevationally moved to not be in close proximity to each other.

Figure 6:
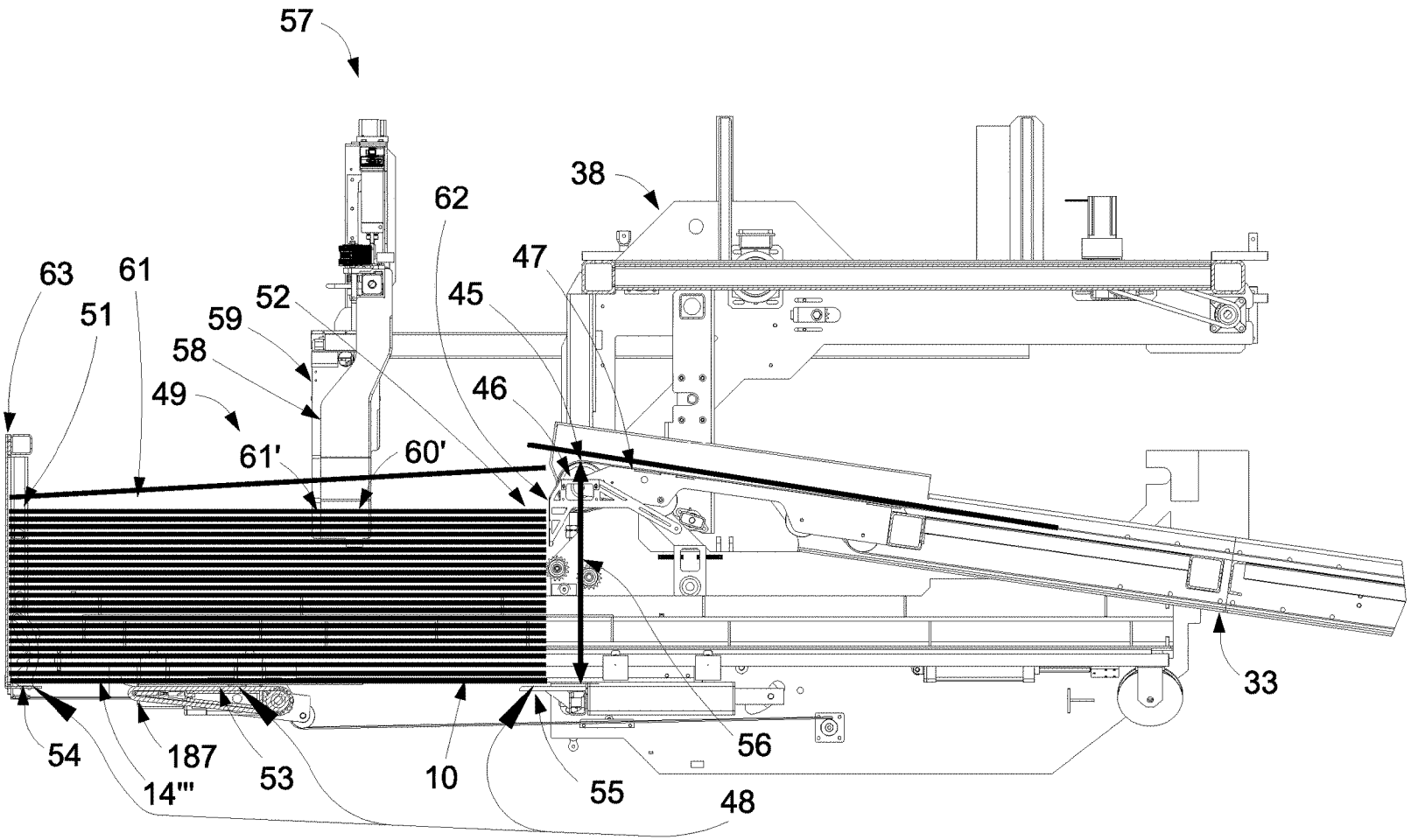
FIG. 6 depicts a cross section, partial view taken along line A-A of FIG. 5 and showing a nascent second stack being supported by one of a plurality of Accumulator Fingers interposed under a second stack.

FIG. 6 is a cross section, partial view A-A from FIG. 5 focusing on some of the elements which make up the Improved Stacker Load Change Cycle Apparatus 6. In this view, more Boxes 10 of the growing nascent Load 14''' have been added. In other words, a larger number of Boxes 10 for the nascent new Load 14''' are show disposed in the increased height of the Dynamic Hopper 49. This is so because the Deck Lift Assembly 38 and the Accumulator Assembly 39 have been elevationally separated so as to not be in close proximity to each other and thus the Hopper Size 56 has increased allowing for the additional Boxes 10. The vertical height of the Backstop 63 is sufficient to allow for the nascent Load 14''' to continue to be built up and simultaneously have its upper portion tamped by Trail Edge Tampers 62 as Deck Lift Assembly 38 and Accumulator Assembly 39 are elevationally move apart from each other. The ability of the Accumulator Assembly 39 to move independently of the Deck Lift Assembly 38 and thus independently of the Stacking Deck Discharge Surface 45 means that this system is able to also perform a partial amount of stack building by means of DownStacking (e.g., by means of having the Accumulation Sheet Support System 48 (e.g., bottom box contact elements 53, 54 and 55) move downwardly relative to a temporarily elevationally stationary Stacking Deck Discharge Surface 45).

Figure 7:
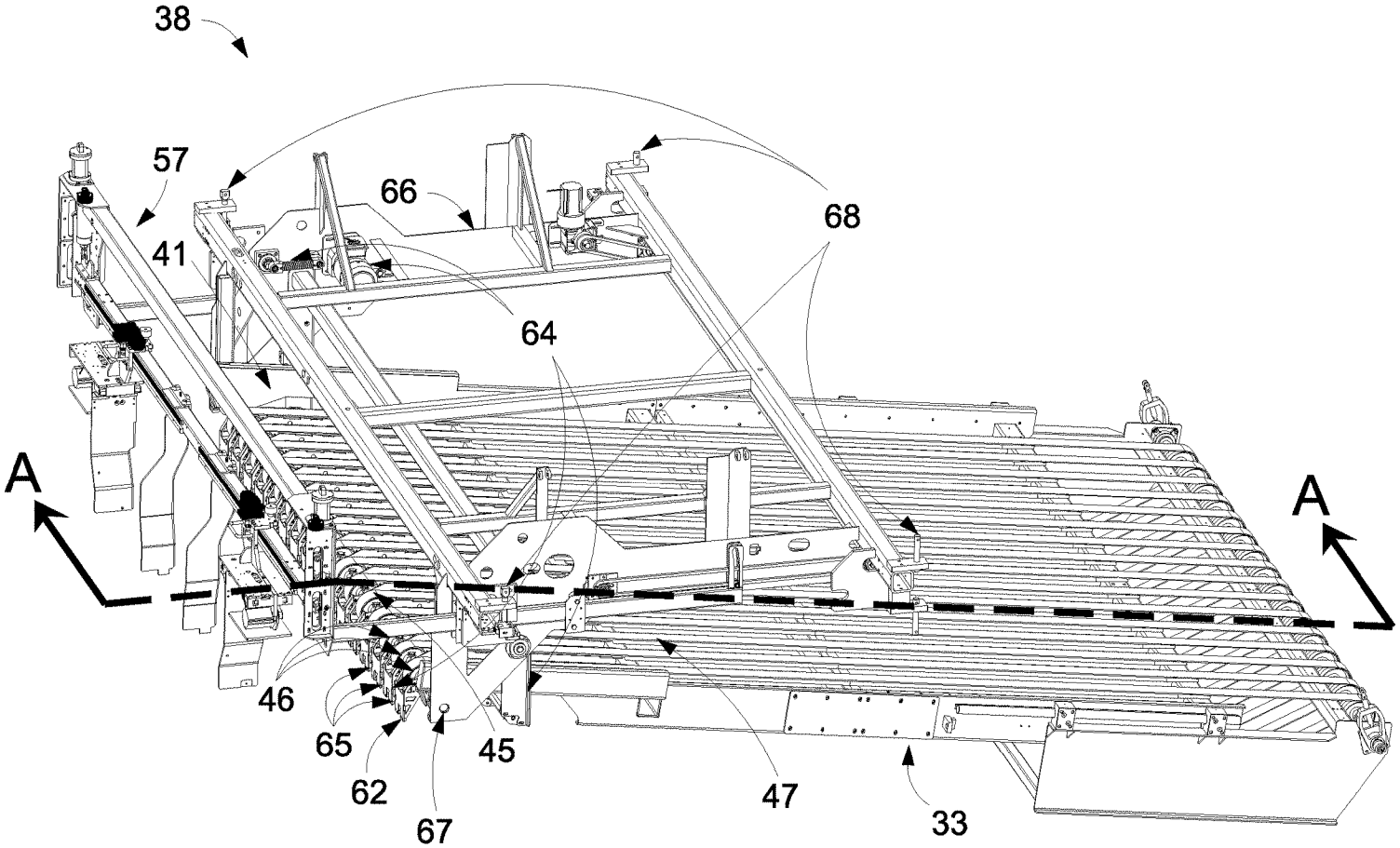
FIG. 7 is a perspective view of the Deck Lift Assembly which has two sub-assemblies, a Trail Edge Tamper Assembly which is integrated into the Stack Deck Discharge End of the Stacking Deck and a Cross Machine Stack Alignment System.

FIG. 7 is a perspective view of the Deck Lift Assembly 38 which has two sub-assemblies, a Trail Edge Tamper Assembly 64 which is integrated into the Stack Deck Discharge End 41 of the Stacking Deck 33 and a Cross Machine Stack Alignment System 57. The Deck Lift Frame 66 has Deck Lift Chain Attachments 68 which operatively connect to the Gantry 36 in order to allow the Computer Control System 50 to selectively change the elevation of Deck Lift Assembly 38 and thus the elevation of the Stack Deck Discharge End 41 from which downstream conveyed boxes may be discharged into the vertical stacks accumulating area (which area includes the Dynamic Hopper 49). The Deck Lift Frame 66 has a Deck Pivot Connection 67 pivotally coupled to the Stacker Deck 33 such that as the elevation of the Deck Lift Assembly 38 changes, the elevation of the Stacking Deck Discharge Surface 45 also changes.

The Stack Deck Discharge End 41 of the Stacking Deck 33 and the Trail Edge Tamper Assembly 64 has a plurality of Finger Gaps 65 respectively interposed between respective pairs of the Stacking Deck Discharge Pulleys 46. The Finger Gaps 65 define part of a parking space and allow Accumulator Finger Lead Edges 187 (finger tips) of the Accumulator Fingers 53 to selectively project out of the gaps-defined portion of the parking space so as to interject themselves being a selected pair of discharged Boxes 10 (a first belonging to a completing first stack (e.g., 14" of FIG. 4) and a second belonging to a nascent second stack (e.g., 14''' of FIG. 4) forming above the first stack). The Accumulator Finger Lead Edges 187 (finger tips) of the Accumulator Fingers 53 can be interjected in relatively close proximity to Stacking Deck Discharge Surfaces 45 off of which Boxes 10 falling into the vertical stacks accumulating area (which area includes the Dynamic Hopper 49) tend to fall in an orderly fashion for forming generally vertical stacks. When a Box Trail Edge 52 of a respective and downstream moving Box 10 first leaves the Stacking Deck Discharge Surface 45 it is quite orderly, which is to say that there will be a gap quite consistent based on the speed of the Stacking Deck Belts 47 that convey the Box and based on the Up Shingle Ratio 22 and/or the Sheet Shingle Ratio 23. However, the further the Box Trail Edge 52 advances beyond the Stacking Deck Discharge Surface 45 and begins to fall (or droop because it is no longer supported from underneath), the gap between it and the further upstream sheets begins to vary based on multiple factors. One factor is air resistance, which can affect wide sheets inconsistently across the width of the machine. A second factor is lateral skew where if the Boxes 10 are slightly skewed such that one side starts falling (drooping down) before the other side of the same box, the behavior across the width of the machine can be inconsistent. A third factor is based on the randomness of the friction that occurs between the box and the guiding surfaces it encounters, in this case the Backstop 63 and the Trail Edge Tampers 62.

Figure 8:
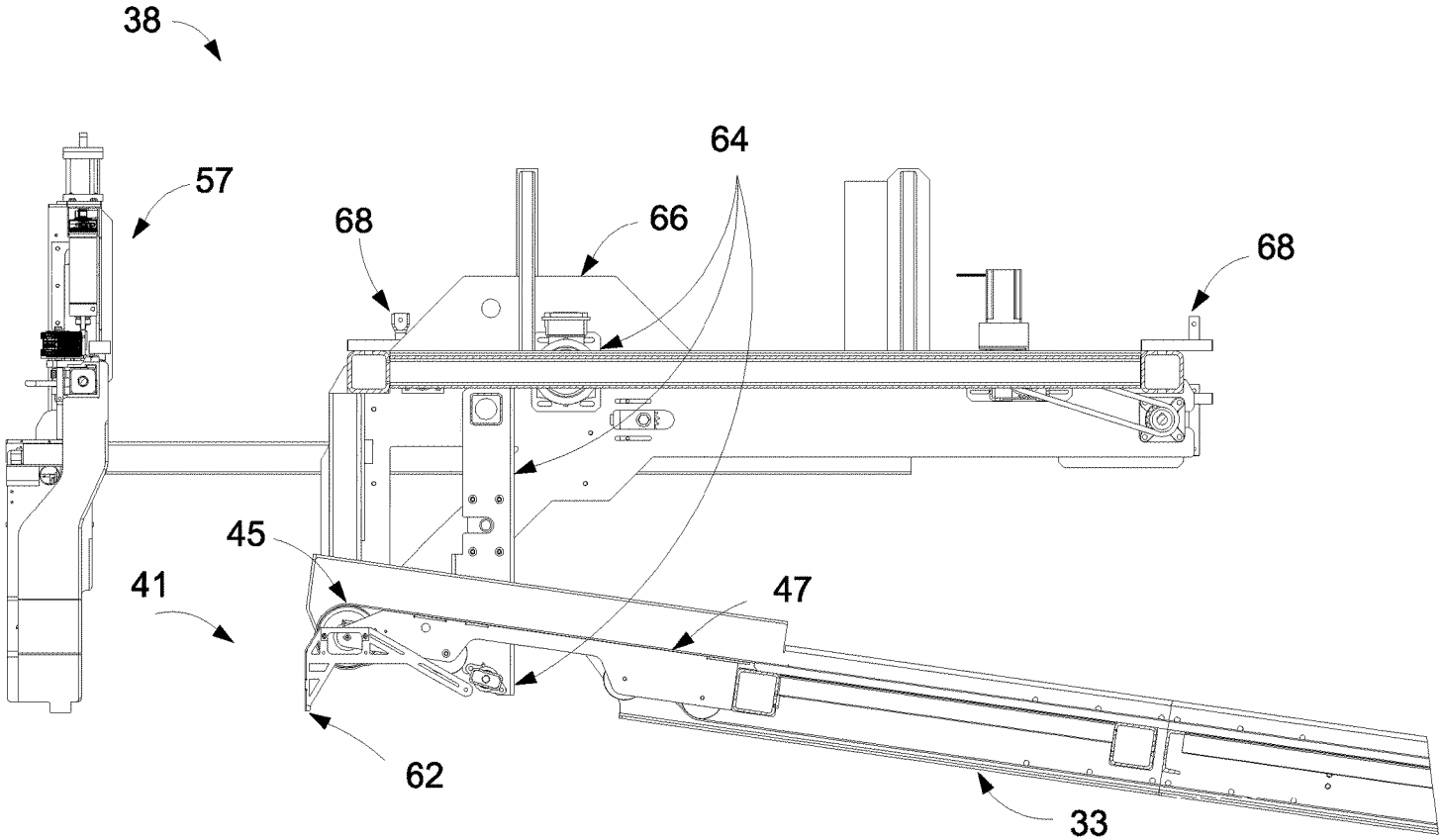
FIG. 8 is a cross section, partial view along line A-A from FIG. 7 and showing relative dispositions of various elements.

FIG. 8 is a cross section, partial view A-A from FIG. 7 and showing relative dispositions of various elements described herein including the Stacking Deck Belts 47, the Stacking Deck Discharge Surfaces 45 and the Trail Edge Tampers 62.

Figures 9A, 9B:
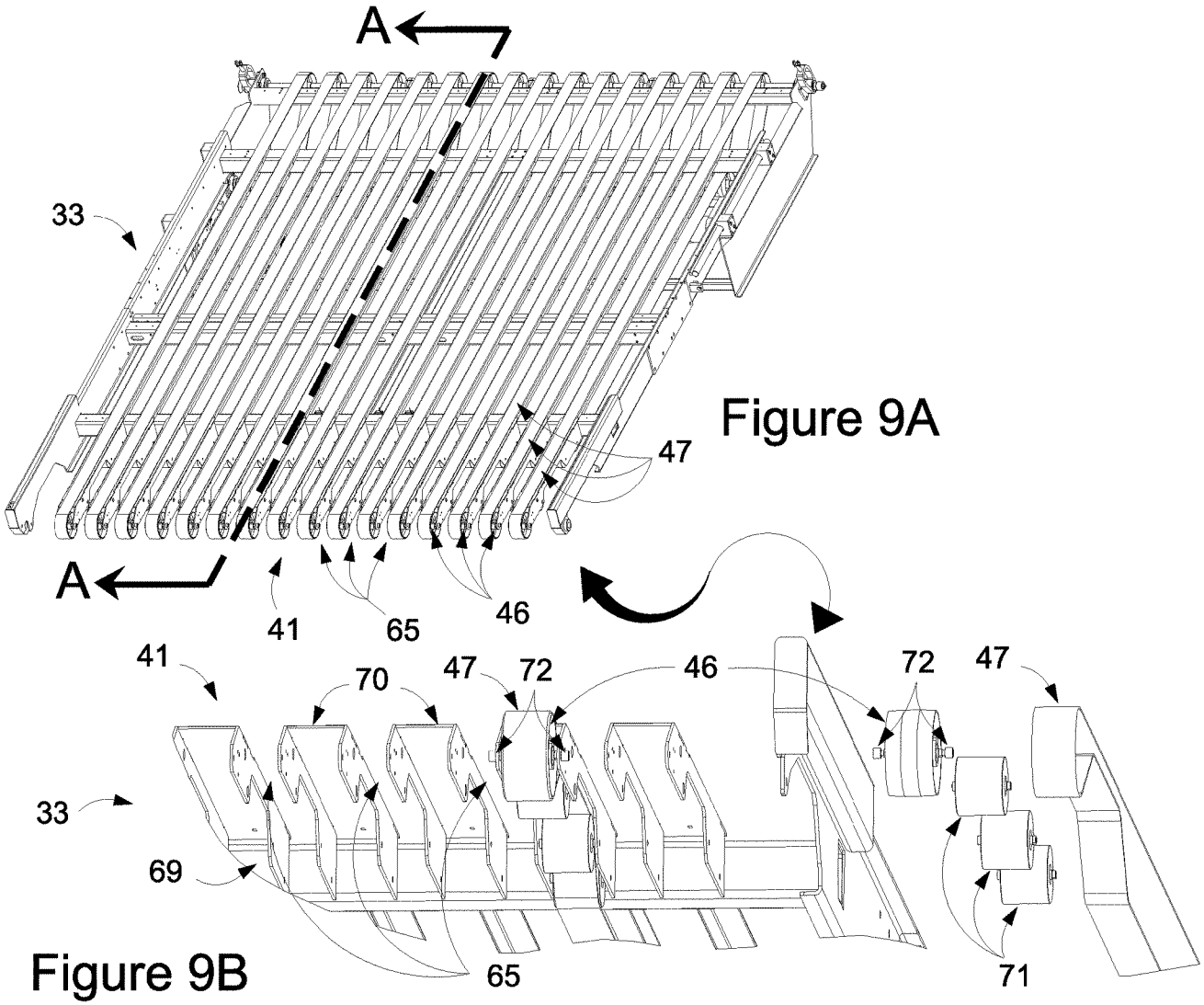
FIG. 9A is a perspective view of the Stacking Deck.
FIG. 9B is a simplified exploded partial perspective view of the construction of the Stacking Deck Discharge End of the Stacking Deck.

FIG. 9A is a perspective view of the Stacking Deck 33. As seen, the construction of the Stacking Deck Discharge End 41 of the Stacking Deck 33 is such that a plurality of Finger Gaps 65 exists, each respectively disposed between a respective pair of the Stacking Deck Discharge Pulleys 46.

FIG. 9B is a simplified exploded partial perspective view of the construction of the Stacking Deck Discharge End 41 of the Stacking Deck 33. Stacking Deck Frame 69 has a comb like construction with Pulley Teeth Weldments 70 which allows mounting a plurality of Stacking Deck Discharge Pulleys 46 across the machine while still creating the Finger Gaps 65 and providing respective belt paths for the Stacking Deck Belts 47. The Stacking Deck Discharge Pulleys 46 are held in place by Trail Edge Tamper Rollers, which in one embodiment, are Cam Followers, providing both the holding force on the Stacking Deck Discharge Pulleys 46 and providing a horizontal constraint for the oscillating motion of the oscillating Trail Edge Tampers 62 (whose oscillation will be detailed below).

Figure 10A:
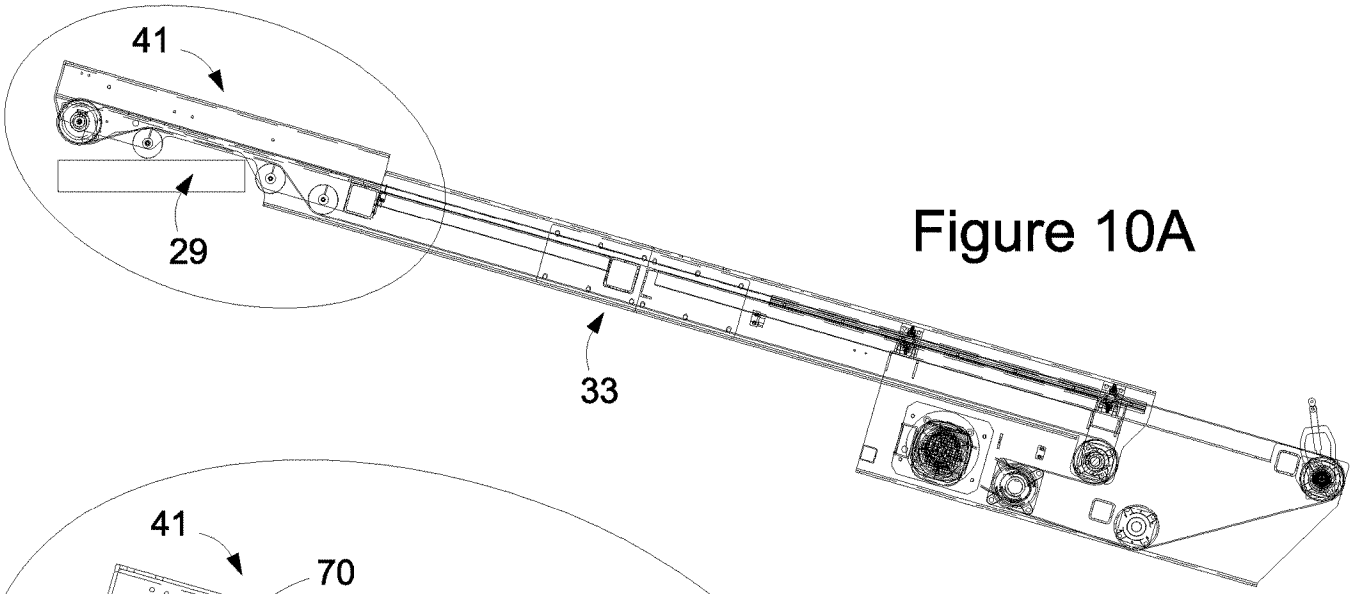
FIGS. 10A and 10B are side views with details along line A-A of FIG. 9A which shows placement of Stacking Deck Belt Control Pulleys which are disposed upstream of the respective Stacking Deck Discharge Pulleys and which are also attaches to the Pulley Teeth Weldments
Figure 10B:
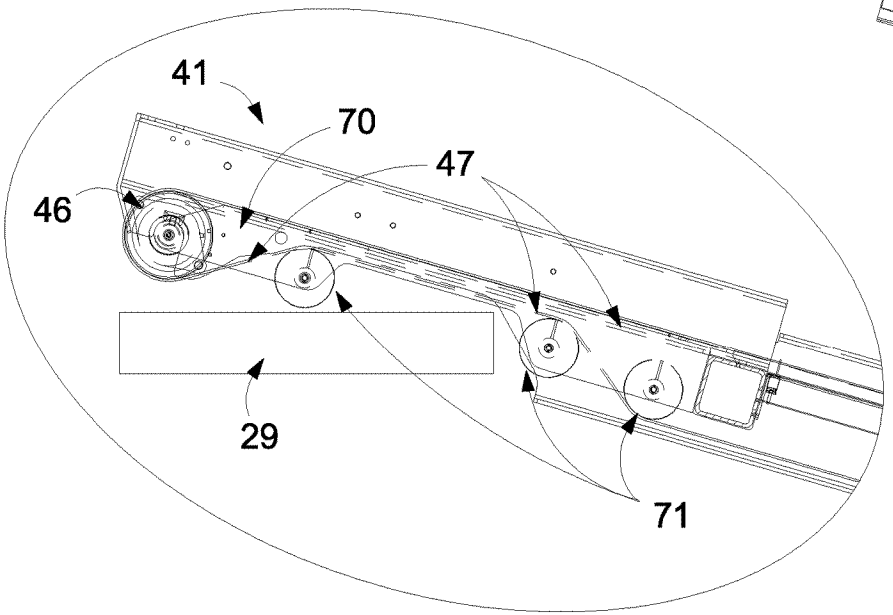
Figure 49:
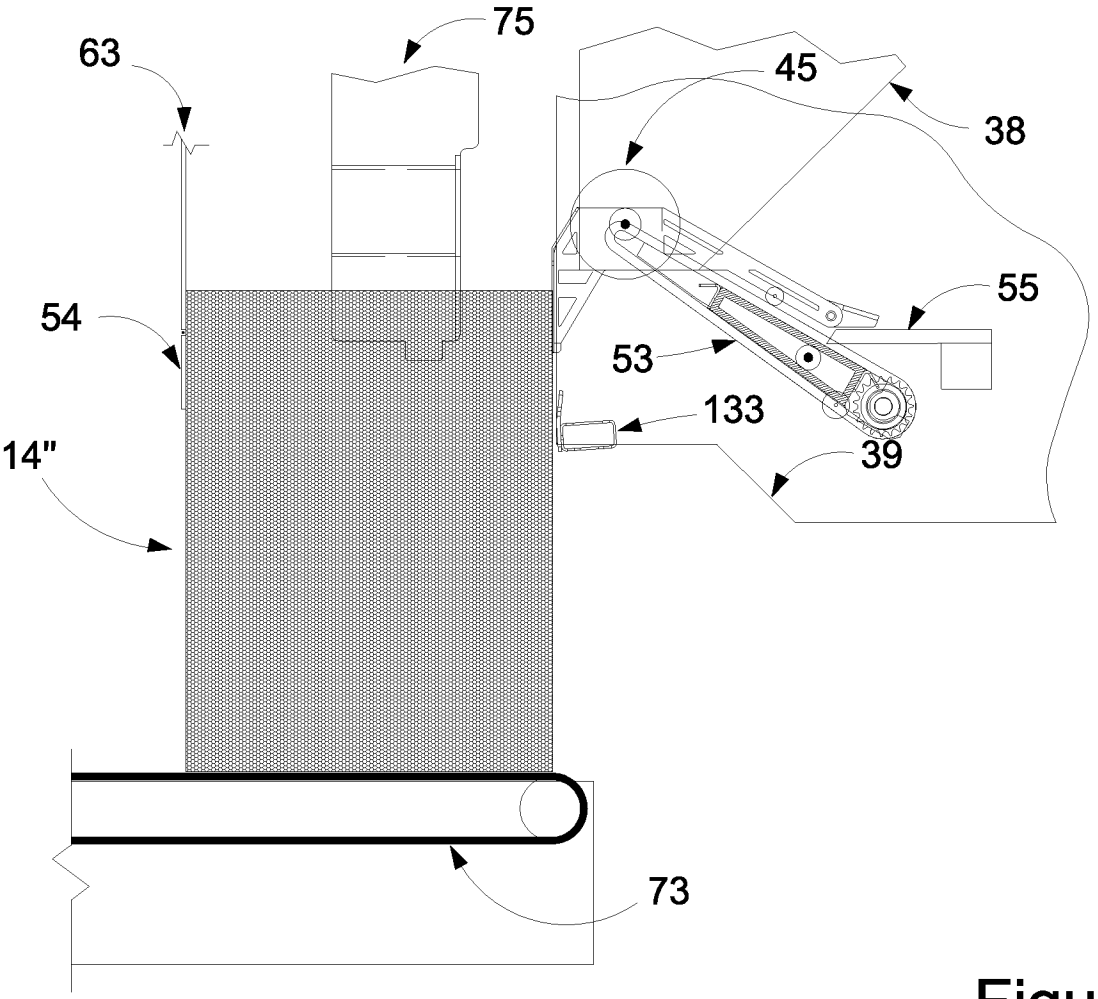

FIGS. 10A and 10B shows placement of Stacking Deck Belt Control Pulleys 71 which are disposed upstream of the respective Stacking Deck Discharge Pulleys 46 and which are also attaches to the Pulley Teeth Weldments 70. The Stacking Deck Belt Control Pulleys 71 control the belt paths of the Stacking Deck Belts 47 such that when the Stacking Deck Discharge End 41 of the Stacking Deck 33 is elevated to its maximum, the amount of Linear Space 29 made available for parking therein of various components of the Improved Stacker Load Change Cycle Apparatus 6 (e.g., the Accumulator Fingers Assembly 129 and the Trail Edge Comb Assembly 130) is sufficient. (It is to be understood that as the elevation angle of the Stacking Deck Discharge End 41 decreases, even more space is created. However, the critical issue is how much parking space is available for the to be parked components when the elevation angle of the Stacking Deck Discharge End 41 is maximized.) As can be seen in FIG. 10B, two of the Stacking Deck Belt Control Pulleys 71 are spaced apart from one another so as to increase the lateral dimension of the available Linear Space 29 in the upstream direction. The downstream end of the Linear Space 29 terminates with the downstream circumferential extent of the Stacking Deck Discharge Pulley 46. Components parked in the Linear Space 29 can be selectively moved in the downstream direction to interject between boxes 10 accumulating in the vertical stacks accumulating region and can thereafter be retracted so as to be parked outside of the stacks accumulating region and not interfering with boxes falling into the stacks accumulating region. (See briefly and for example, kinematic snapshot FIG. 49 showing parking of the Accumulator Fingers 53.)

Figures 11A, 11B:
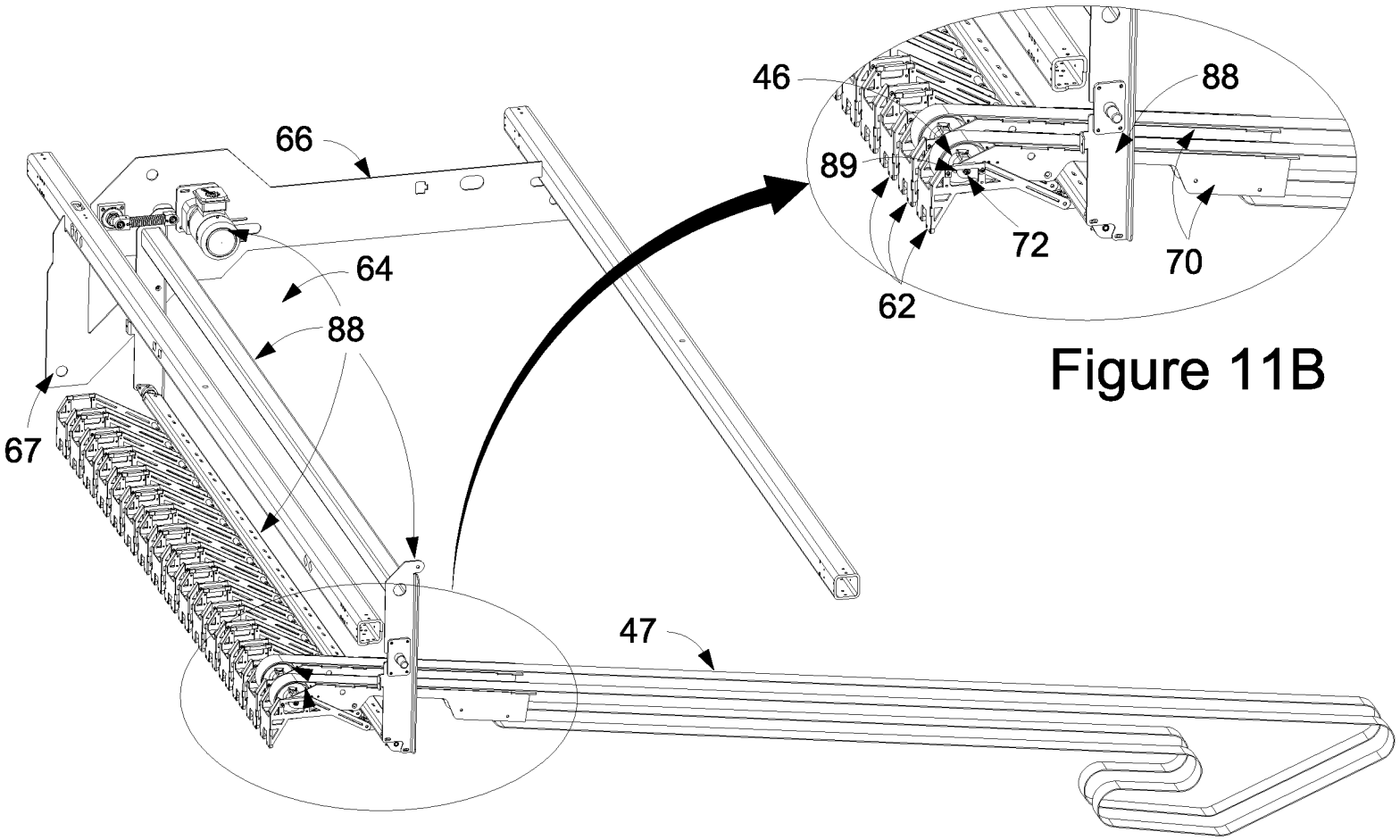
FIGS. 11A and 11B are simplified perspective views with details of the construction of Trail Edge Tamper Assembly

FIGS. 11A and 11B are simplified perspective views of the construction of Trail Edge Tamper Assembly 64. Trail Edge Tamper Drive Assembly 88 is operatively connected to the Deck Lift Frame 66. Stacking Deck 33 has a Deck Pivot Connection 67 pivotally coupled to the Deck Lift Frame 66.

Only a reduced portion of Stacker Deck 33 is shown in these figures for clarity. The Pulley Teeth Weldments 70, the Stacking Deck Discharge Pulley 46, and the Trail Edge Tamper Rollers 72 are shown providing a vertical constraint for the Trail Edge Tampers 62 by engaging with them in the Trail Edge Tamper Slide Slots 89.

Figures 12A, 12B, 12C:
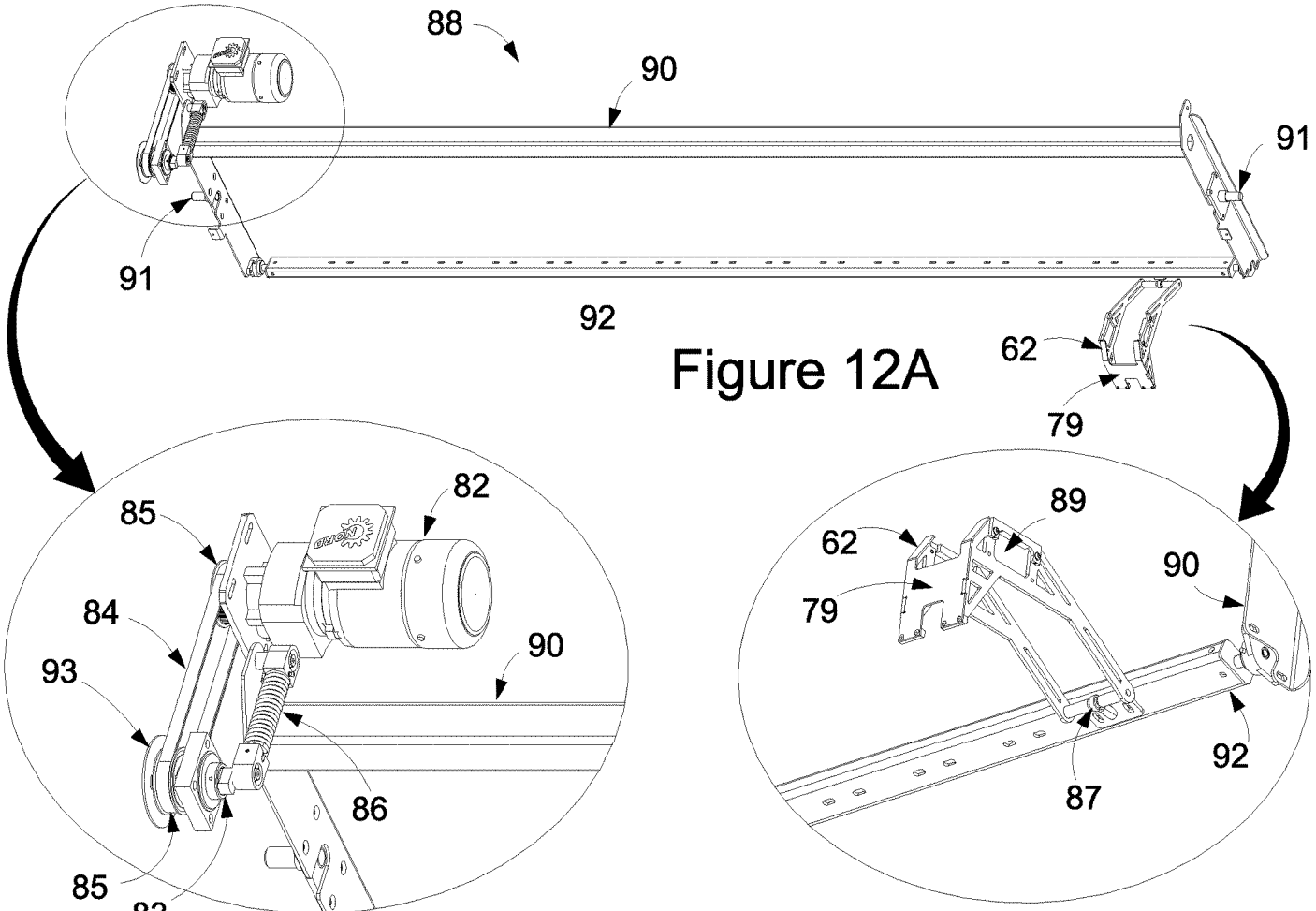
FIGS. 12A, 12B and 12C are simplified perspective views of the construction of the Trail Edge Tamper Drive Assembly and the connections to the Trail Edge Tampers.

FIGS. 12A, 12B and 12C are simplified perspective views of the construction of the Trail Edge Tamper Drive Assembly 88 and the connections to the Trail Edge Tampers 62. The Trail Edge Tamper Drive Frame 90 is connected to the Deck Lift Frame 66 by a Trail Edge Assembly Pivot Connection 91. Also connected to the Deck Lift Frame 66 is a Trail Edge Tamper Motor 82 which drives the motive input of a Trail Edge Crank 83 with a Crank Belt 84 and Crank Pulleys 85. The output shaft of the Trail Edge Crank 83 is connected to Trail Edge Tamper Drive Frame 90 by spring loaded Trail Edge Drive Linkage 86. Actuation of the Trail Edge Tamper Motor 82 causes the Trail Edge Tamper Drive Frame 90 to oscillate about Trail Edge Assembly Pivot Connection 91. One or more of the Trail Edge Tampers are rigidly connected to a Trail Edge Swing Bar 92 with the other Trail Edge Tampers 62 being connected to Trail Edge Tamper Drive Frame 90 by way of a Trail Edge Spherical Connection 87 through Trail Edge Swing Bar 92. This constrains the back portion of the Trail Edge Tamper 62 to follow an arc motion of the Trail Edge Tamper Drive Frame 90 and also constrains in the cross machine direction. A pair of Trail Edge Tamper Rollers 72 engage the Trail Edge Tamper Slide Slots 89 providing a vertical constraint for the downstream end of the Trail Edge Tampers 62. As a result, the Trail Edge Tampers 62 will oscillate such that each Trail Edge Tamping Surface 79 stays roughly vertical with the closest to vertical orientation being when fully extended downstream towards the area of the Dynamic Hopper. A Trail Edge Sensor 93 gives the Computer Control System 50 feedback to track the position of the Trail Edge Tamping Surfaces 79 and thus allows the Computer Control System 50 to selectively position the surface in order to optimize the vertically aligned stacking of the Boxes 10 by use of the laterally oscillating Trail Edge Tampers 62. For instance, when dropping the nascent Load 14''' onto the Load Conveyor 14 (see briefly FIG. 47), having the Trail Edge Tamping Surface 79 pause while fully extended in the downstream direction helps with the load quality.

Figures 13A, 13B, 13C:
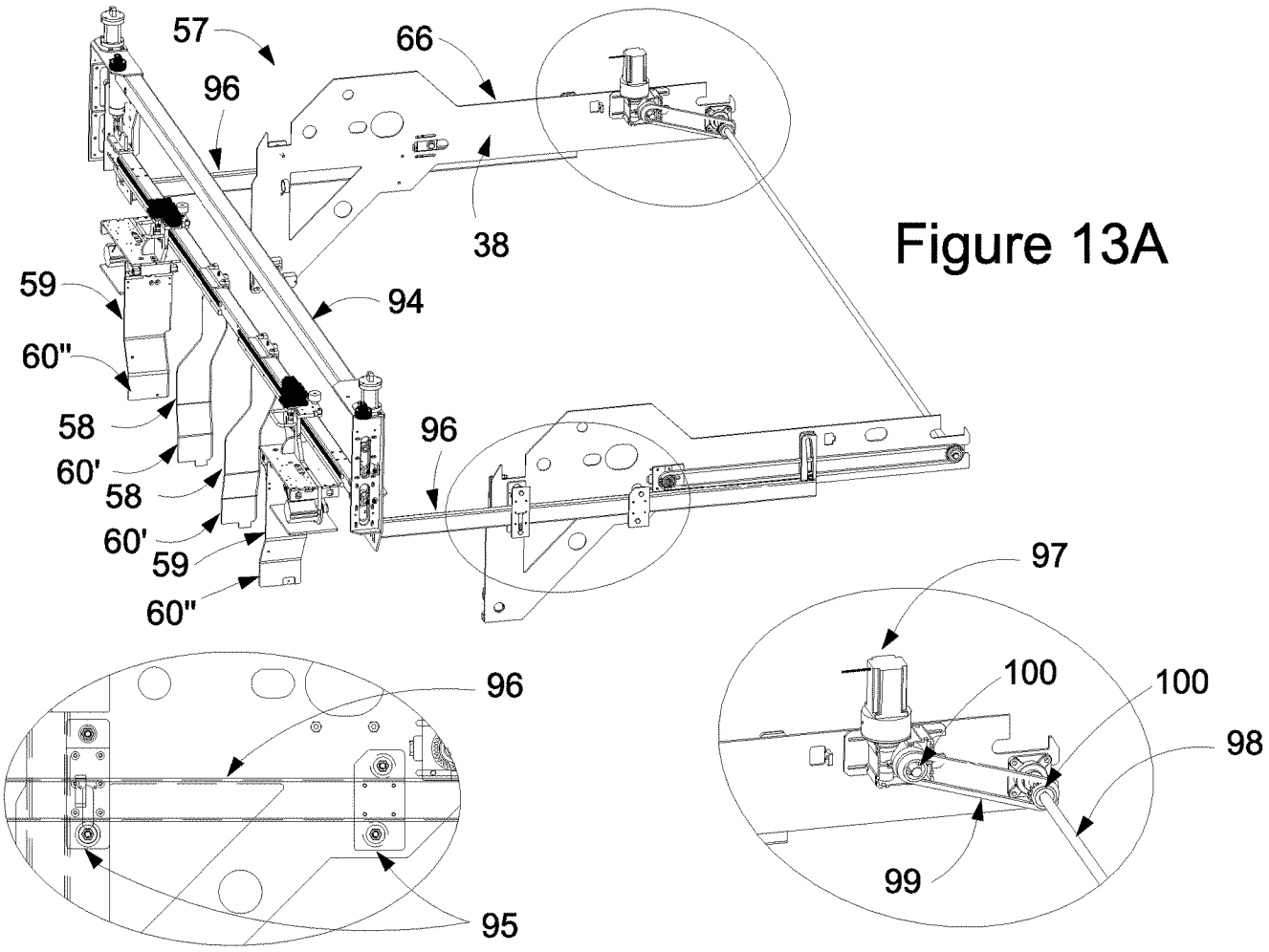
FIG. 13A is a simplified perspective view of the construction of a Cross Machine Stack Alignment System.
FIG. 13B is a detail perspective view of an Accessory Rail System positioning drive system.
FIG. 13C is a side view of a plurality of Accessory Rail Supports Slides

FIG. 13A is a simplified perspective view of the construction of a Cross Machine Stack Alignment System 57. FIG. 13B is a detail perspective view of an Accessory Rail System 94 positioning drive system. FIG. 13C is a side view of a plurality of Accessory Rail Supports Slides 95. These views detail the degrees of freedom afforded for horizontal motion of the Accessory Rail System 94 in the material flow direction. The Accessory Rail System 94 provides a vertical degree of freedom and a cross machine degree of freedom for the sub-assembly Stack Side Dividers 58 and Stack Side Tampers 59. The Stack Side Tampers 59 tamper loads in the cross machine direction so as to provide loads that are not only squared along their upstream and downstream sides but also generally vertically aligned along their opposed cross machine facing sides. (See briefly FIG. 38A.) The Cross Machine Stack Alignment System 57 is operatively connected to Deck Lift Assembly 38 and thus changes elevation with vertical movement of the Deck Lift Assembly 38.

Accessory Rail Motor 97 is mounted to the Deck Lift Frame 66 and drives the Accessory Rail Synchronizing Shaft 98 with chain 99 and sprockets 100. The Accessory Rail Synchronizing Shaft 98 in turn drives the Accessory Rail Positioning Chains 101 which are operatively connected at to Accessory Rail Supports 96 by way of an Accessory Rail Support Chain Connect 102. Accessory Rail Supports 96 are constrained by the Accessory Rail Support Slides 95 which are connected to the Deck Lift Frame 66 such that the Accessory Rail System 94 is cantilevered from the Deck Lift Frame 66.

Figure 14:
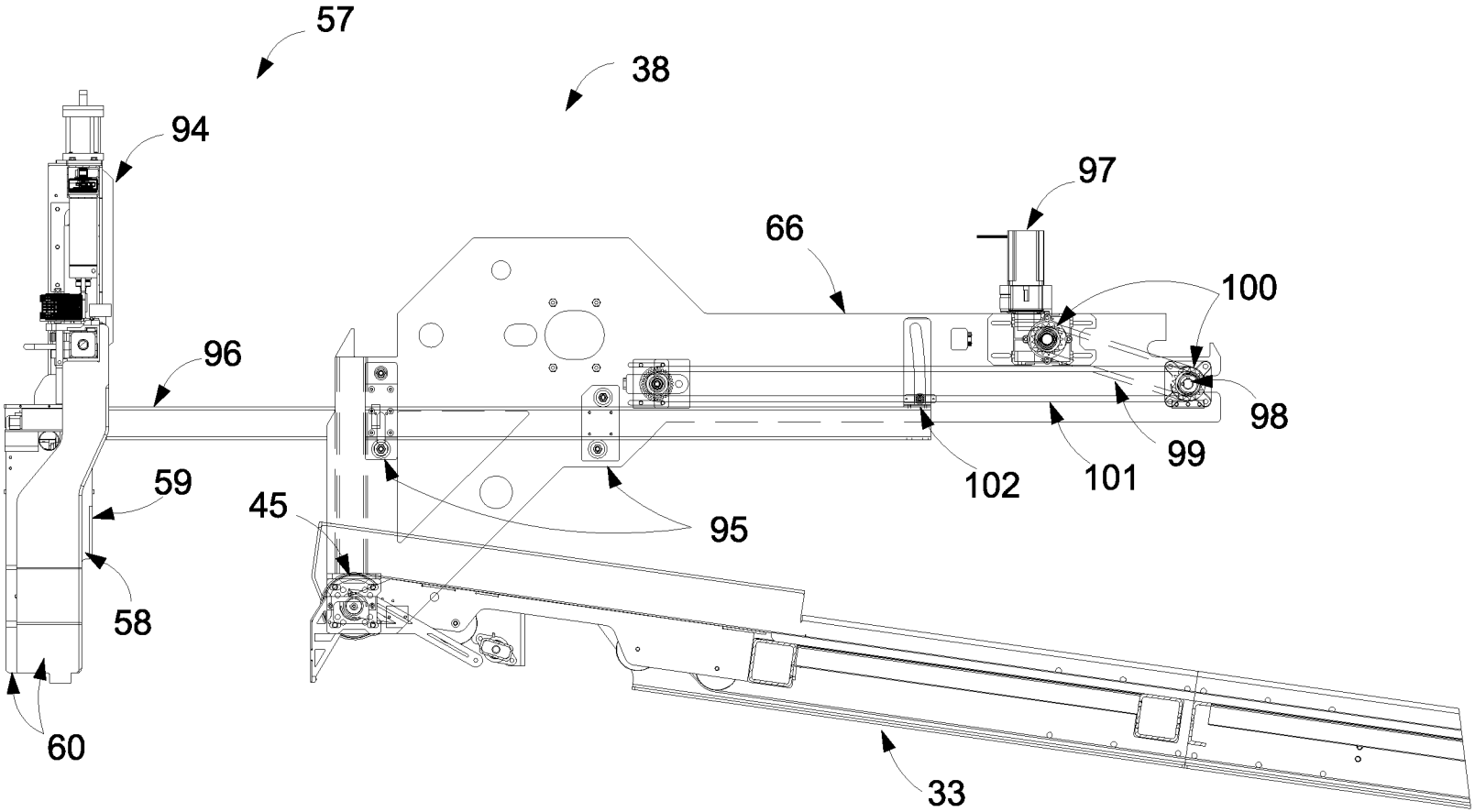
FIG. 14 is a side view of the Cross Machine Stack Alignment System.

FIG. 14 is a side view of the Cross Machine Stack Alignment System 57. The relationship of the Stack Side Alignment Surfaces 60' and 60" to the Stack Build Elevation 61 is dynamic and important for quality stack building. More specifically and as detailed below, the Stack Side Alignment Surfaces 60' and 60" are from time to time moved vertically out of the way so that the Accumulator Fingers 53 can be interjected into the vertical stacks accumulating area for separating a completing first stack from a newly beginning and thus nascent second stack.

Figure 15B:
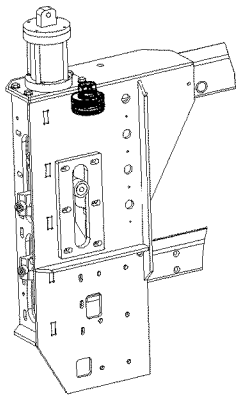
FIGS. 15A, 15B, 15C and 15D provide a simplified perspective view and detail views of the construction of the Accessory Rail System.
Figure 15C:
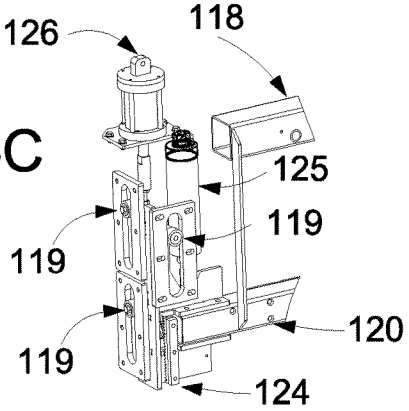
Figure 15D:
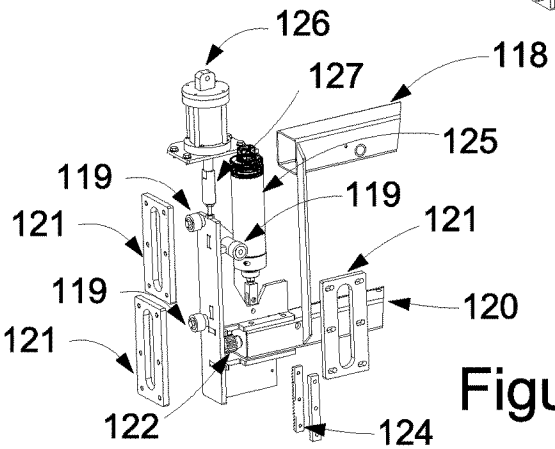
Figure 15A:
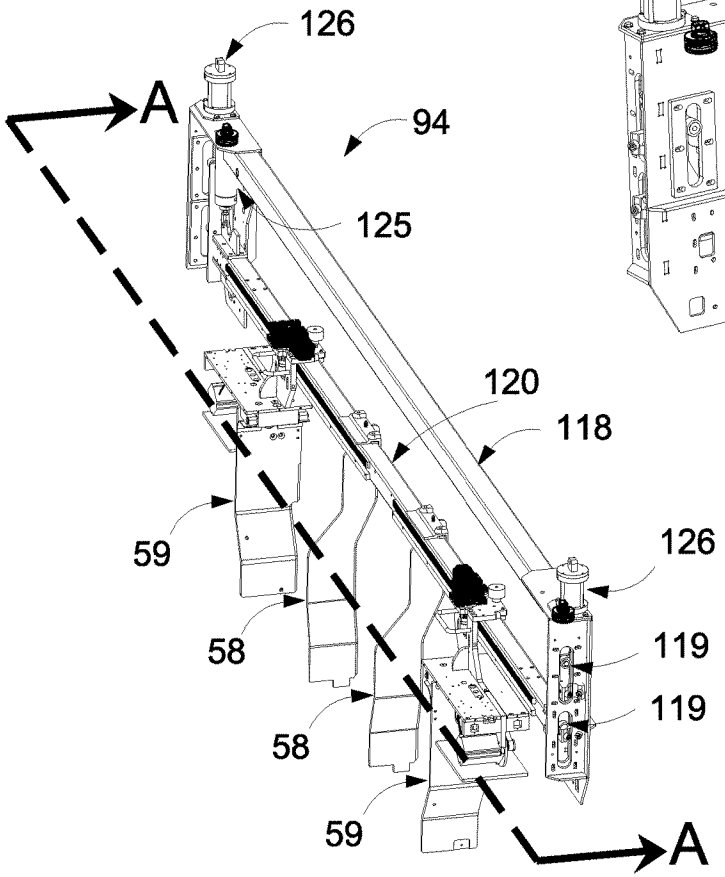

FIG. 15A is a simplified perspective view of the construction of the Accessory Rail System 94. FIGS. 15B and 15C are detailed views of FIG. 15A with additional items removed for clarity. FIG. 15D is an exploded perspective view of FIG. 15C.

Figure 16:
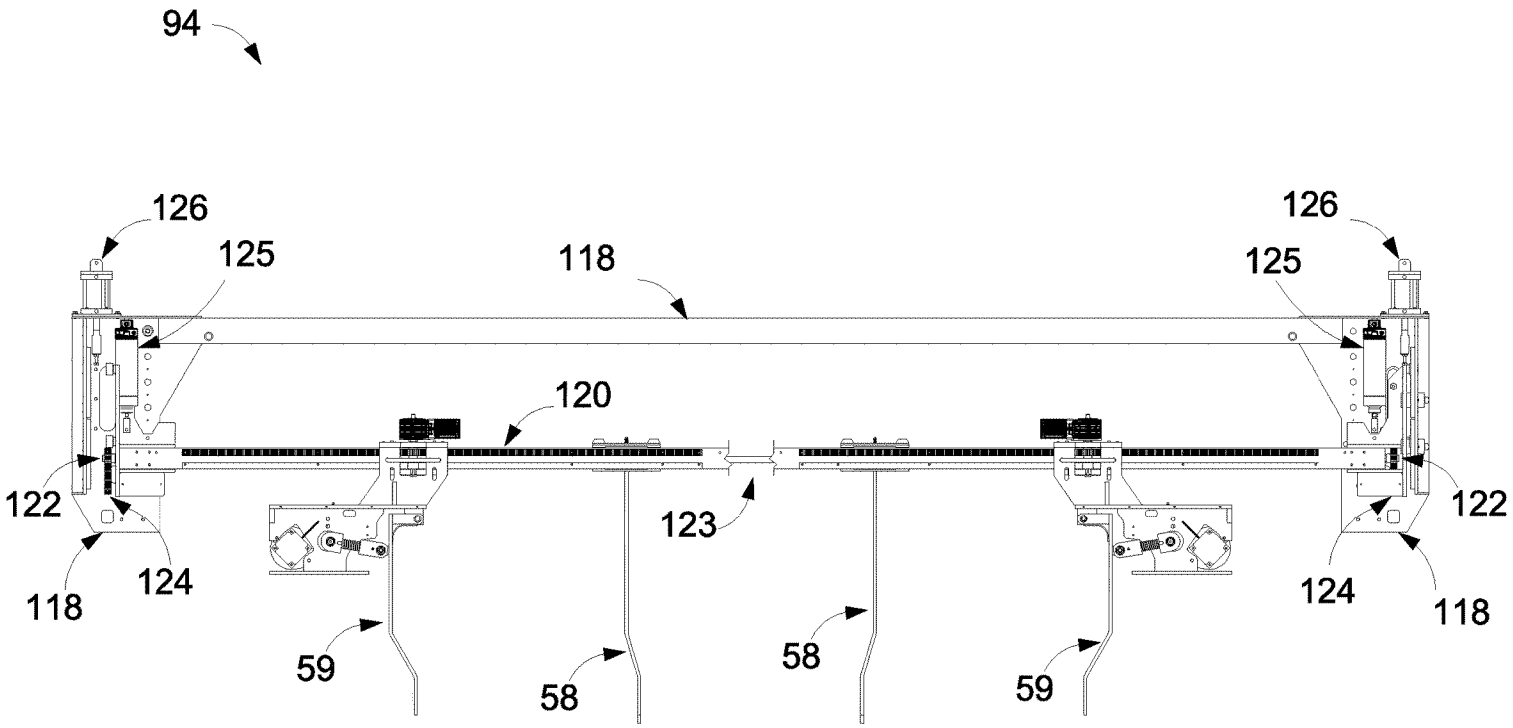
FIG. 16 is an end view of FIG. 15A along line A-A.

FIG. 16 is an end view of FIG. 15A along line A-A. A cutaway is used on the middle of the Accessory Rail to show an Accessory Rail Pinion Shaft 123.

An Accessory Rail Frame 118 is attached and supported by the Accessory Rail Supports 96. The Accessory Rail 120 is the structure upon which the various stack alignment accessories can attach and move in the cross machine direction. Two of these accessories are the Stack Side Dividers 58 and the Stack Side Tampers 59. Their ability to be positioned in the cross machine direction can be manual, motorized or automatically positioned by means of known technology including for example servo driven electrical and/or pneumatic motors. The Improved Stacker Load Change Cycle Apparatus 6 has the ability to vertically position the Accessory Rail 120 selectively by the Computer Control System 50. In this embodiment, there are three distinct positions, one of them being where the Stack Side Alignment Surfaces 60' and 60" are moved vertically out of the way so that the Accumulator Fingers 53 can be interjected into the stacks accumulating area for separating a completing first stack from a newly beginning and thus nascent second stack. An alternate option would include using a variable positioning actuator.

The Accessory Rail 120 is constrained to move only vertically by Accessory Rail Rollers 119 which are operatively connected to Accessory Rail 120 and are guided by Accessory Rail Slotted Guides 121 which are operatively connected to the Accessory Rail Frame 118. In order to constrain the Accessory Rail 120 to stay relatively horizontal, a synchronizing rack and pinion system is implemented with Accessory Rail Pinions 122 on both ends of Accessory Rail Pinion Shaft 123. The Accessory Rail Racks 124 operatively connect to the Accessory Rail Frame 118.

The Accessory Rail 120 actuators are symmetrically positioned in the cross machine direction. Accessory Rail Full Stroke Cylinders 125 are provided and operatively connected between the Accessory Rail Frame 118 and the Accessory Rail 120. A second independent pair to Accessory Rail Limiting Cylinders 126 are connected to the Accessory Rail Frame 118 and positioned so that when extended an Accessory Rail Limiting Surface 127 will effectively stop the Accessory Rail 120 from going all the way to its full up position. The effective strength of Accessory Rail Limiting Cylinders 126 are greater than that of Accessory Rail Full Stroke Cylinders 125. This allows the Computer Control System 50 to selectively position the Accessory Rail 120 in a Down Position 74 by extending Accessory Rail Full Stroke Cylinders 125. This also allows the Computer Control System 50 to selectively position the Accessory Rail 120 in an Up Position 76 (see briefly FIG. 58) by retracting both Accessory Rail Full Stroke Cylinders 125 and Accessory Rail Limiting Cylinders 126. This further allows the Computer Control System 50 to selectively position the Accessory Rail 120 in a Middle Position 75 (see briefly FIG. 46) by retracting the Accessory Rail Full Stroke Cylinders 125 and extending the Accessory Rail Limiting Cylinders 126.

Figure 17A:
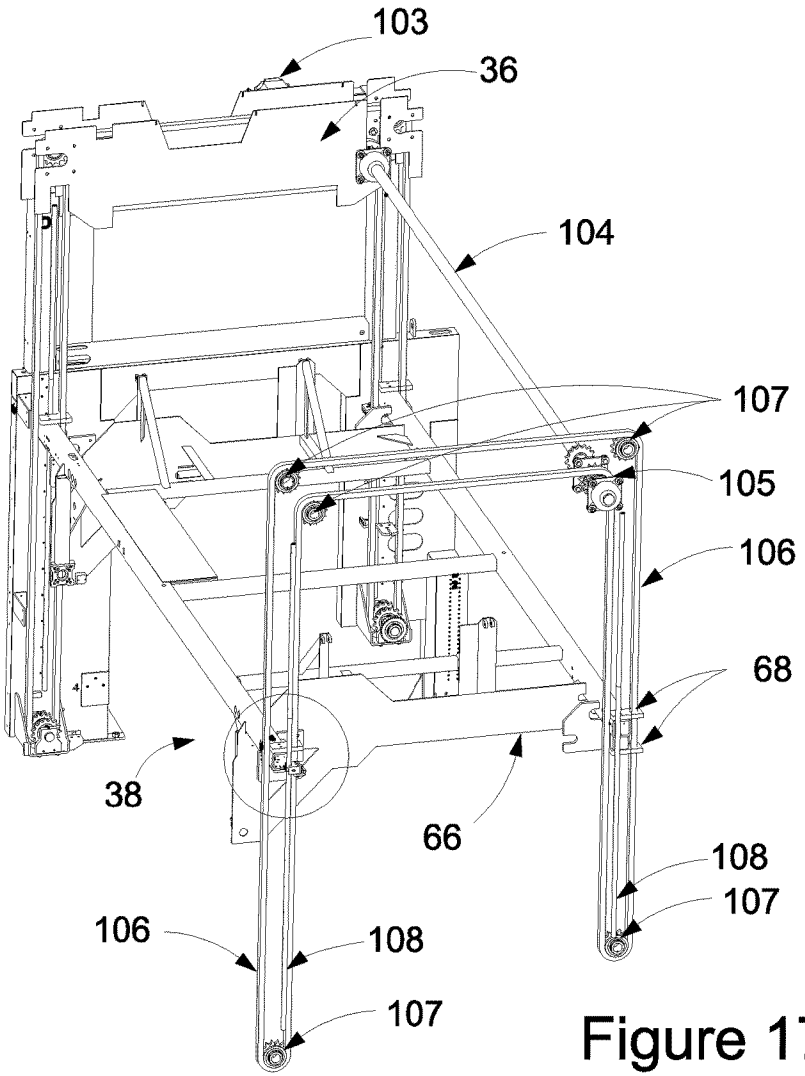
FIGS. 17A and 17B provide a simplified perspective view and detail views of the lifting means in one embodiment for the Deck Lift Assembly.
Figure 17B:
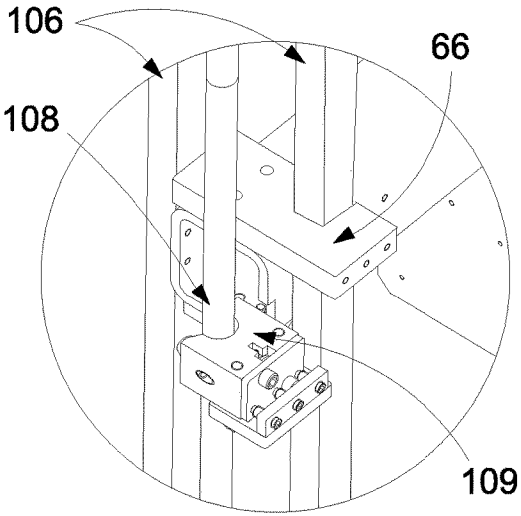

FIG. 17A is a simplified perspective view of the lifting means in one embodiment for the Deck Lift Assembly 38. FIG. 17B is a detail view of 17A. Most components have been removed for clarity showing primarily the Deck Lift Frame 66, a portion of the Gantry 36 and the elements that actually perform the lifting and provide constraints. Besides the single motor, all other elements are symmetrical across the machine. Deck Lift Gear-Motor 103 drives a Deck Lift Synchronizing Shaft 104. Deck Lift Drive Sprockets 105 convert the torque into a drive force in Deck Lift Chains 106. The Deck Lift Chains 106 follow the paths defined by Deck Lift Idler Sprockets 107 which operatively connected to the Gantry 36. The Deck Lift Chains 106 attach to the Deck Lift Frame 66 at the Deck Lift Chain Attachments 68.

The Deck Lift Assembly 38 is constrained to move only vertically. Vertical Rails 108 operatively connect to the Gantry 36. Deck Lift Slide Blocks 109 are mounted to the Deck Lift Frame 66 and attach to the Vertical Rails 108.

Figure 18:
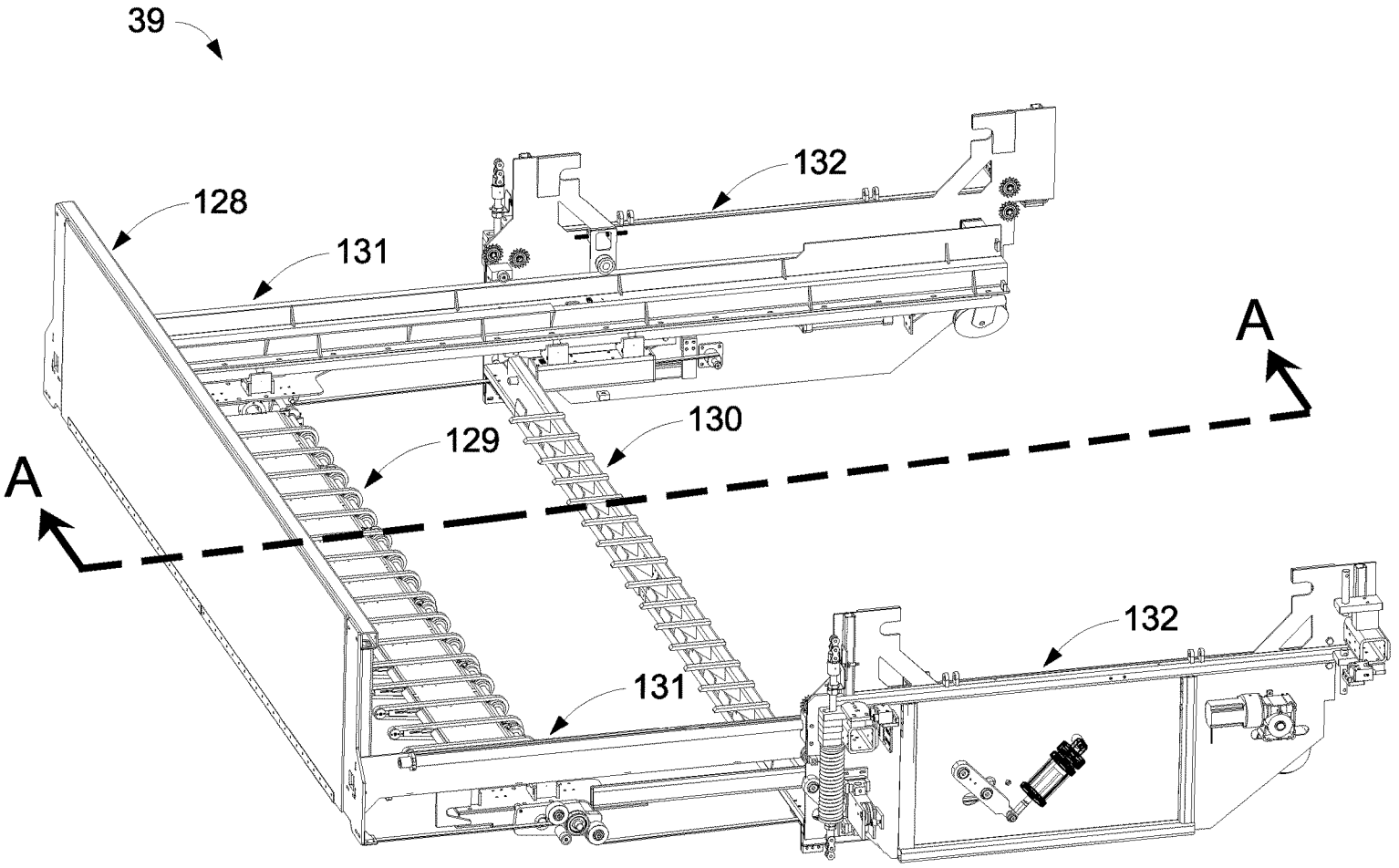
FIG. 18 is an assembled perspective view showing the Accumulator Assembly.

FIG. 18 is an assembled perspective view showing the nascent stacks Accumulator Assembly 39. This assembly has the following sub-assemblies, a Backstop Assembly 128 extending both vertically and in the cross machine direction and against which lead edges of downstream flung boxes engage, the Accumulator Fingers Assembly 129 extending in the cross machine direction, the Trail Edge Comb Assembly 130 also extending in the cross machine direction, Accumulator Side Rails 131 extending in the downstream direction, the Lower Stack Stop Assembly 133 (see briefly FIGS. 19-20) and the Accumulator Lift Assemblies 132.

Figure 19:
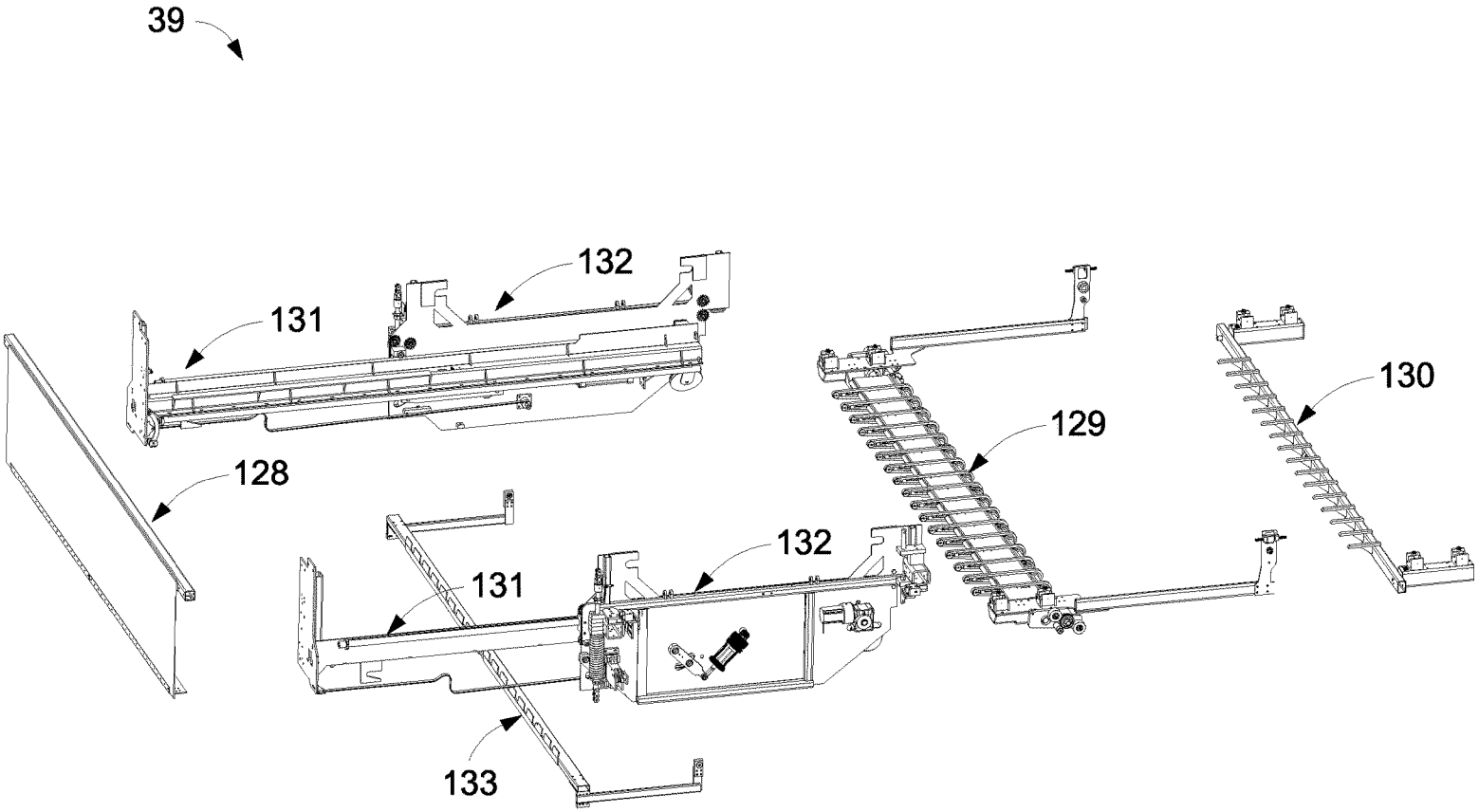
FIG. 19 is an exploded perspective view of the Accumulator Assembly of FIG. 18.

FIG. 19 is an exploded perspective view of the Accumulator Assembly 39.

Figure 20:
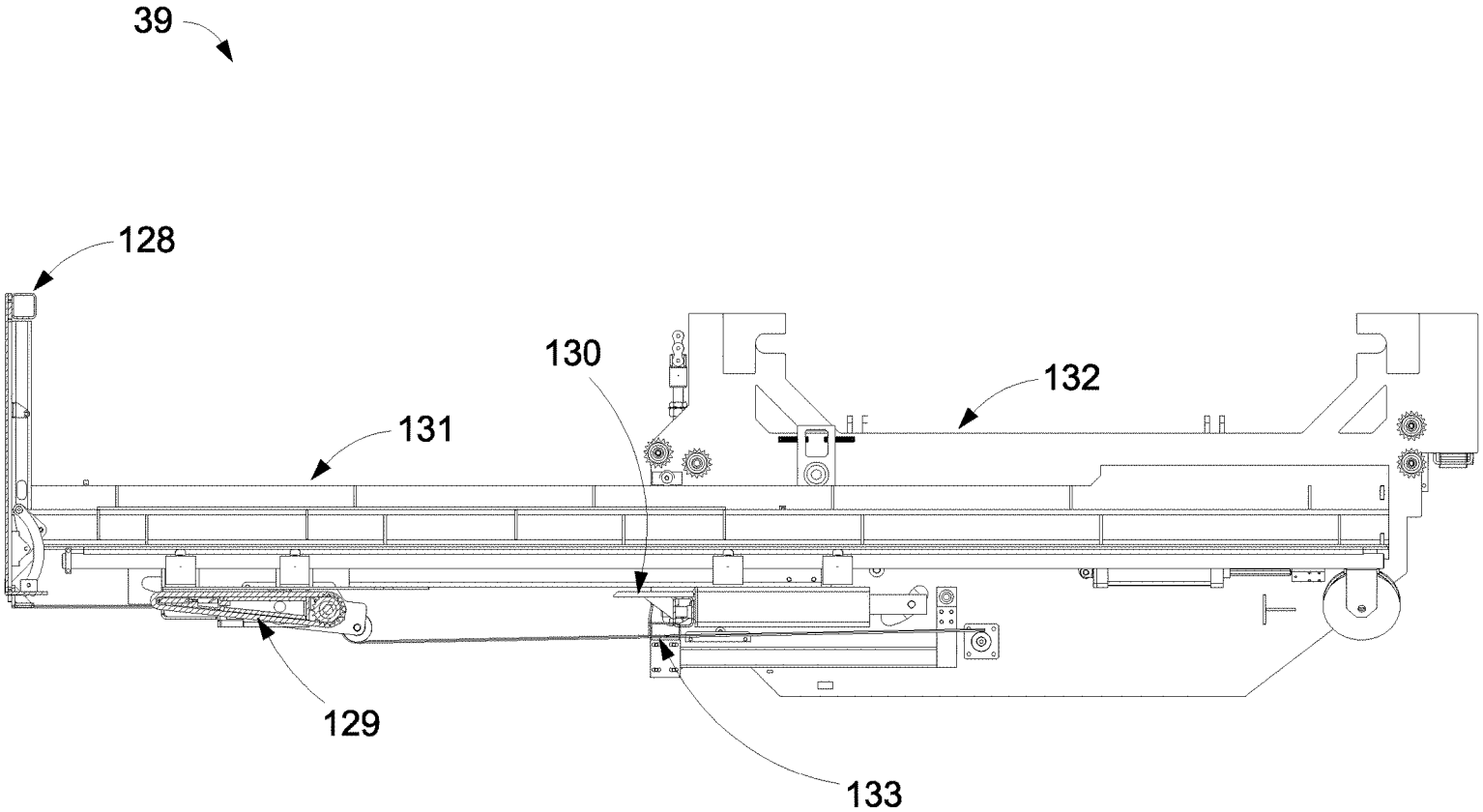
FIG. 20 is a cross section along line A-A of FIG. 18.

FIG. 20 is a cross section, view A-A from FIG. 18.

Figure 21:
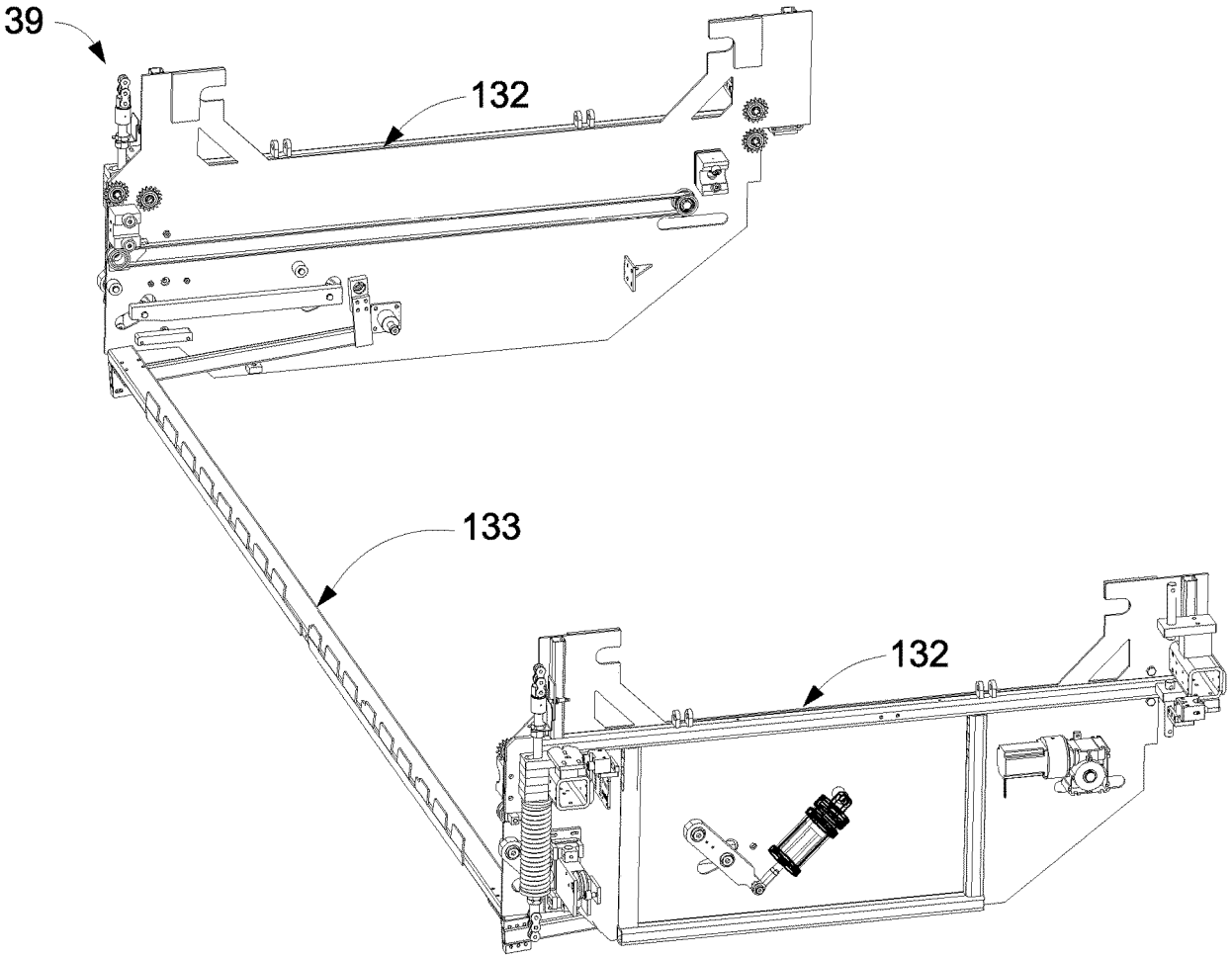
FIG. 21 is a simplified perspective view of the Accumulator Lift Assembly and the Lower Stack Stop Assembly.

FIG. 21 is a simplified perspective view of the Accumulator Lift Assemblies 132 and the Lower Stack Stop Assembly 133.

Each Accumulator Lift Assembly 132 has an Accumulator Lift Frame 134. Attached to each Accumulator Lift Frame 134 is a pair of Accumulator Side Rail Slide Blocks 135 which will allow the Accumulator Side Rails 131 to maintain the same elevation as the Accumulator Lift Assembly 132 and have a degree of freedom in the material flow direction. Attached to each Accumulator Lift Frame 134 is a plurality of Accumulator Finger Chain Idler Sprockets 136. These control a chain path that drives the Accumulator Fingers Assembly horizontally. (In one embodiment, the Accumulator Fingers 53 may also be rotated about their upstream ends—see briefly FIGS. 51-56.)

Figure 64:
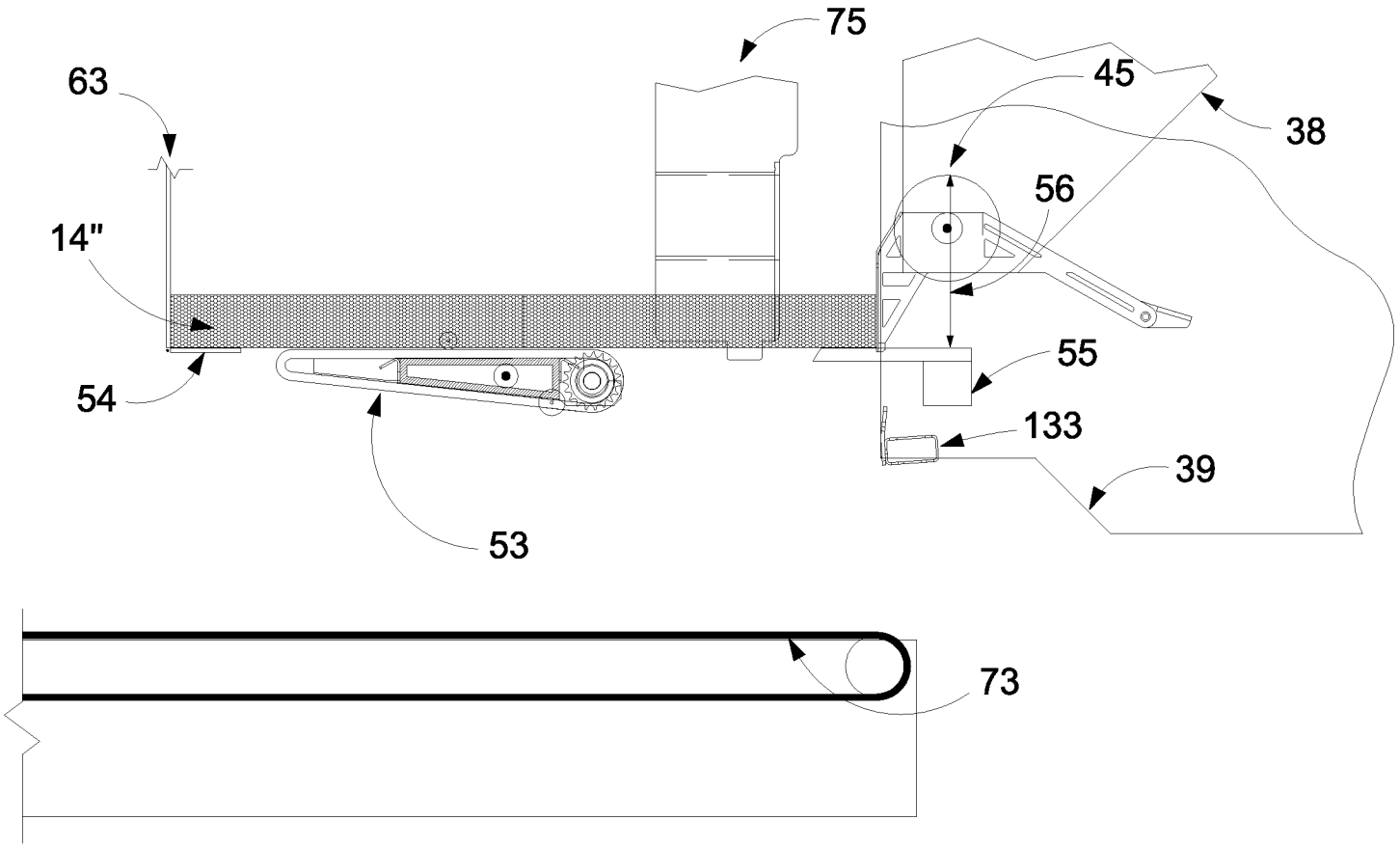
Figure 65:
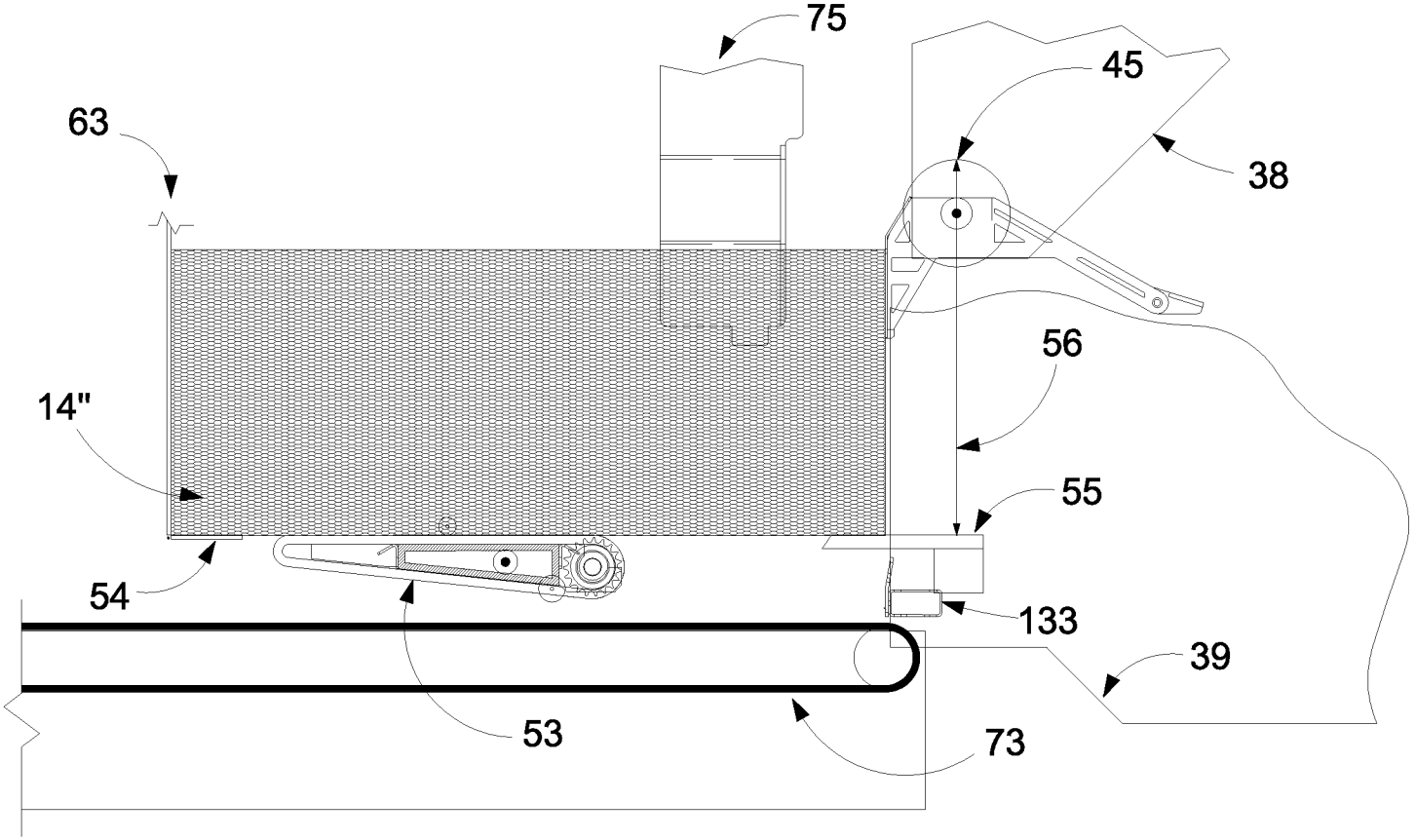

The Lower Stack Stop Assembly 133 is attached to each Accumulator Lift Frame 134 with a pivot connection which allows the Lower Stack Stop Comb 137 to move closer and mesh with the bottoms of the Accumulator Fingers 53 when near the Load Conveyor (see briefly FIGS. 64-65). During the dropping of a stack onto the Load Conveyor 73, the Lower Stack Stop Comb 137 provides a surface to help maintain the quality of the stack during this process.

Figure 22A:
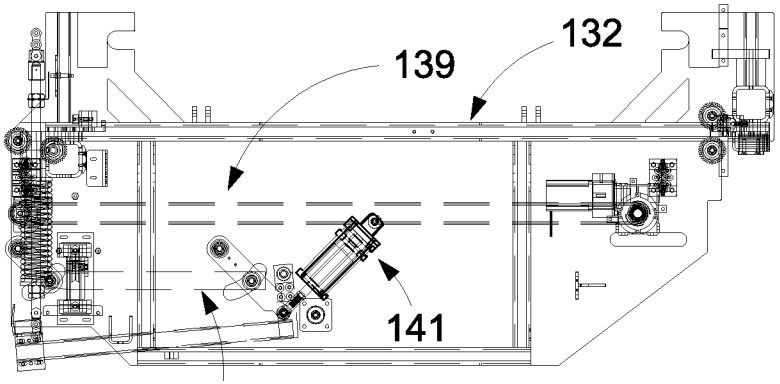
FIGS. 22A, 22B and 22C depict the linkages that allow the Computer Control System to selectively change the downstream inclination angle of the Accumulator Fingers between horizontal, tilted up and tilted down
Figure 22B:
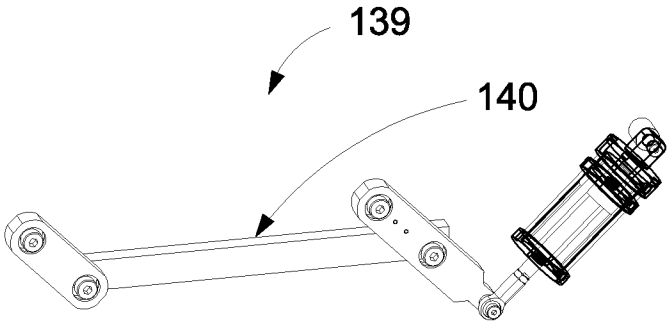
Figure 22C:
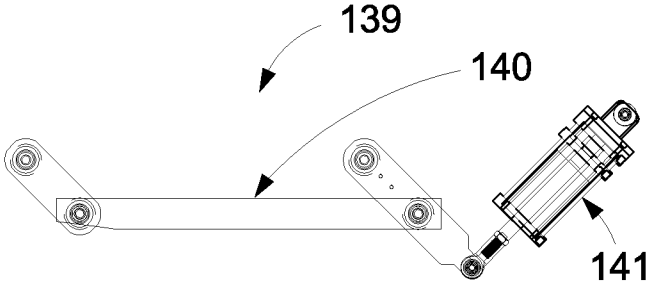

FIGS. 22A, 22B and 22C depict the linkages that allow the Computer Control System 50 to selectively change the downstream inclination angle of the Accumulator Fingers 53 between horizontal, tilted up and tilted down. The Accumulator Finger Assembly 129 has Accumulator Finger Tilt Rollers 138 which can be forced down to cause the Accumulator Fingers 53 to move from their normal tilted down positions (see briefly FIG. 58 where upper box supporting surfaces of the Accumulator Fingers tilt down) to either horizontal positions (see briefly FIG. 60 where upper box supporting surfaces of the Accumulator Fingers are horizontal when supporting center of box lengths) or tilt up positions (see briefly FIG. 53 where Accumulator Finger Lead Edges 187 (finger tips) of the Accumulator Fingers 53 interject to catch the trailing edge of the first box (sheet) of a new nascent stack). When the Accumulator Fingers 53 are in relatively close proximity to the Accumulator Lift Assemblies 132, the Finger Tilt Linkage 139 can apply force onto Accumulator Finger Tilt Rollers 138 by way of its Finger Tilt Horizontal Bar 140. The three position Finger Tilt Cylinder 141 (of one embodiment), when actuated selectively by the Computer Control System 50 can either leave the Accumulator Fingers 53 in the tilt down position, or rotate them into the horizontal position or to the tilt up position.

Figure 23A:
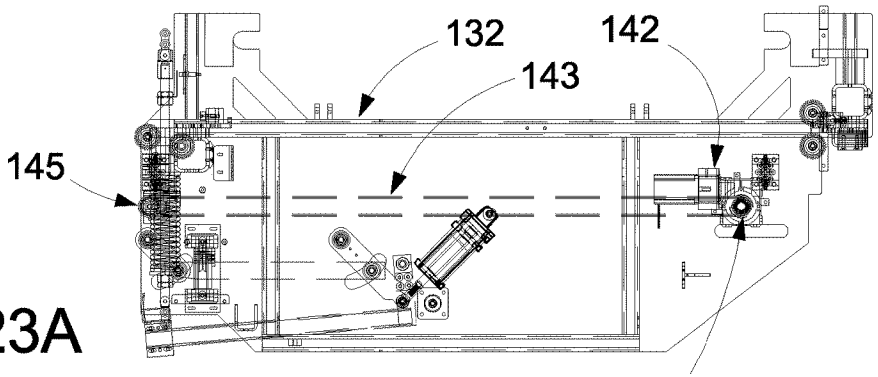
FIGS. 23A, 23B and 23C depict the actuation system which moves the Accumulator Side Rails horizontally
Figure 23B:
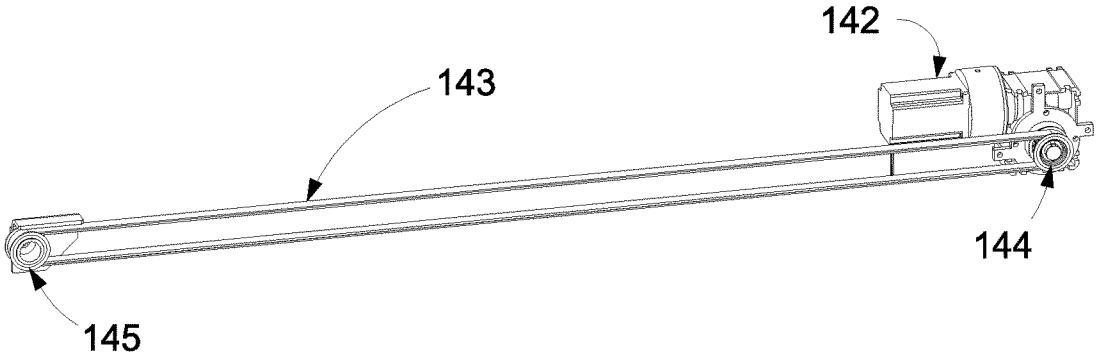
Figure 23C:
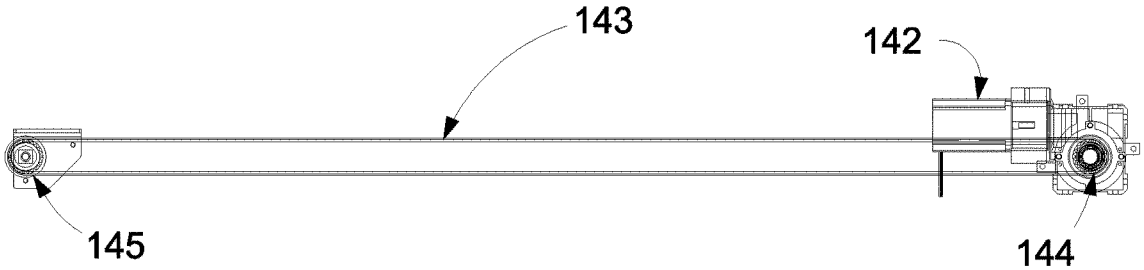

FIGS. 23A, 23B and 23C depict the actuation system which moves the Accumulator Side Rails 131 horizontally. Accumulator Side Rail Motors 142 drive corresponding Accumulator Side Rail Timing Belts 143 with drive pulleys 144 and idler pulleys 145. The Accumulator Side Rails 131 are operatively attached to respective Accumulator Side Rail Timing Belts 143 in order to allow the Accumulator Side Rail Motors 142 to position the Backstop Assembly 128. The Accumulator Side Rail Motors 142 can be either stepper or other types of motors controlled with feedback in order to keep track of positioning. The Computer Control System 50 is used to electronically synchronize both of the Accumulator Side Rails 131 so they remain synchronized with respect to the cross machine direction.

Figure 24:
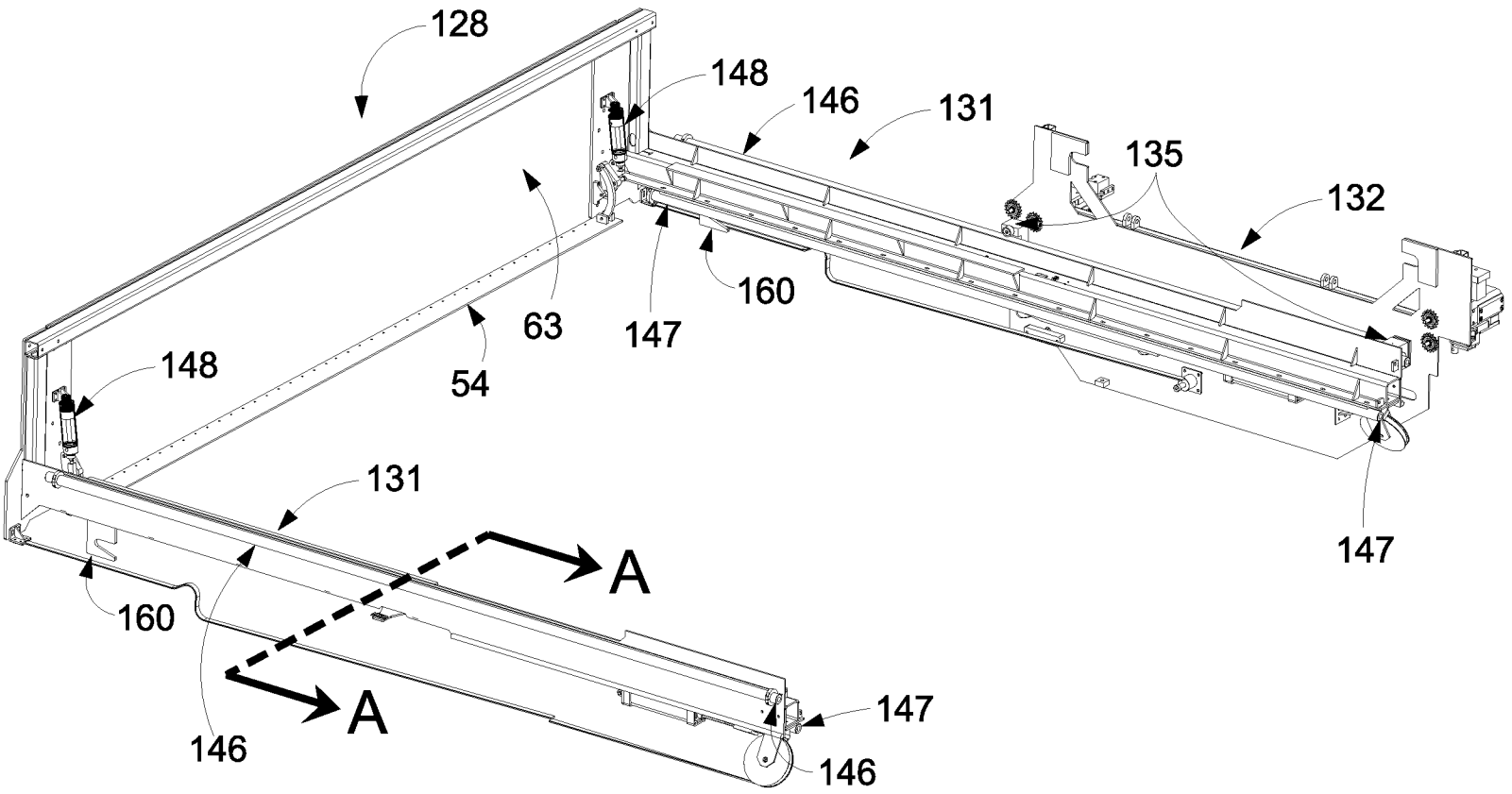
FIG. 24 is a simplified perspective view of the Accumulator Lift Assembly and the Accumulator Side Rails with the Backstop Assembly.
Figure 25A:
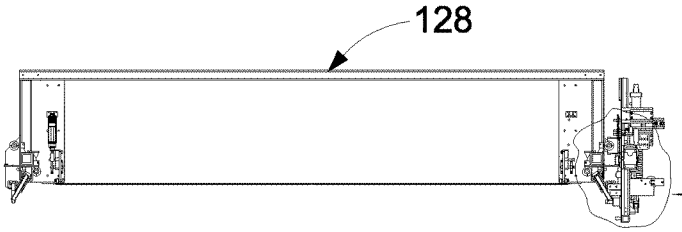
FIGS. 25A and 25B provide cross sectional detail views of FIG. 24 along line A-A.
Figure 25B:
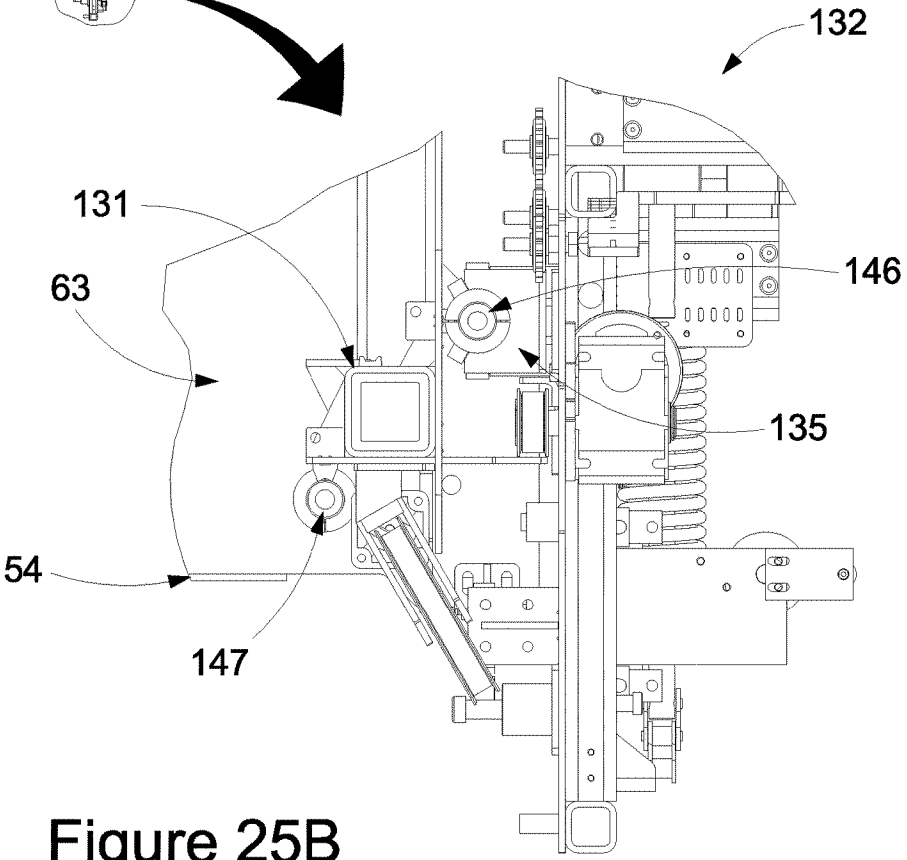

FIGS. 24, 25A and 25B depict the Accumulator Lift Assembly 132 and the Accumulator Side Rails 131 with the Backstop Assembly 128 provided at the downstream end. The Accumulator Side Rails 131 have two linear rails each. The Backstop Linear Rail 146 slides in the Accumulator Side Rail Slide Blocks 135 which allows the Backstop Assembly 128 to be selectively positioned horizontally relative to the Accumulator Lift Assemblies 132. The second linear rail is the Accumulator Linear Rail 147 which allows for the respective selective horizontal motions of the Accumulator Fingers Assembly 129 and Trail Edge Comb Assembly 130 respectively. The Backstop Assembly 128 has a vertical element referred to as the Backstop 63 and a dynamic element referred to as the Backstop Lip 54 where the Backstop Lip 54 is selectively interjectable into and retractable out of the vertical stacks accumulating region. In one embodiment (see briefly kinematic snapshot FIGS. 60-61) the Backstop Lip 54 is moveable via a hinge connection between vertical and horizontal positions. Backstop Lip Cylinders 148 are operatively connected to the Backstop Lip 54 which allows the Computer Control System 50 to selectively move the Backstop Lip between its vertical position in which it is retracted out of the stacks accumulating region (see briefly FIG. 60) and its horizontal position in which it is interjected into the stacks accumulating region (see briefly FIG. 61). The structure of the Backstop Assembly 128 keeps the Accumulator Side Rails 131 from rotating about the Backstop Linear Rails 146.

Figure 26:
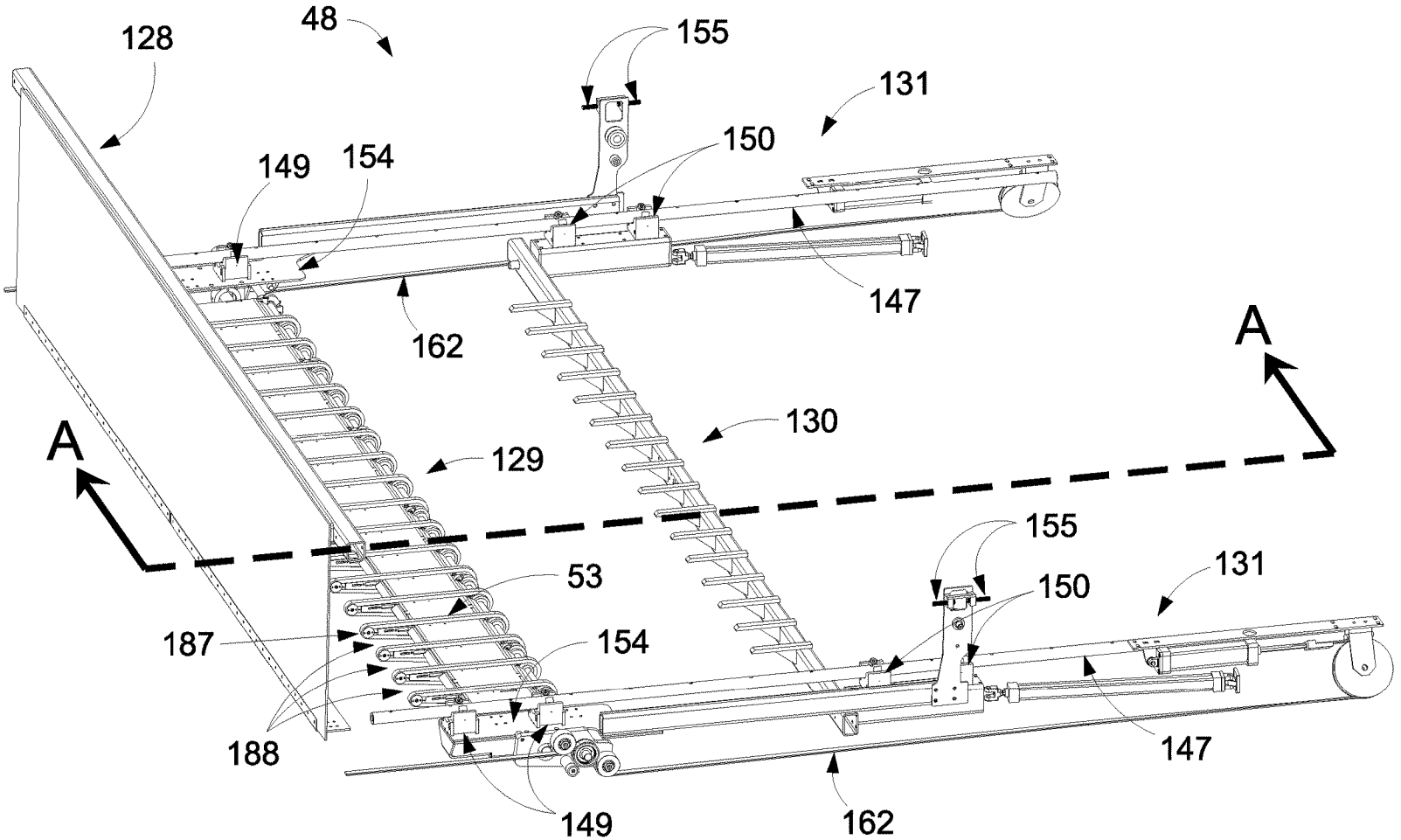
FIG. 26 is a simplified perspective view of the Accumulator Sheet Support System from a generally upstream view.
Figure 27:
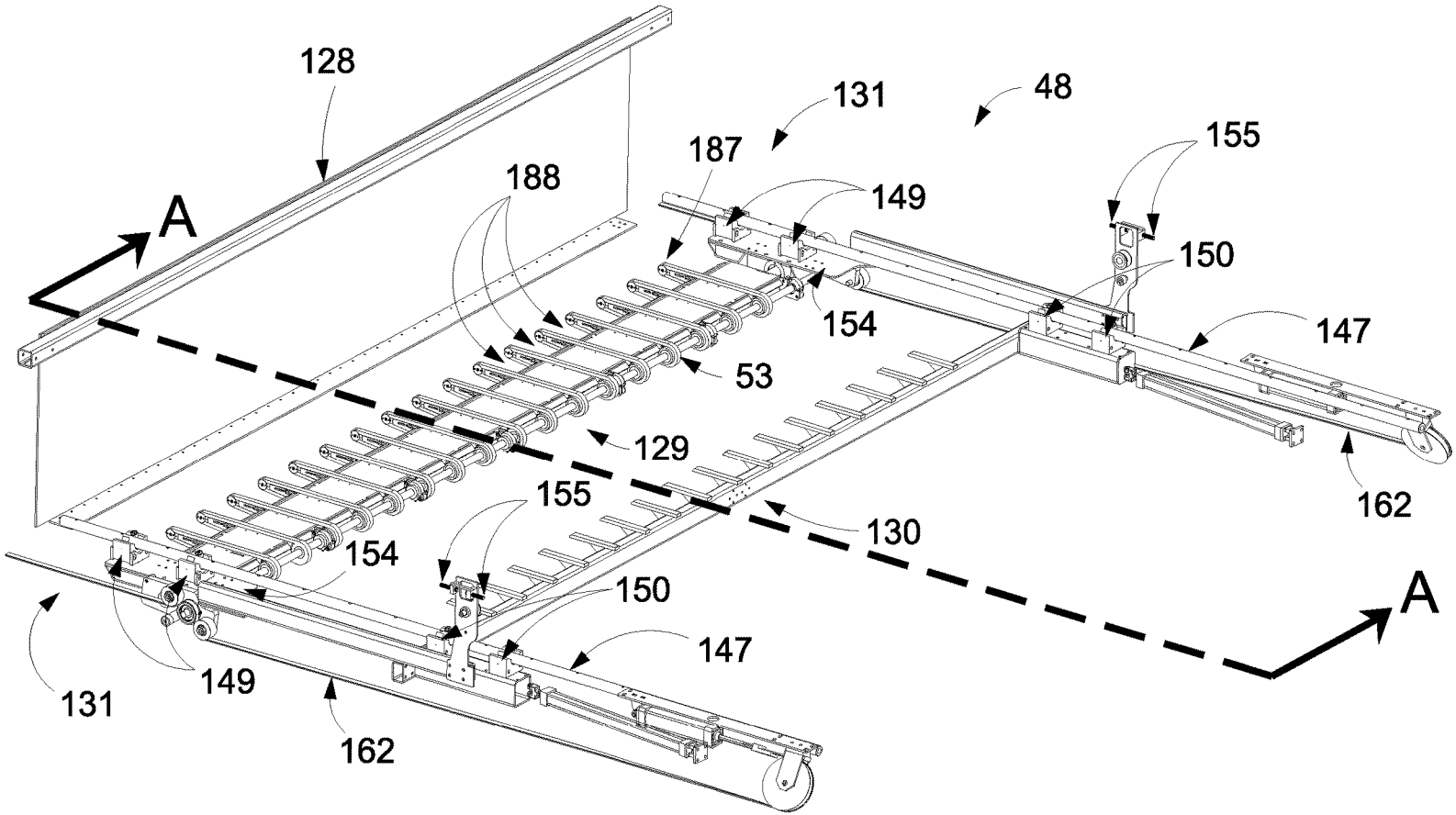
FIG. 27 is a simplified perspective view of the Accumulator Sheet Support System from a downstream view.
Figure 28A:
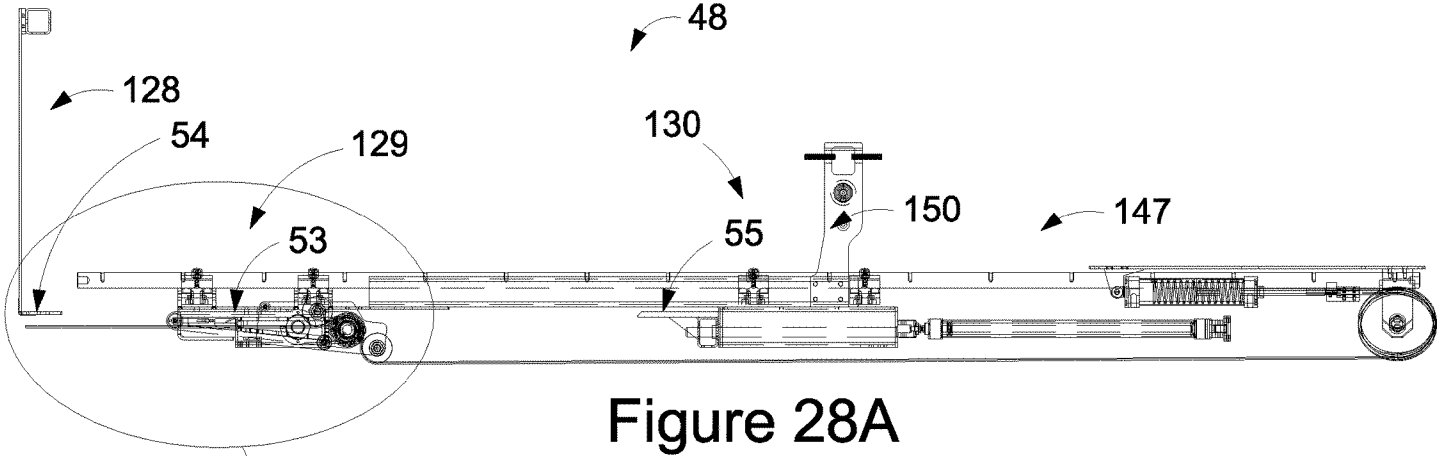
FIGS. 28A and 28B area cross section detail views of FIGS. 26 and 27 along line A-A.
Figure 28B:
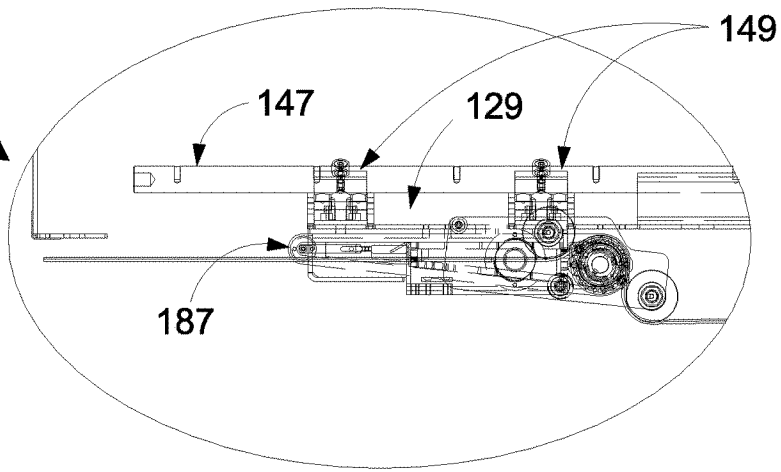
Figure 29A:
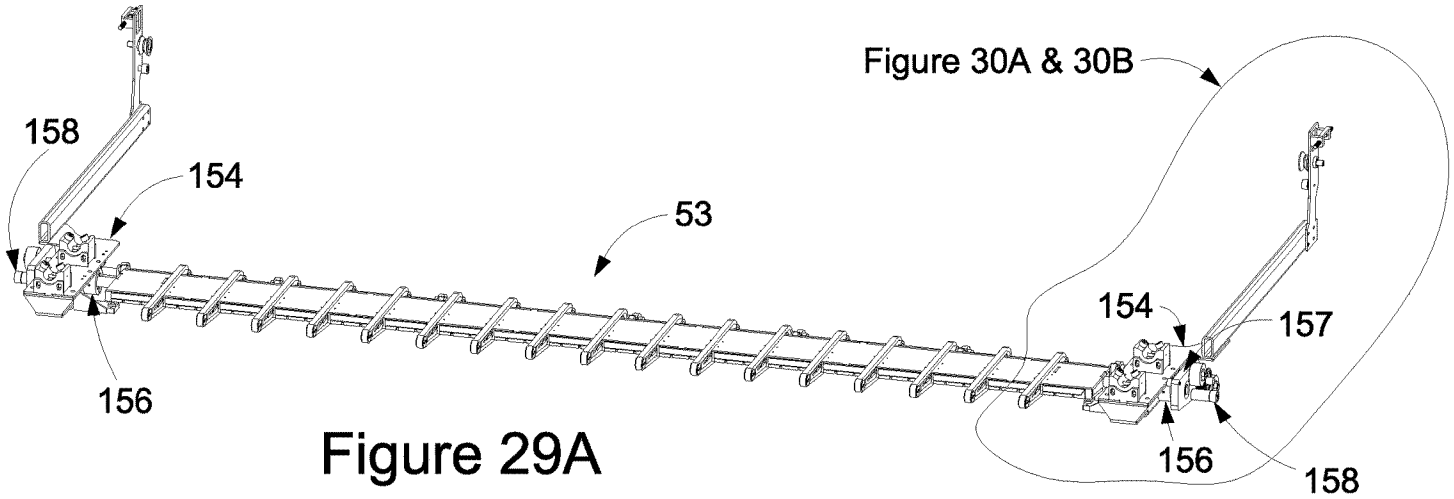
FIGS. 29A and 29B are simplified perspective views of the means for allowing the Accumulator Fingers to pivot relative to the Accumulator Finger Cart at pivot connection.
Figure 29B:
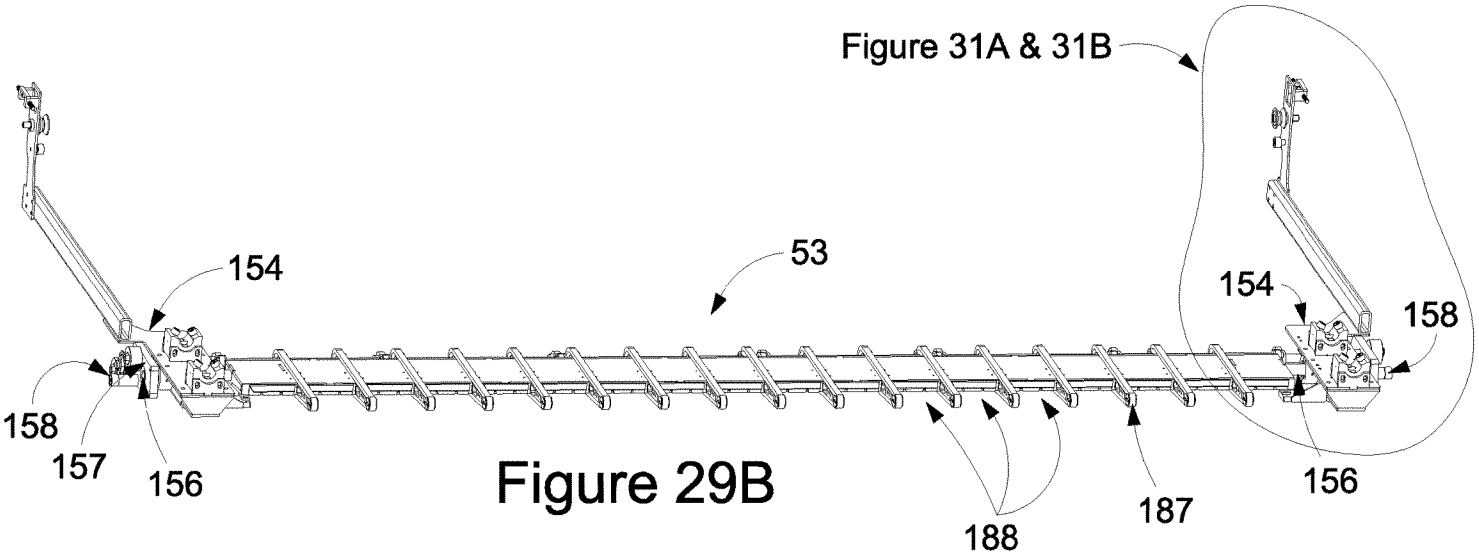
Figure 30B:
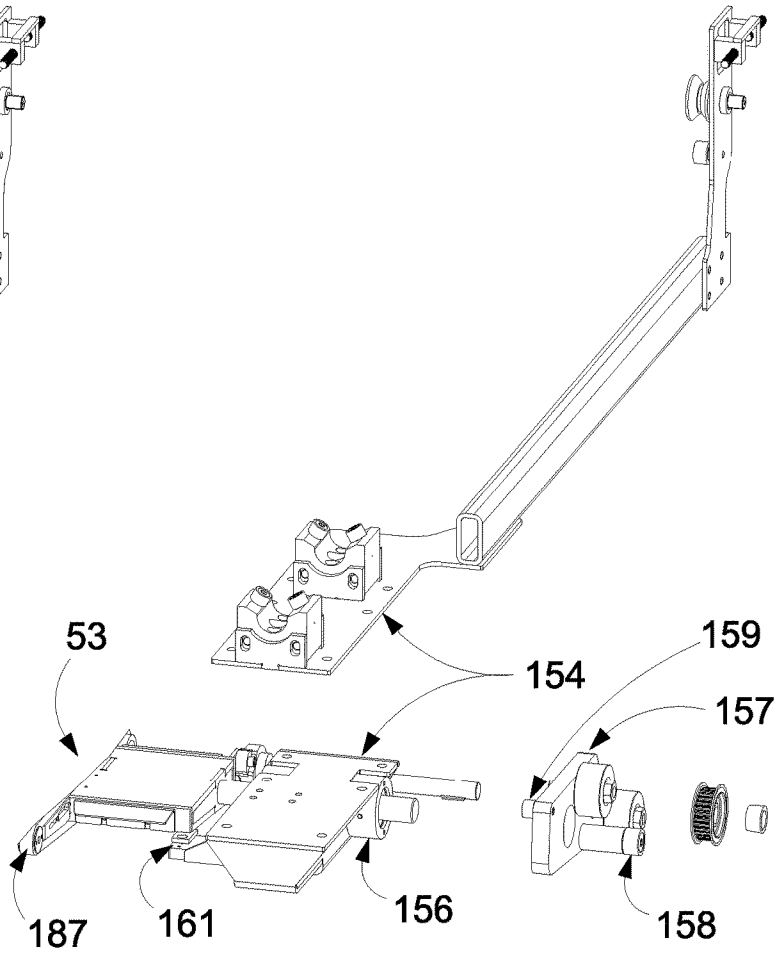
FIGS. 30A and 30B are detail non-exploded and exploded views of the right side of apparatus of FIG. 29A.
Figure 30A:
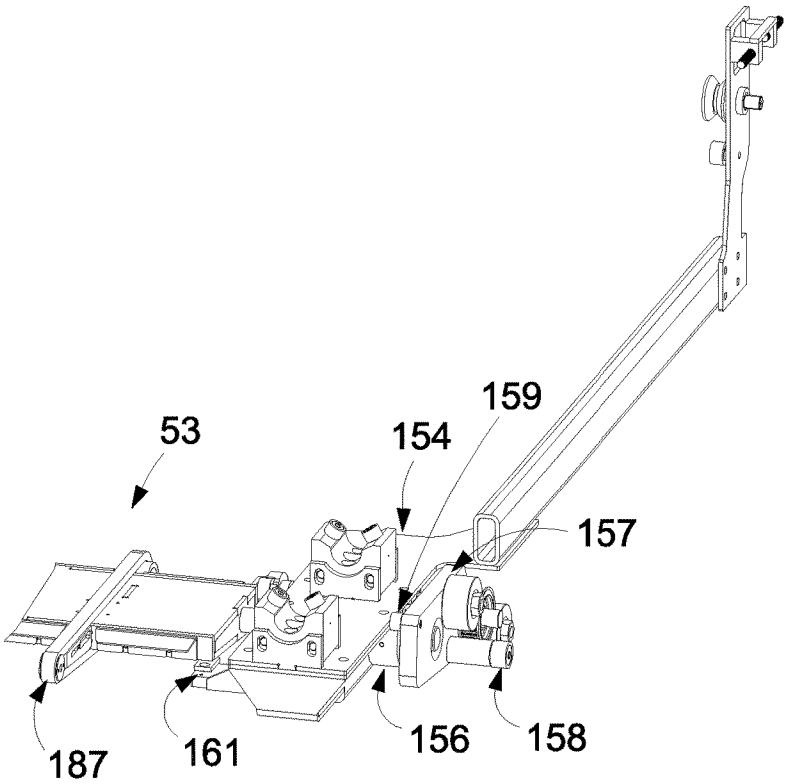
Figure 31B:
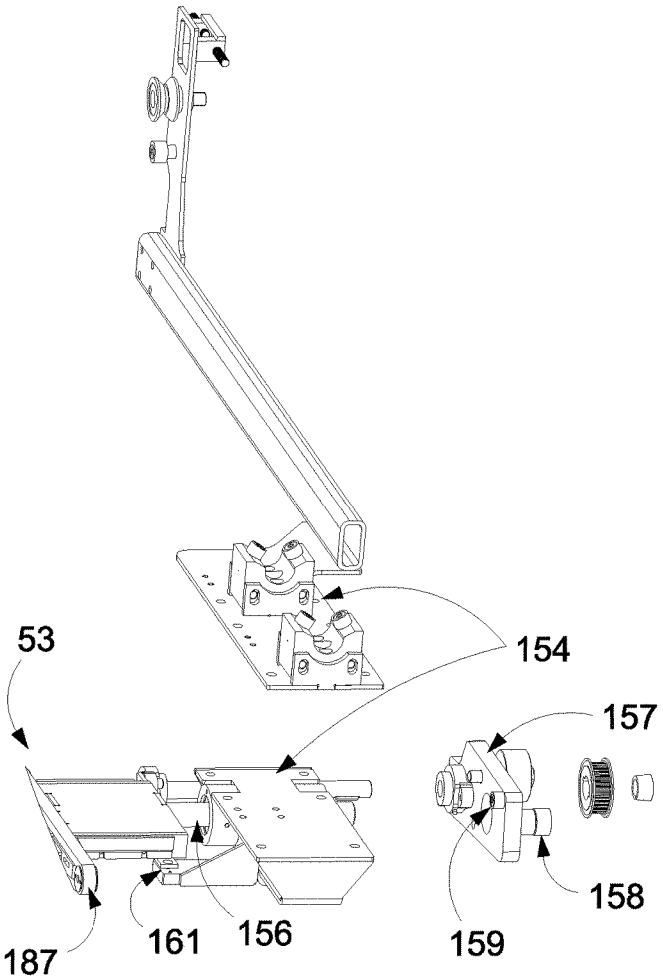
FIGS. 31A and 31B are detail non-exploded and exploded views of the right side of apparatus of FIG. 29B.
Figure 31A:
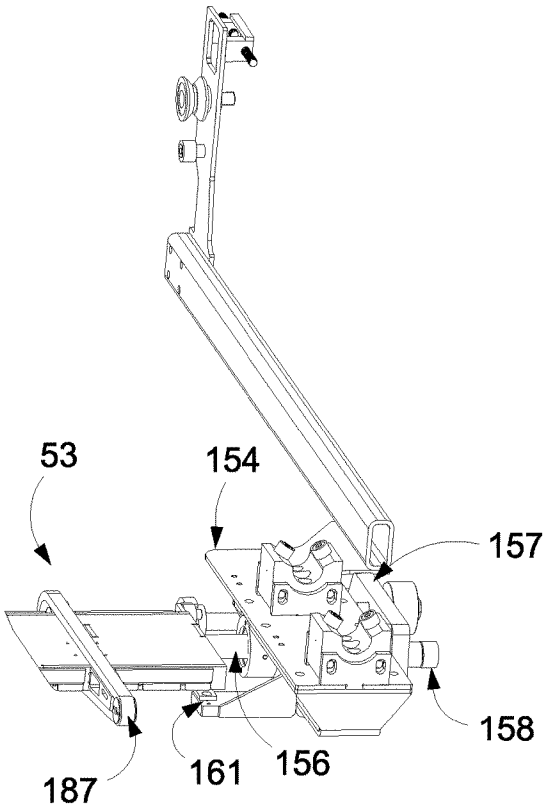
Figure 32B:
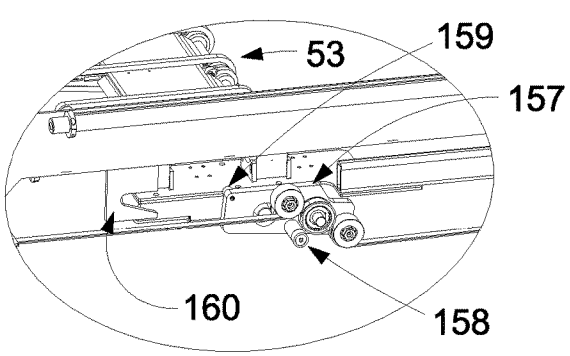
FIGS. 32A, 32B and 32C are detailed views of FIGS. 29A and 29B.
Figure 32A:
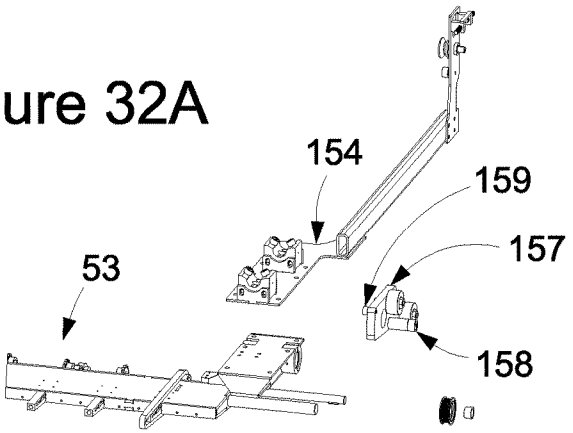
Figure 32C:
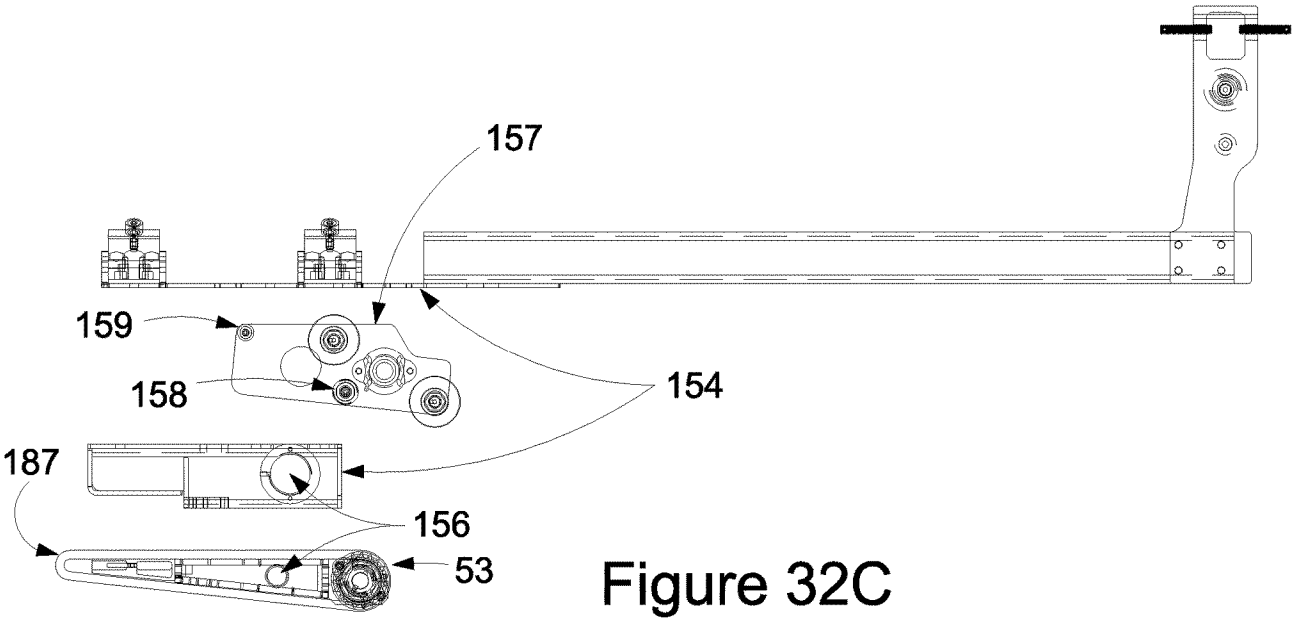
Figure 33B:
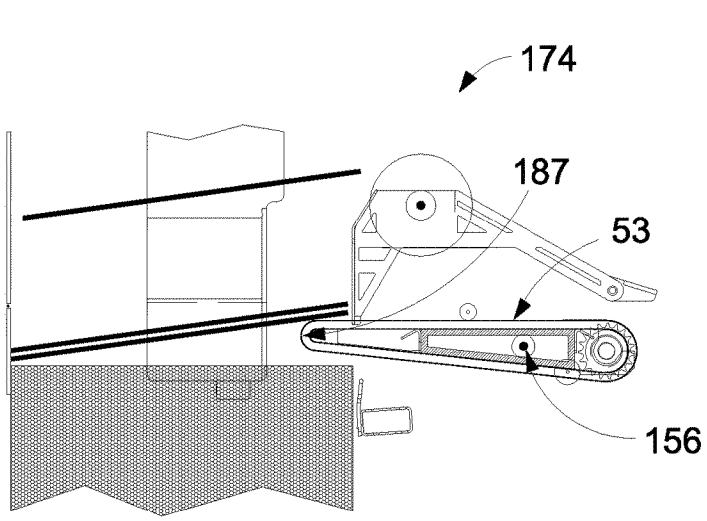
FIGS. 33A, 33B and 33C are side views of kinematic overlay state motion for the Accumulator Fingers during pivoting motion.
Figure 33A:
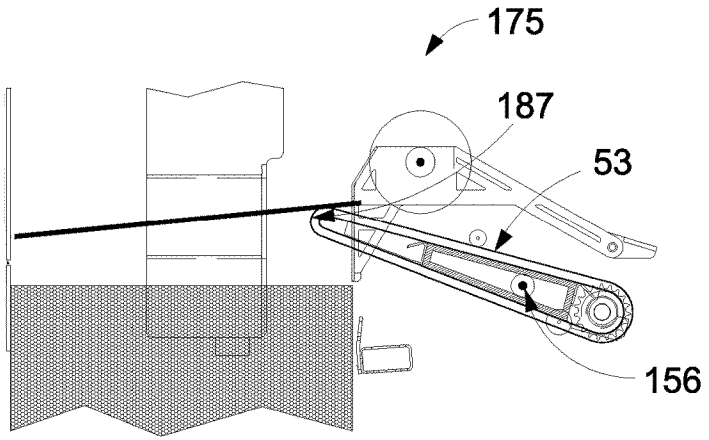
Figure 33C:
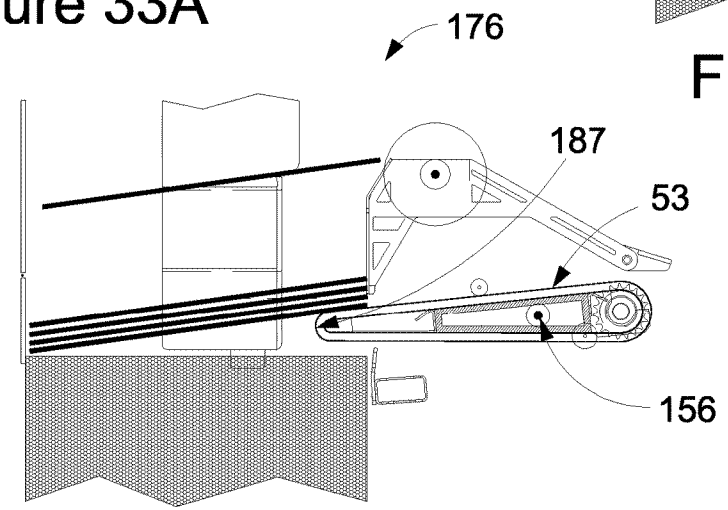
Figures 34A, 34B:
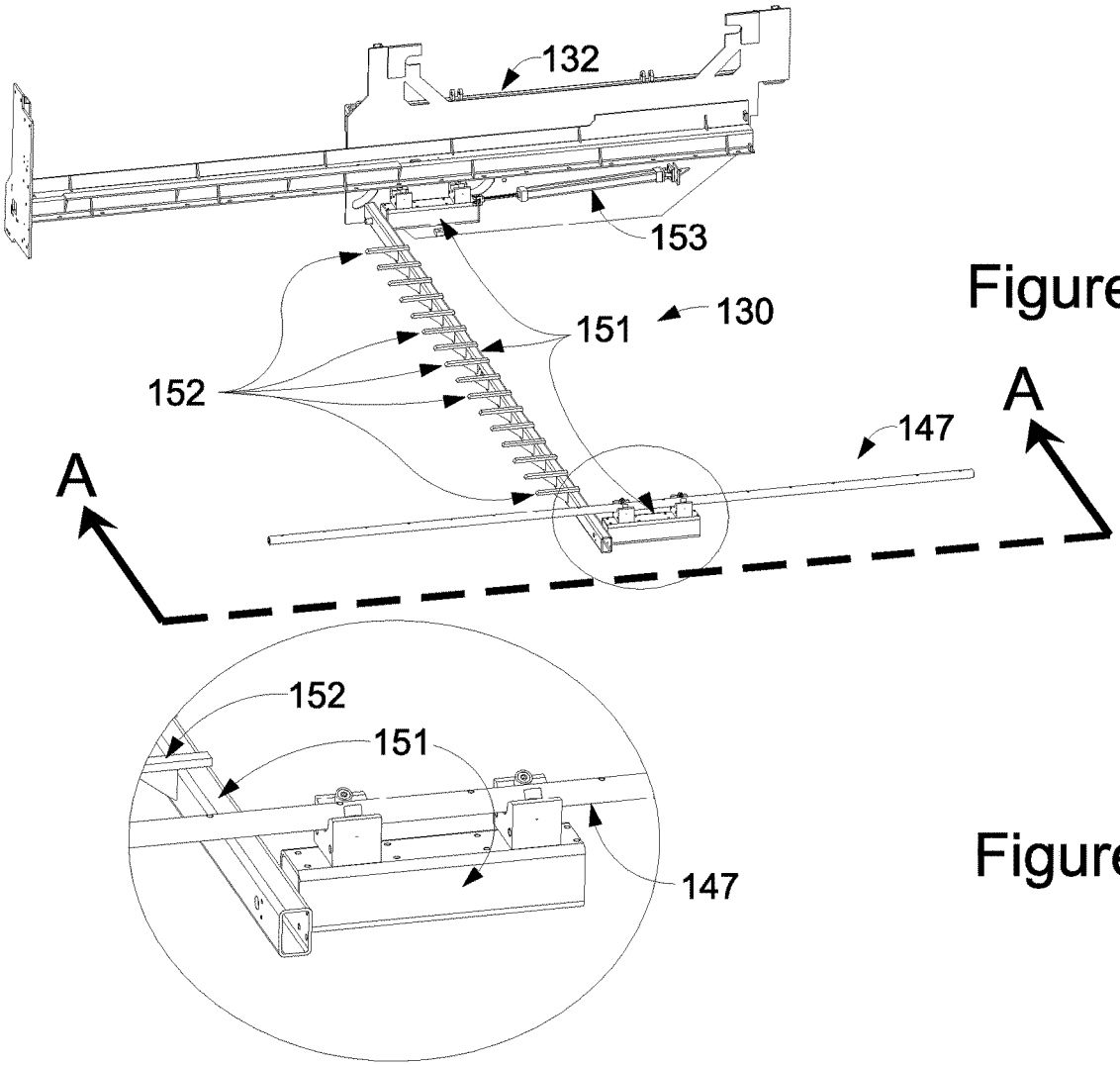
FIGS. 34A and 34B provide a simplified perspective view and a detail view of the Trail Edge Comb.
Figure 35A:
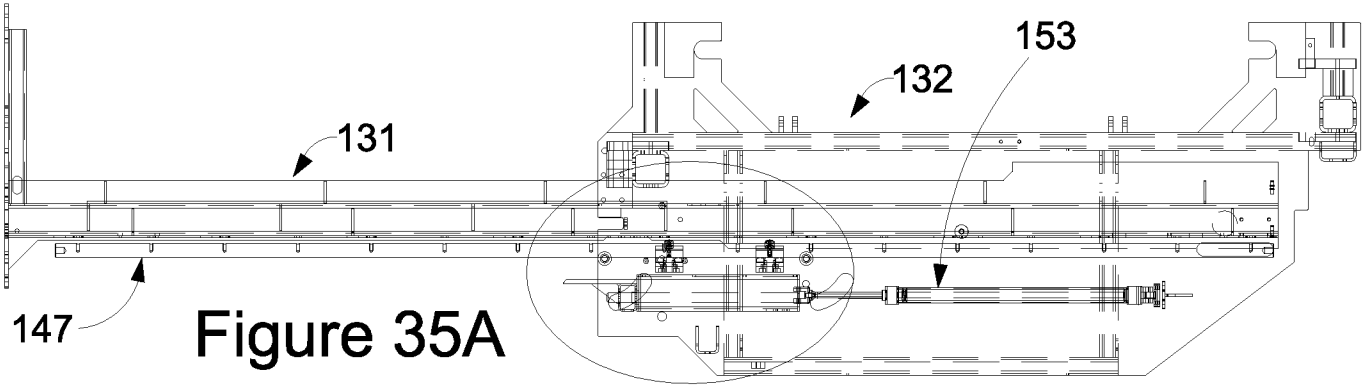
FIGS. 35A and 35B Figures provide a side view and detail view of FIG. 34A along line A-A.
Figure 35B:
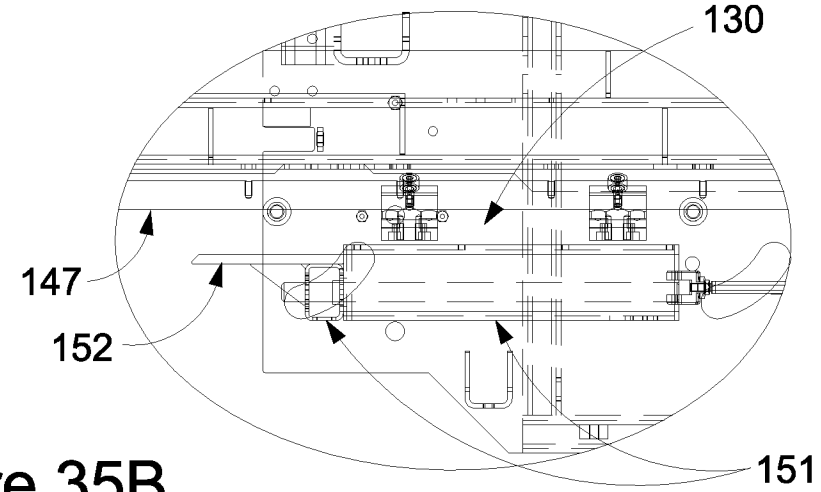

FIGS. 26, 27 and 28 depict three sub-assemblies of the Accumulation Sheet Support System 48. These are the Backstop Assembly 128, the Accumulator Fingers Assembly 129 and the Trail Edge Comb Assembly 130. The Accumulator Fingers Assembly 129 and the Trail Edge Comb Assembly 130 are able to move horizontally by their connection to the Accumulator Side Rails 131 with Accumulator Finger Slide Blocks 149 and Trail Edge Comb Slide Blocks 150.

In FIGS. 26, 27, 28A and 28B the Accumulator Fingers 53 are able to move horizontally (so as to come to be interjected into the stacks accumulating region or conversely so as to come to be retracted out of the stacks accumulating region and instead parked in Linear Space 29) due to the connection to the Accumulator Finger Cart 154 and due to the Accumulator Finger Slide Blocks 149 connection to Accumulator Linear Rail 147. Chain connections Accumulator Finger Chain Attachments 155 allow selectively actuating the horizontal positions of the Accumulator Fingers 53.

In FIGS. 29A, 29B, 30A, 30B, 31A, 31B, 32A, 32B, 32C, 33A, 33B and 33C, means are shown for allowing the Accumulator Fingers 53 to pivot relative to the Accumulator Finger Cart 154 at pivot connection 156. Based on gravity and the torque provided by Tracking Timing Belts 162 (see FIG. 26), the Accumulator Fingers 53 naturally want to tilt down to the Tilt Down Position 176 and are limited by Accumulator Finger Tilt Down Stop 161. Accumulator Finger Cam Blocks 157 are attached to each end to the Accumulator Fingers 53. The Accumulator Finger Cam Blocks 157 have Linkage Control Rollers 158 which when in close proximity of the Finger Tilt Linkages 139 can be pressed down by the Finger Tilt Horizontal Bars 140 (see FIGS. 22A, 22B and 22C) which will tilt the Accumulator Fingers 53 to either the Horizontal Position 174 or the Tilt Up Position 175. The Accumulator Finger Cam Blocks 157 also have Backstop Control Rollers 159 which when the Accumulator Fingers 53 are in close proximity to the Backstop Assembly 128 will engage the Backstop Tilt Control Guide 160. The profile of the contacting surface of the Backstop Tilt Control Guide 160 allows the relative horizontal position of the Accumulator Finger Cam Blocks 157 to variably control the tilt of the Accumulator Fingers 53 from down to horizontal and even some what tilted up based on the selection of the Computer Control System 50.

Tracking Timing Belts 162 (see FIG. 27) attach from the Backstop Assembly 128 and are selectively tensioned by Tracking Timing Belt Cylinders 163. The path of the Tracking Timing Belts 162 snake through the Accumulator Finger Cam Blocks 157 and wrap around Finger Belt Timing Pulley 164 and are controlled by Finger Belt Timing Idlers 165. The Finger Belt Timing Shaft 166 is driven by Finger Belt Timing Pulley 164 which in turn drives Finger Belt Timing Sprockets 167. The Finger Belt Timing Sprockets 167 drive the Finger Belts 168 which respectively circumferentially move about the circumferences of the respective Accumulator Fingers 53. The linkage between the Finger Belt Timing Sprockets 167 and the Finger Belts 168 results in the top surfaces of the Finger Belts 168 having essentially no motion relative to the bottom surface of the lowest supported Box 10 of a nascent stack as the Accumulator Fingers 53 are selectively moved horizontally. This results in avoiding scuffing (e.g., abrading) printed or other fine surfaces of the lowest supported Box 10 as the Accumulator Fingers 53 move horizontally.

In FIGS. 34A, 34B, 35A and 35B the Trail Edge Comb Assembly 130 is shown to have a Trail Edge Comb Weldment 151 which stays horizontal and the Trail Edge Comb Tines 152 can nest into Trail Edge Tampers 62 when the Accumulator Assembly 39 and Deck Lift Assembly 38 are in close proximity. Trail Edge Cylinders 153 are connected to valves and the Computer Control System 50 to selectively apply extending force to the Trail Edge Comb Weldment 151 but the actual positioning of the Trail Edge Comb Weldment 151 is controlled by the position of the Accumulator Fingers Assembly 129 which shares the same Accumulator Linear Rails 147.

Figure 36B:
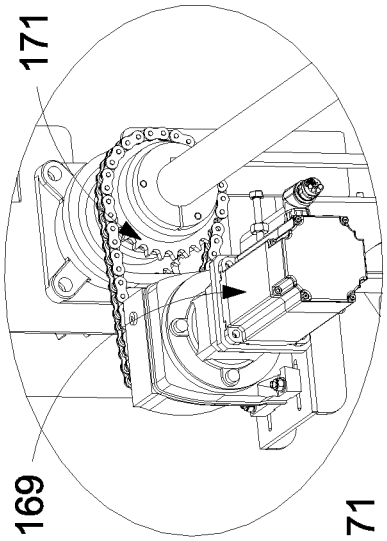
FIGS. 36A and 36B provide a simplified perspective views and detail view of drive system for horizontally positioning the Accumulator Fingers.
Figure 36A:
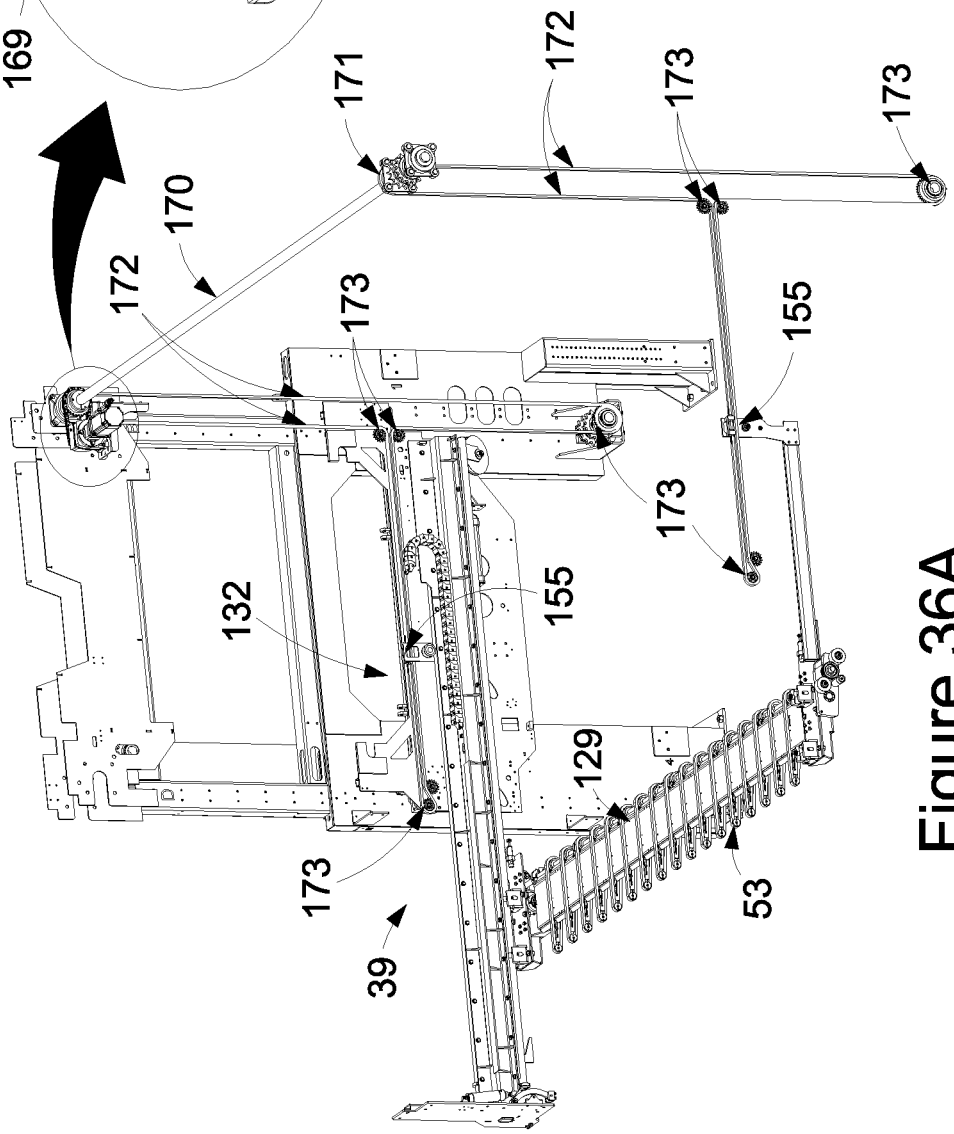

FIGS. 36A and 36B are perspective views of drive system for horizontally positioning the Accumulator Fingers 53. Accumulator Finger Motor 169 operatively drives Accumulator Finger Synchronizing Shaft 170 which in turn drives the Accumulator Finger Drive Sprockets 171 which convert the torque into force in Accumulator Finger Chains 172. The path of Accumulator Finger Chains 172 is controlled by Accumulator Finger Drive Idlers 173. Accumulator Finger Chains 172 attach to Accumulator Finger Chain Attachments 155 which allows the Accumulator Finger Motor 169 to control the horizontal position of the Accumulator Fingers 53. As the Accumulator Finger Assembly 129 is mounted to Accumulator Assembly 39 which also move vertically, the Computer Control System 50 is employed together with use of electronic gear or coordinated motion to control the relative position of the Accumulator Finger Assembly 129 by means of known technology such as for example, servo controlled electrical or pneumatic motors.

Figure 37A:
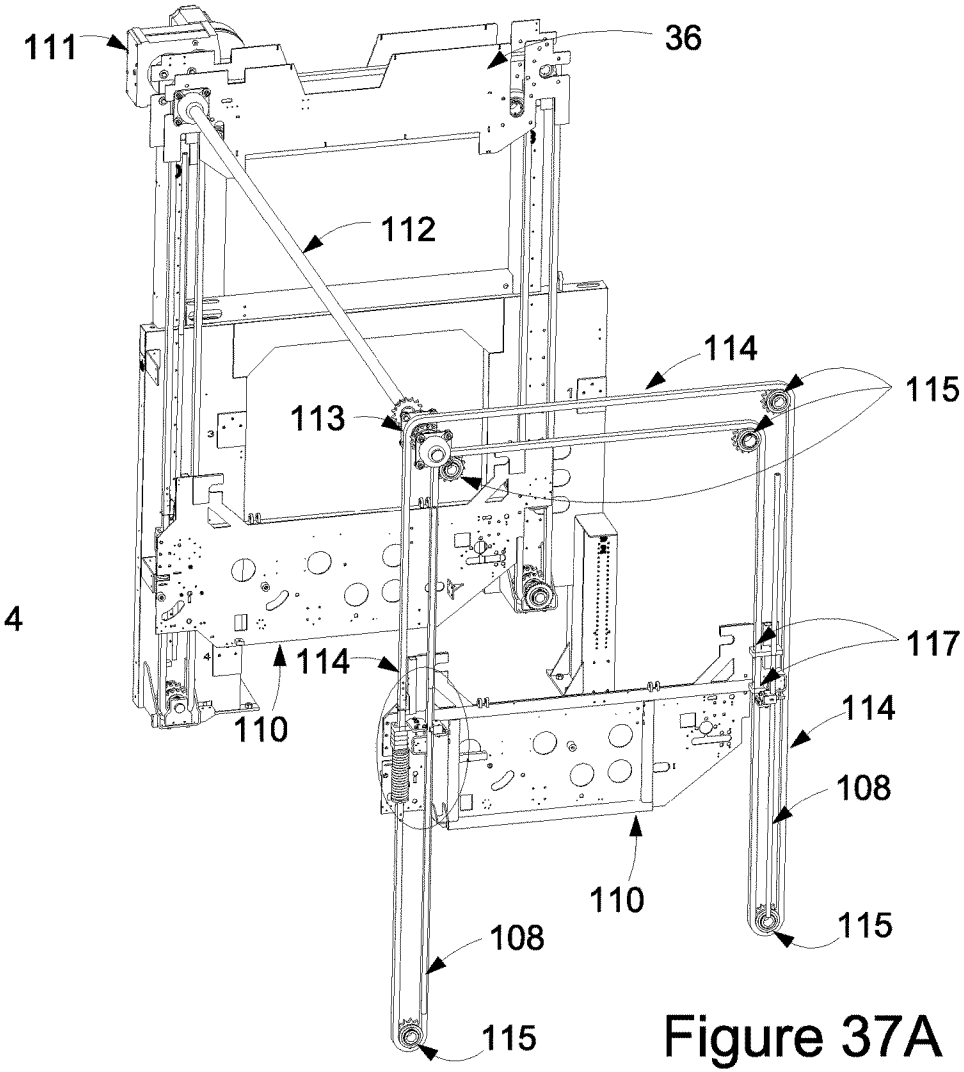
FIGS. 37A and 37B provide a simplified perspective view and detail view of lifting means for the Accumulator Assembly.
Figure 37B:
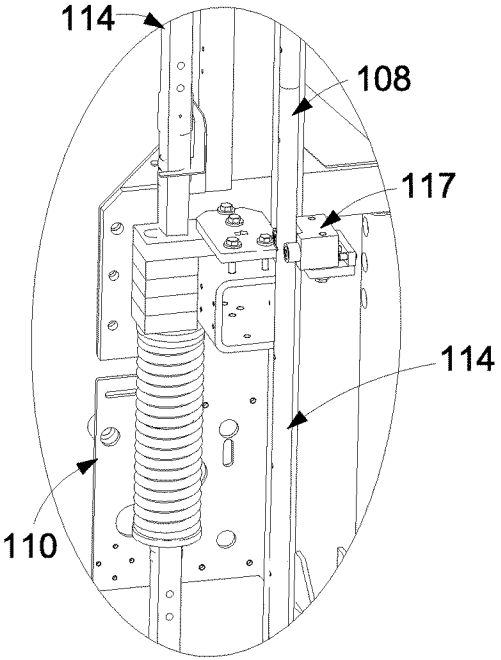

FIG. 37A is a simplified perspective view of lifting means for the Accumulator Assembly 39. FIG. 37B is a detail view of a portion of 37A. Most components have been removed for clarity showing primarily the Accumulator Lift Frames 110, a portion of the Gantry 36 and the elements that actually perform the lifting and provide constraints. Besides the single motor, all other elements are symmetrical across the machine. Accumulator Lift Gear-Motor 111 drives Accumulator Lift Synchronizing Shaft 112. Accumulator Lift Drive Sprockets 113 converts the torque into force in Accumulator Lift Chains 114. The Accumulator Lift Chain 114 follows the path defined by Accumulator Lift Idler Sprockets 115 which operatively connected to the Gantry 36. The Accumulator Lift Chains 114 attach to the Accumulator Lift Frame 110 at the Accumulator Lift Chain Attachments 117.

The Accumulator Assembly 39 is itself constrained to move only vertically. Vertical Rails 108 operatively connect to the Gantry 36. Accumulator Lift Slide Blocks 117 are mounted to Accumulator Lift Frames 110 and attach to the Vertical Rails 108.

Figure 38B:
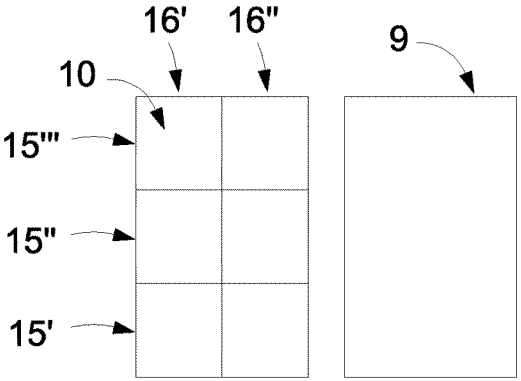
FIG. 38B depicts the relationship between the Corrugated Sheet Stock fed into the Die Cutter and the final Boxes produced.
Figures 39A, 39B:
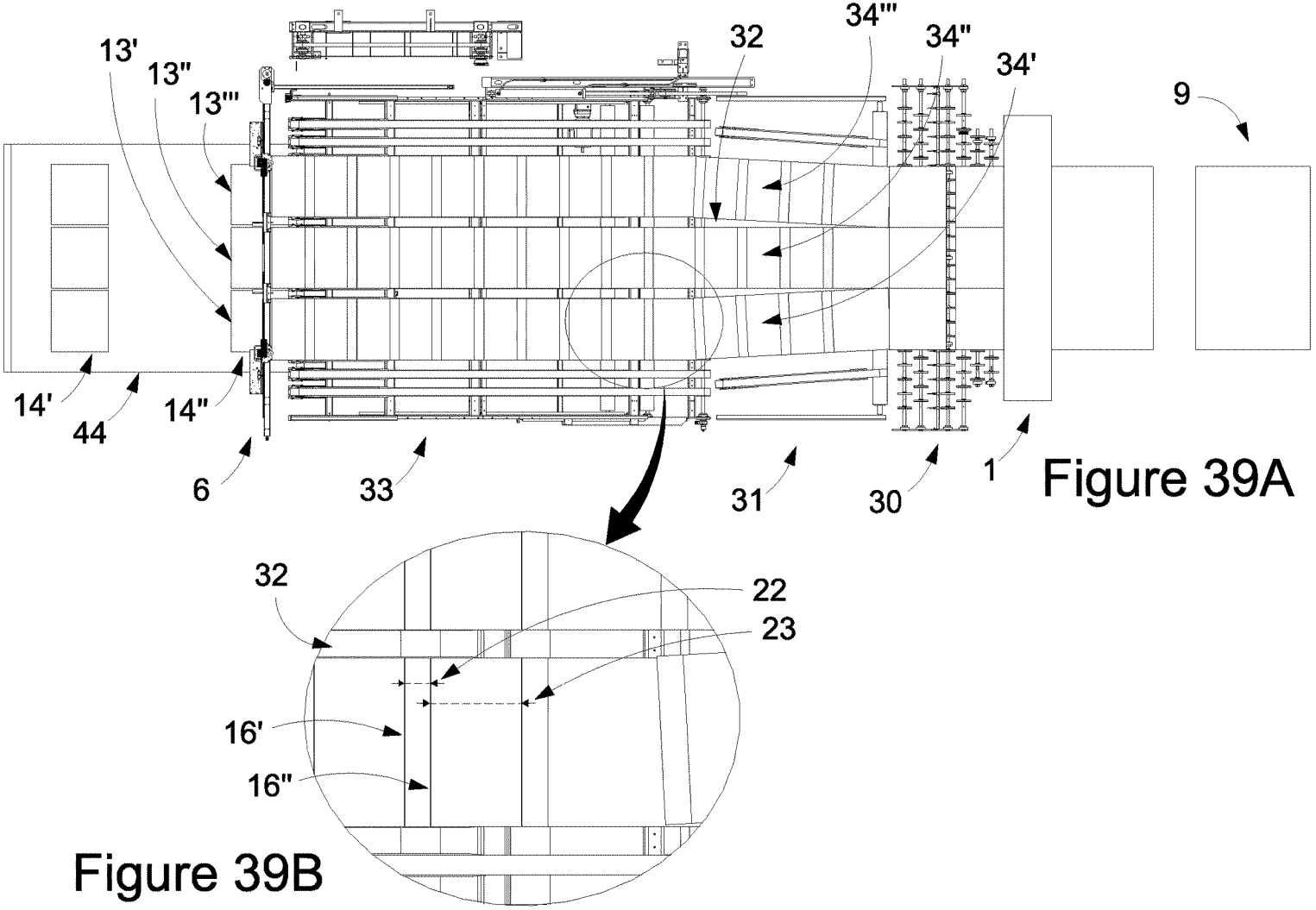
FIGS. 39A and 39B provide a top planar view and a detailed view of FIG. 38A.

FIGS. 38A, 39A and 39B show a simplified perspective view of an Up Stacker 8 with just the mechanical elements that convey its Boxes 10 shown in order to illustrate and define some of key ideas. FIG. 38B depicts the relationship between the Corrugated Sheet Stock fed into the Die Cutter and the final Boxes produced. Assume the customer order is for a medium size box, detailed in FIG. 16B, where the Corrugated Sheet Stock 9 is being die cut by the Rotary Die Cutter 1 into two Ups 16' and 16" and three Outs 15', 15" and 15'''. The Outs 15 are being completely cut by the Rotary Die Cutter 1. The Boxes 10 then are being conveyed through the Layboy Function by a Wheel Style Layboy 30. The Shingling Function and Box Separation 32 are performed by the Diverting Transfer Deck 31. As this is a two Up 16', 16" order, there is a Sheet Shingle Ratio 23 and an Up Shingle Ratio 22 shown in FIG. 39A. As the three Shingle Streams 34', 34" and 34''' exit the Diverting Transfer Deck 31 they progress up the Stacking Deck 33. At the discharge end of the Stacking Deck 33, the three Shingle Streams 34 pass through the Improved Stacker Load Change Cycle Apparatus 6 resulting in the outputting of three Full Stacks 13', 13" and 13" of boxes that are placed relatively close to each other in the cross machine direction in nicely tamped stacks on the floor conveyor 44. These three stacks 13', 13" and 13" constitute a Load 14' is then processed out the exit end of the machine and a nascent new Load 14' created in the vertical stacks accumulating region using Zero Feed Interrupt Time (meaning that the flow of boxes up Stacking Deck 33 is not interrupted even though separate Loads such as 14' and 14" are being produced). All the details of the Improved Stacker Load Change Cycle Apparatus 6 are not shown in FIGS. 38A and 39A for sake of clarity.

Figures 40A, 40B:
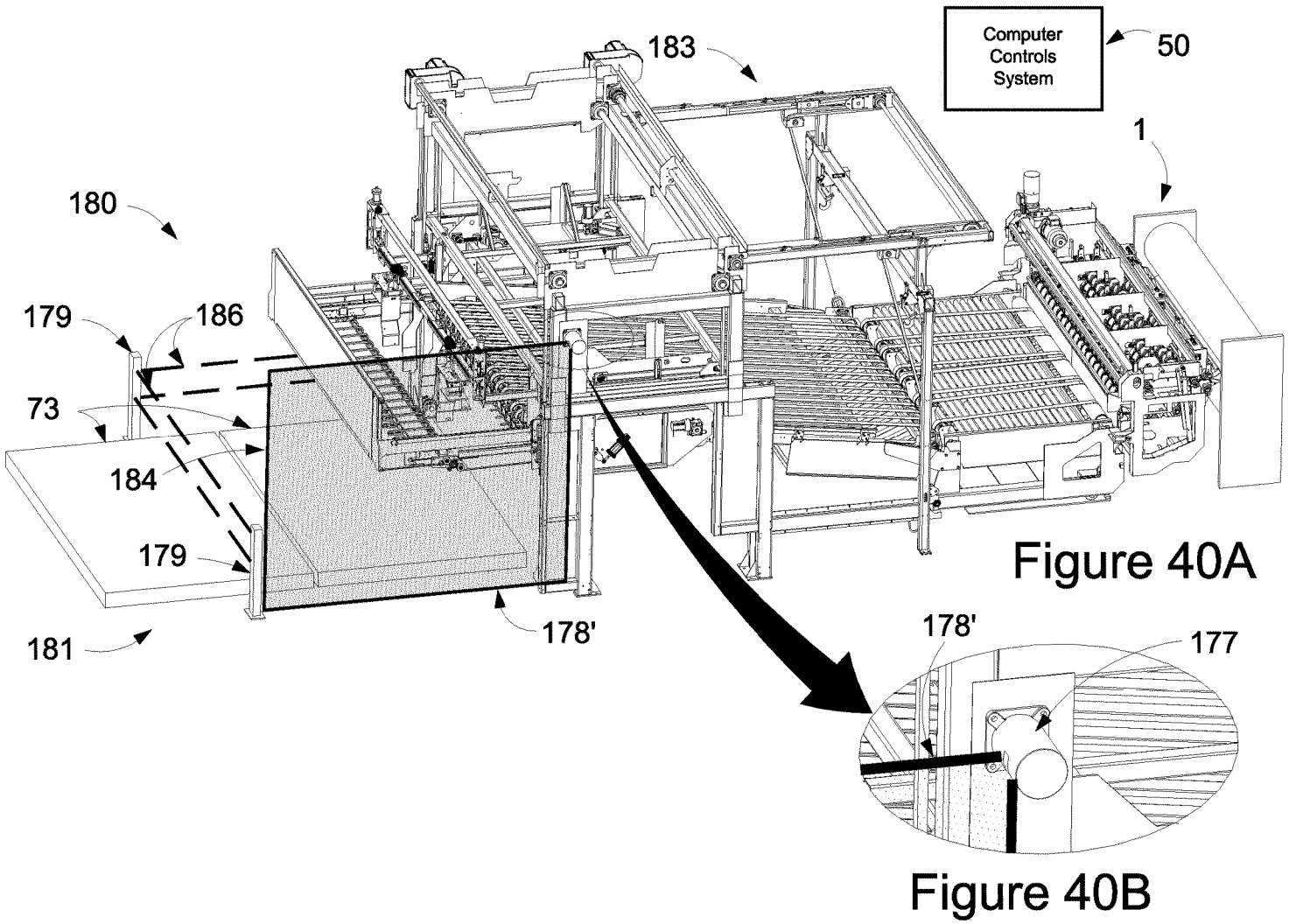
FIGS. 40A and 40B provide a perspective view and a detail view which depicts a Stacking Apparatus configured to operate in what is known as a Full Stack Configuration with a Scanner System.

FIG. 40A depicts a Stacking Apparatus 183 configured to operate in what is known as a Full Stack Configuration 181 where respective Loads are built at the end of the illustrated Stacking Apparatus 183 (in a vertical stacks accumulating region) and then discharged straight out the end of the machine on one or more provided Floor Conveyors 184. During the Load Change Cycle there can be many hazards near the machinery and detecting presence of an operator and stopping the hazardous situation is desired. The challenge is that the Loads should expeditiously exit the system and ideally not cause a substantial loss in production rate. An optical area Scanner 177 (FIG. 40B) , which is a safety rated device that uses light to programmably scan a pre-defined plane (e.g., the lightly shaded rectangle) is mounted to the stacker such that the Scanner Plane 178' creates a mostly vertical surface which the operator is to stay on the outside of for safety sake. This can be used in conjunction with the additional provision of Light Towers 179 which can use one or more area surrounding Safety Beams 186 where these might require more distance of the operator away from potential hazards. The Scanner System 180 is tied to the Computer Control System 50 which will bring all detected situations considered as hazardous to a stop.

Figures 41A, 41B:
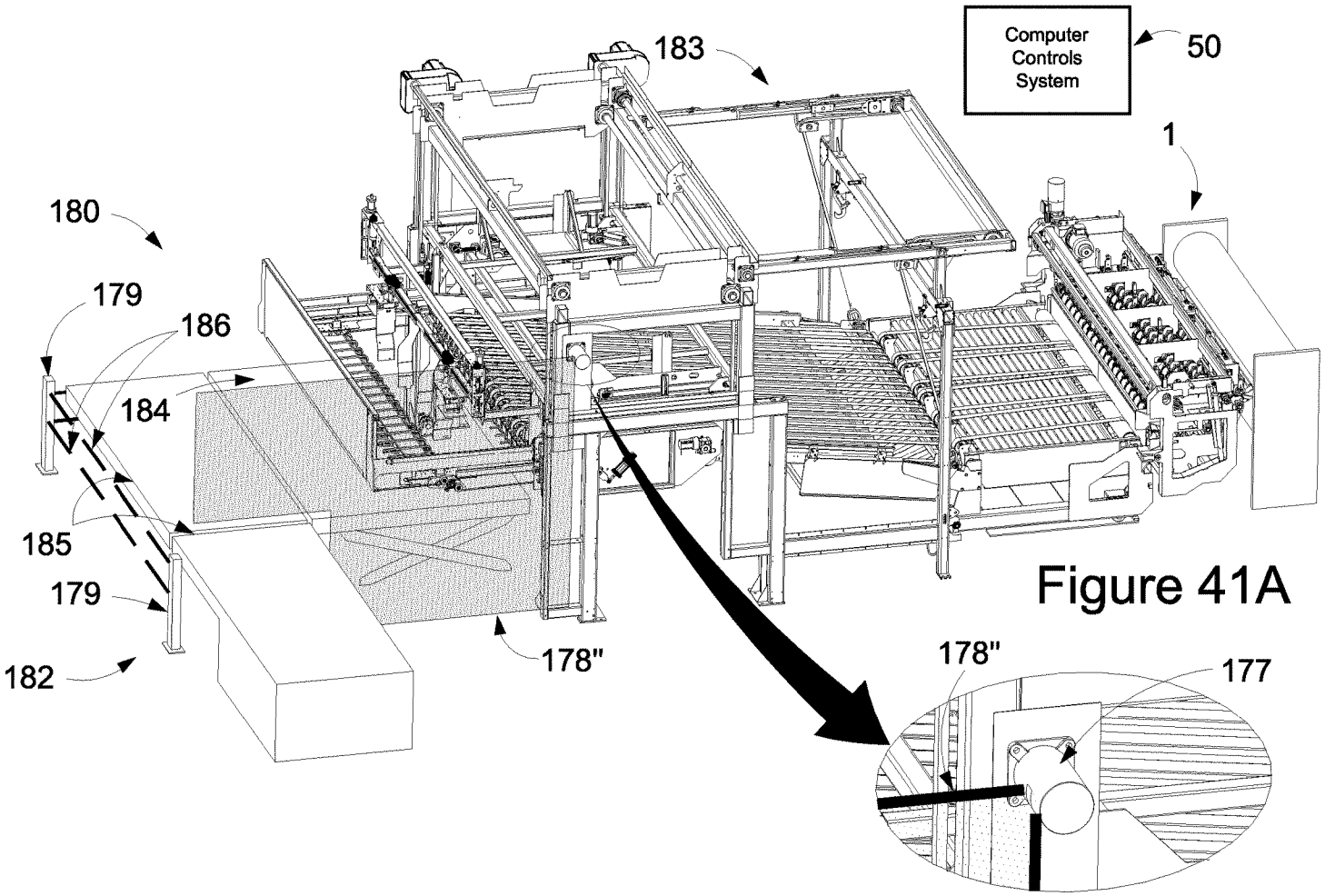
FIGS. 41A and 41B provide a perspective view and a detail view which depicts a Stacking Apparatus configured in what is known as a Full Stack And Bundling Configuration with a Scanner System.

FIG. 41A depicts a Stacking Apparatus 183 configured in what is known as a Full Stack And Bundling Configuration 182 where the Loads are built at the end of the stack (in the stacks accumulating region) and then moved out of the stacks accumulating region either linearly straight out the end of the Stacking Apparatus 183 on Floor Conveyors such as 184 or moved out nonlinearly such as at a Right Angle by a Bundle Conveyor as bundle logs sent to a Bundle Breaker or other downstream processes. Here the Scanner 177 (FIG. 41B) can be programmed to selectively create a temporary gap in the safety planes so as to allow the Loads to come out of the Scanner Plane 178" at desired times and also to allow the machinery to move in and out of the plane based on order changes.

The Computer Control System 50 can be configured to either stop only downward motion upon Scanner detection or all motion depending on the interpretation of which motion is deemed hazardous.

The following description of kinematic overlay sequences (motion snapshots) are for an exemplary customer order type where the Accumulation Sheet Support System 48 is achieved by using the Backstop Lip 54 and the Accumulator Fingers 53. A nearly similar sequence applies to the order type where Accumulation Sheet Support System 48 is achieved by using the Backstop Lip 54, the Accumulator Fingers 53 and the Trail Edge Comb 55.

Figure 42B:
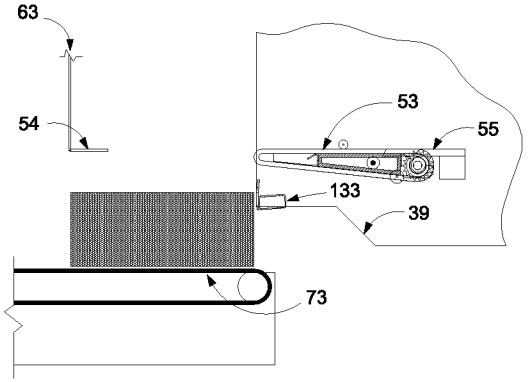
FIGS. 42A, 42B and 42C show kinematic overlay snapshots of alternative possible initial states at the start of a production run.
Figure 42A:
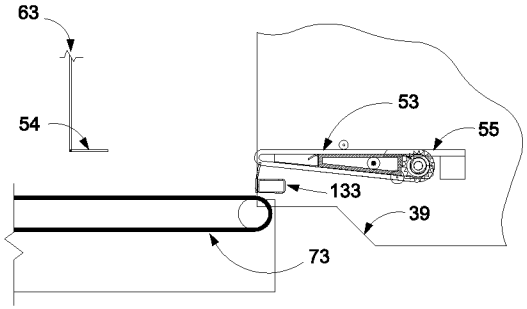
Figure 42C:
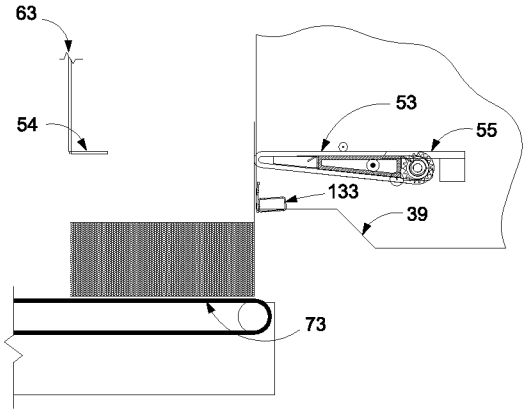

FIGS. 42A, 42B and 42C respectively show kinematic overlay snapshots of alternative possible initial states at the start of a production rune. One (FIG. 42A) where no existing Load is on the floor conveyor and planning on starting in Upstacking Mode. One (FIG. 42B) where there is a pre-existing Load on the floor conveyor and the system is planning on starting a next Load in Upstacking Mode. One (FIG. 42C) where there is an existing Load on the floor conveyor and the system is planning on starting a next Load in a Downstacking Mode initially before switching to Upstacking Mode.

FIGS. 43-62 are kinematic overlay sequences (motion snapshots) for an exemplary customer order type where the Accumulation Sheet Support System is achieved by using the Backstop Lip 54 and the Accumulator Fingers 53. For clarity, new Boxes 10 falling onto the Load 14" are not shown and only the size of the Load 14" is shown to increase in height.

Figure 43:
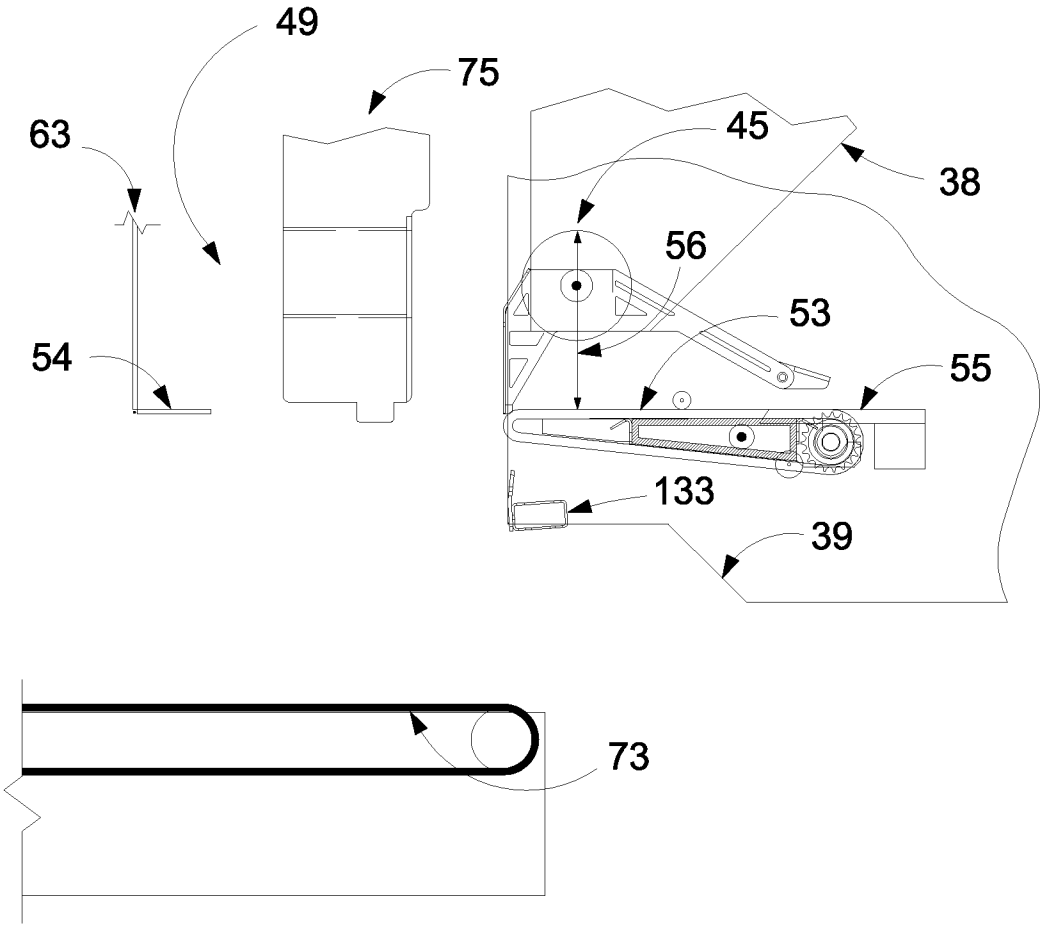
FIGS. 43-62 are kinematic overlay sequences (motion snapshots) for an exemplary customer order type where the Accumulation Sheet Support System is achieved by using the Backstop Lip and the Accumulator Fingers.

FIG. 43 shows the kinematic overlay state in an example initial state before the start of production (note that the conveyor belt on the bottom left has no boxes on it) where the Backstop Lip 54 is in a horizontal interjected state (interjected into the stacks accumulating region but not supporting any boxes), the Accumulator Fingers 53 is fully retracted (upstream-wise to be parked outside the stacks accumulating region) and level, while both the Deck Lift Assembly 38 and the Accumulator Assembly 39 are at their closest elevational spacing thus defining a minimum Hopper Size 56. As the Backstop Lip 54 is elevated a substantial above the Load Conveyor 73, the Dynamic Hopper 49 will first be used in a Downstacking Mode (e.g., in FIG. 43) before switching to an Upstacking Mode.

Figure 44:
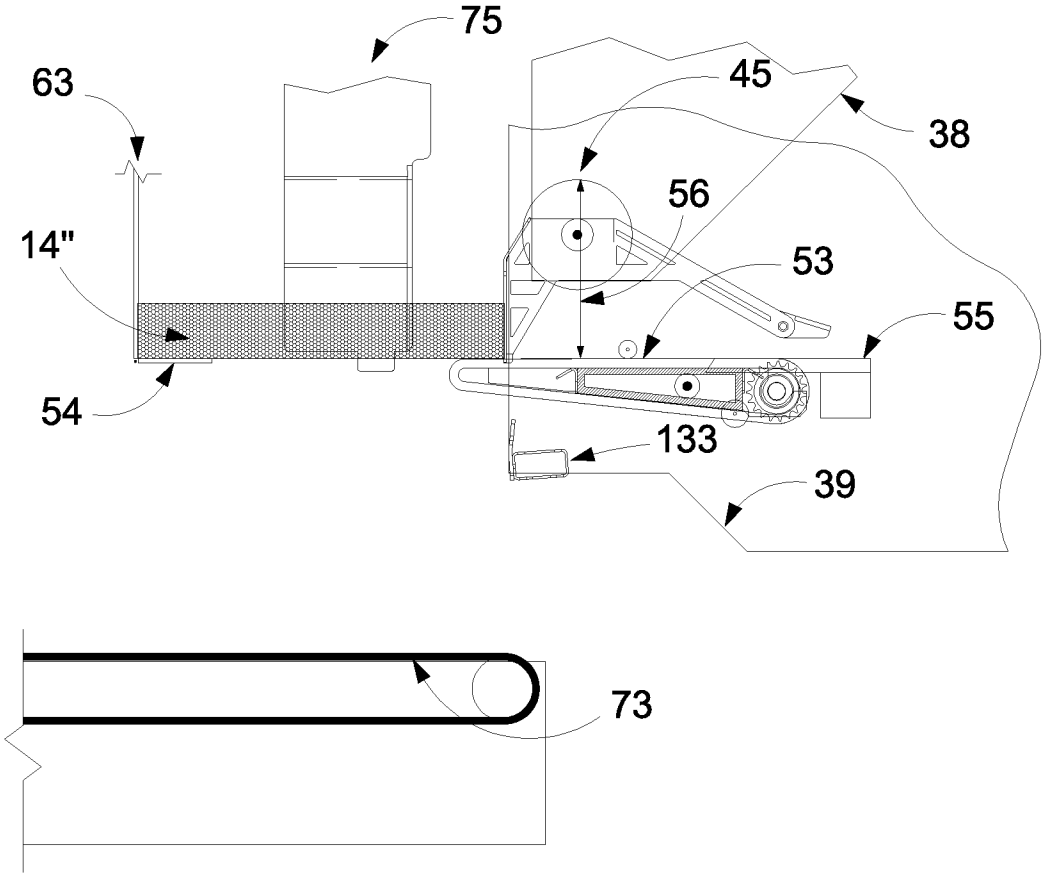

FIG. 44 shows the kinematic overlay state soon after the beginning of a nascent new Load 14' whose bottommost sheet is supported by the Backstop Lip 54 being in the horizontal interjected state, the Accumulator Fingers 53 being partially extended into the stacks accumulating region and held level, the elevation of the Cross Machine Stack Alignment System 57 being in its Middle Position 75 and the vertical distance from the Stacking Deck Discharge Surface 45 to bottom supports 54 and 53 being relatively small so as to define a minimum Hopper Size 56.

Figure 45:
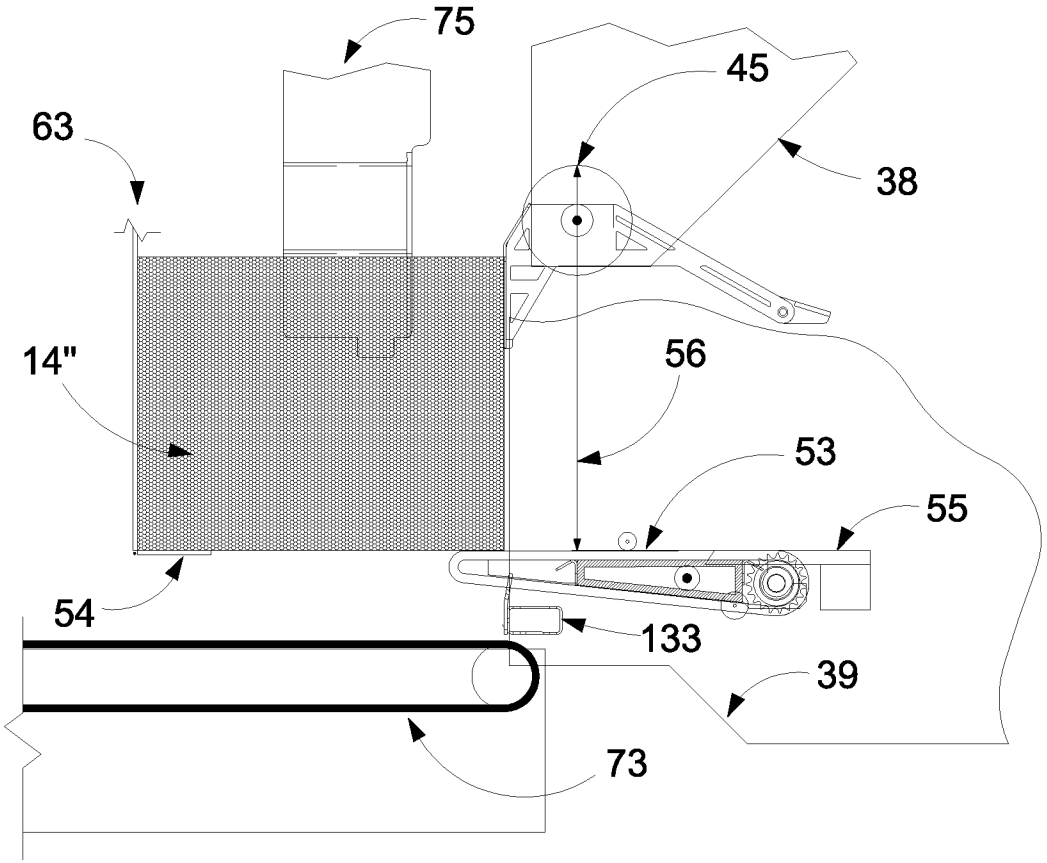

FIG. 45 shows the kinematic overlay state in a Downstacking Mode where the Load is built (boxes are accumulated into it) while the Backstop Lip 54 is moving down and kept in its horizontal Load 14" supporting mode, while the Accumulator Fingers 53 are also moving down and kept partially extended in their level tilt mode, while the Cross Machine Stack Alignment System 57 is in it Middle Position 75 and the Hopper Size 56 being increased because the Accumulator Assembly 39 is lowering. In this embodiment, the Lower Stack Stop Comb 133 has pivoted up and is resting on the Load Conveyor 73 in preparation for receiving and guiding the bottom of the load as it is being dropped.

Figure 46:
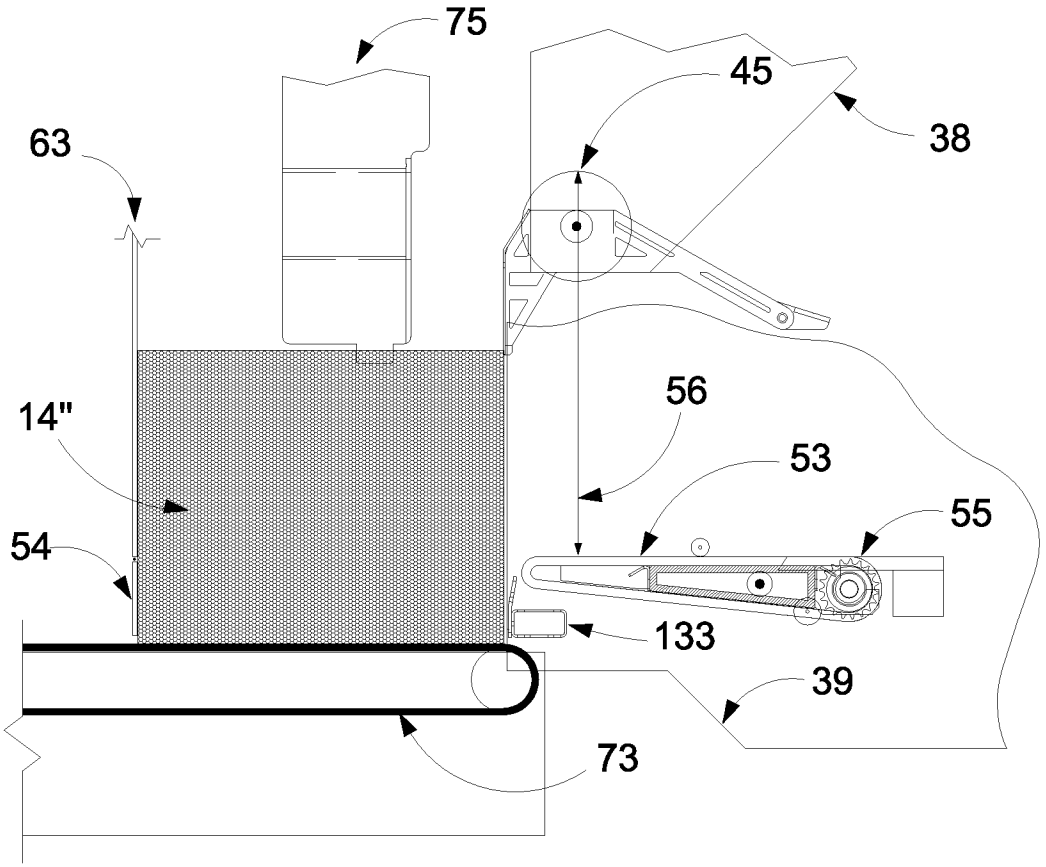

FIG. 46 shows the kinematic overlay state soon after the state of FIG. 45 but for the case where the bottom of the building Load 14" has been dropped onto the Load Conveyor 73. The dropping has been accomplished by switching the Backstop Lip 54 into its retracted vertical state, by fully retracting the Accumulator Fingers 53 out of the vertical stacks accumulating region (while still level). The Cross Machine Stack Alignment System 57 is in it Middle Position 75 and the Hopper Size is the same as before the drop. The Lower Stack Stop Comb 133 is still resting on the Load Conveyor 73 for guiding the bottom of the Load as it is being dropped.

Figure 47:
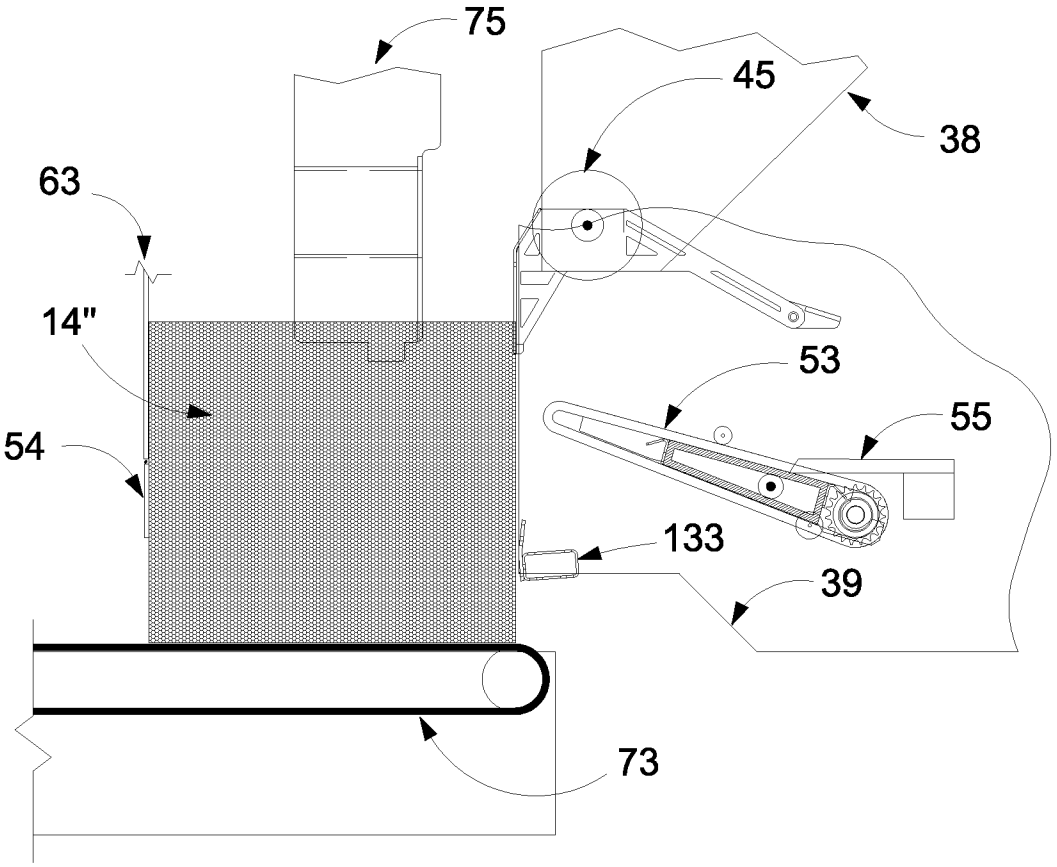

FIG. 47 shows the kinematic overlay state with the system next switched into an Upstacking Mode after the Load 14" has dropped on the Load Conveyor 73. Here, the Backstop Lip 54 remains in its retracted vertical state as it rises up away from the conveyor, the Accumulator Fingers 53 remain fully retracted but are being rotationally reoriented into their tilt up position, the Cross Machine Stack Alignment System 57 is in it Middle Position 75 and the Hopper Size is being reduced by having the elevation of Accumulator Assembly 39 rising faster than the elevation of Deck Lift Assembly 38.

Figure 48:
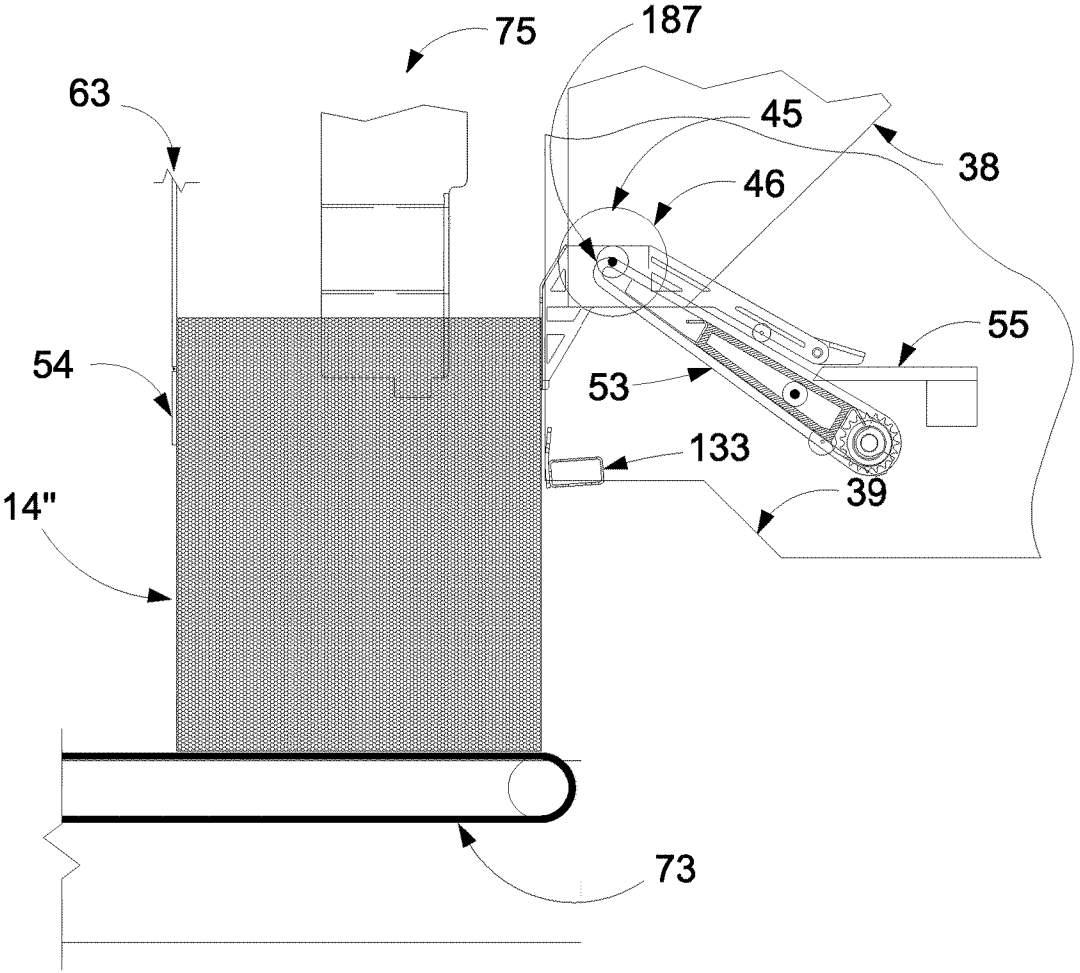

FIG. 48 shows the kinematic overlay state while still in the Upstacking Mode with Backstop Lip 54 still vertical and further raised, the Accumulator Fingers 53 fully retracted, raised together with the Backstop Lip 54 and now in its fully tilt up position, the Cross Machine Stack Alignment System 57 is in it Middle Position 75 and the Hopper Size has decreased back to its minimum. The Accumulator Finger Lead Edges 187 are parked in the gaps between the Stacking Deck Discharge Pulleys 46.

FIG. 49 shows the kinematic overlay state in Upstacking Mode with Backstop Lip 54 is vertical, the Accumulator Fingers 53 fully retracted and now in its fully tilt up position, the Cross Machine Stack Alignment System 57 is in it Middle Position 75 and the Hopper Size back at its minimum and the Computer Control System 50 has decided the currently built Load 14" is complete, meaning an impending Load Change is coming up with the First Sheet 77 (not shown) of the next Load 14''' approaching without interruption of sheet feeding by the Stacking Deck 33.

Figure 50:
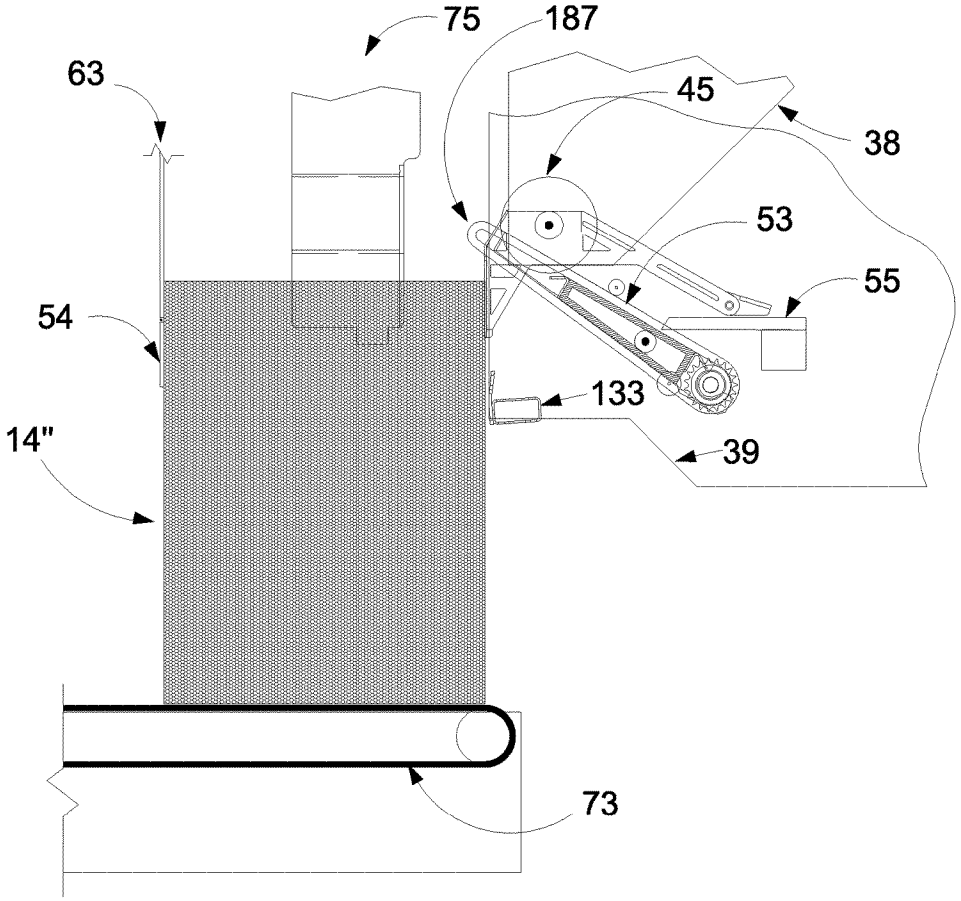

FIG. 50 shows the kinematic overlay state in the Load Change Mode with the Backstop Lip 54 still in vertical, but before the First Sheet 77 (not shown) of the next Load 14''' drops in, the Accumulator Fingers 53 have inserted their Accumulator Finger Lead Edges 187 (finger tips) into the stacks accumulating region so as to be interjected between the completed Load 14" and the First Sheet 77 of the next Load 14". In this state, the Cross Machine Stack Alignment System 57 is in its Middle Position 75 and the Hopper Size is still at its minimum.

Figure 51:
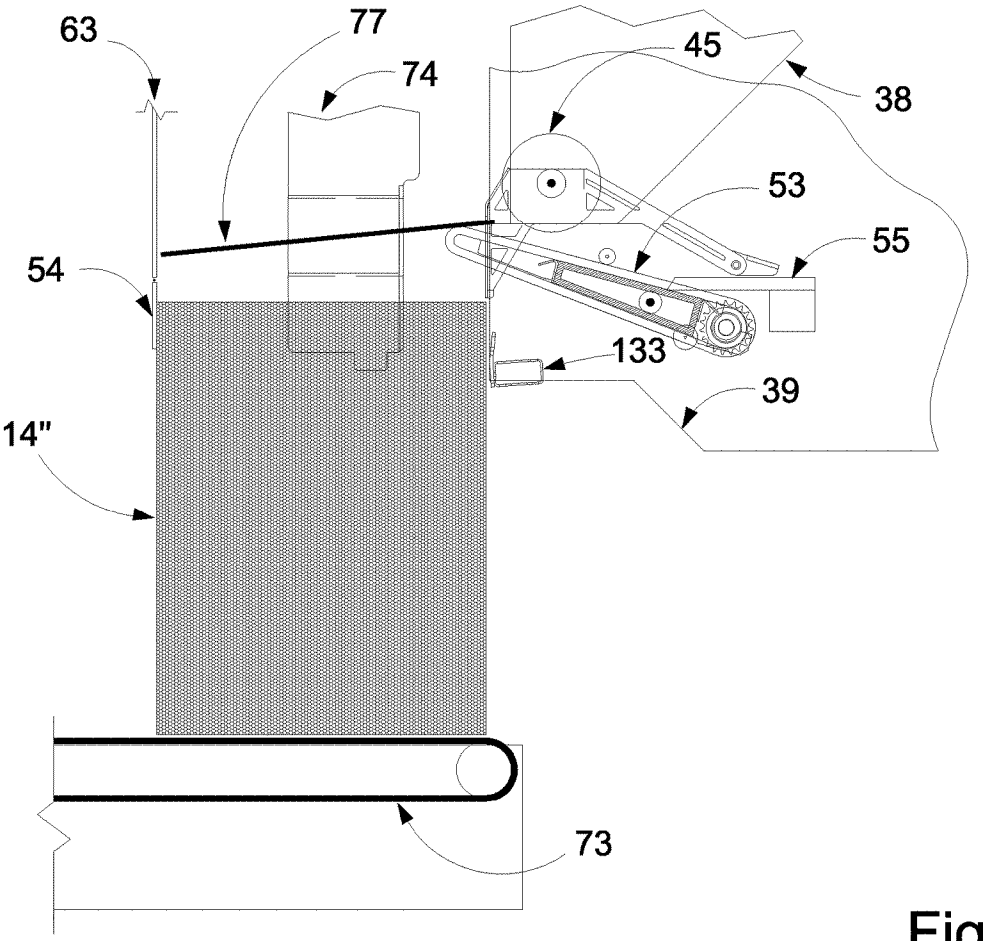

FIG. 51 shows the kinematic overlay state in the Load Change Mode where the First Sheet 77 of the next Load 14''' has begun dropping into the vertical stacks accumulating region. The Backstop Lip 54 is vertical, the Accumulator Finger Lead Edges 187 (finger tips) in between the completed Load 14" and the First Sheet 77 of the next Load 14''' and is now rotating from full tilt up state back around towards its level position as it engages with a trailing portion of the First Sheet 77. The Cross Machine Stack Alignment System 57 is moving at the same time to its Down Position 74 and the Hopper Size is still at its minimum. As this is occurring, coordinate motion control by the Computer Control System 50 is causing a raising of the elevation of both the Accumulator Assembly 39 and the Deck Lift Assembly 38 in order to keep the bottom of the Accumulator Fingers 53 slightly above the completed Load 14". Also, at the same time the Computer Control System 50 is using information from sensor eyes looking across the top of the Load 14" to measure the exact height of the Load 14" in order to make sure the bottom of the Accumulator Fingers 53 is clear of that completed Load 14".

Figure 52:
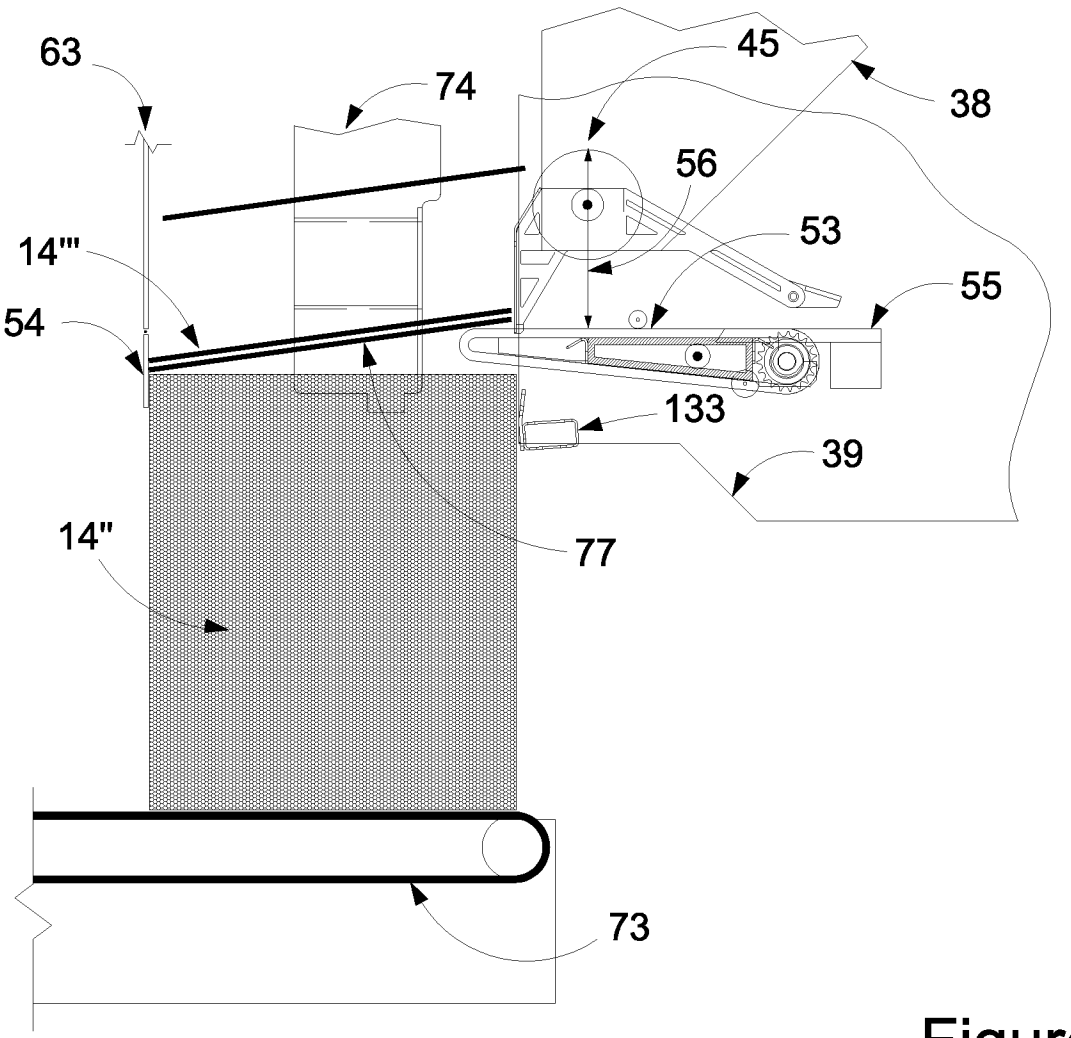

FIG. 52 shows the kinematic overlay state while still in Load Change Mode except that now more sheets of the nascent new Load 14''' besides First Sheet 77 have dropped into the stacks accumulating region. The Backstop Lip 54 is still vertical, the Accumulator Finger Lead Edges 187 (finger tips) inserted in between the completed Load 14" and the First Sheet 77 of the next Load 14''' and is now level. The Cross Machine Stack Alignment System 57 is in it Down Position 74 and the Hopper Size is still at its minimum as the system waits for a minimum amount of the nascent new Load 14''' to build up in the stacks accumulating region in order to keep proper tamping against the sides and trailing face of the nascent new Load 14'''.

Figure 53:
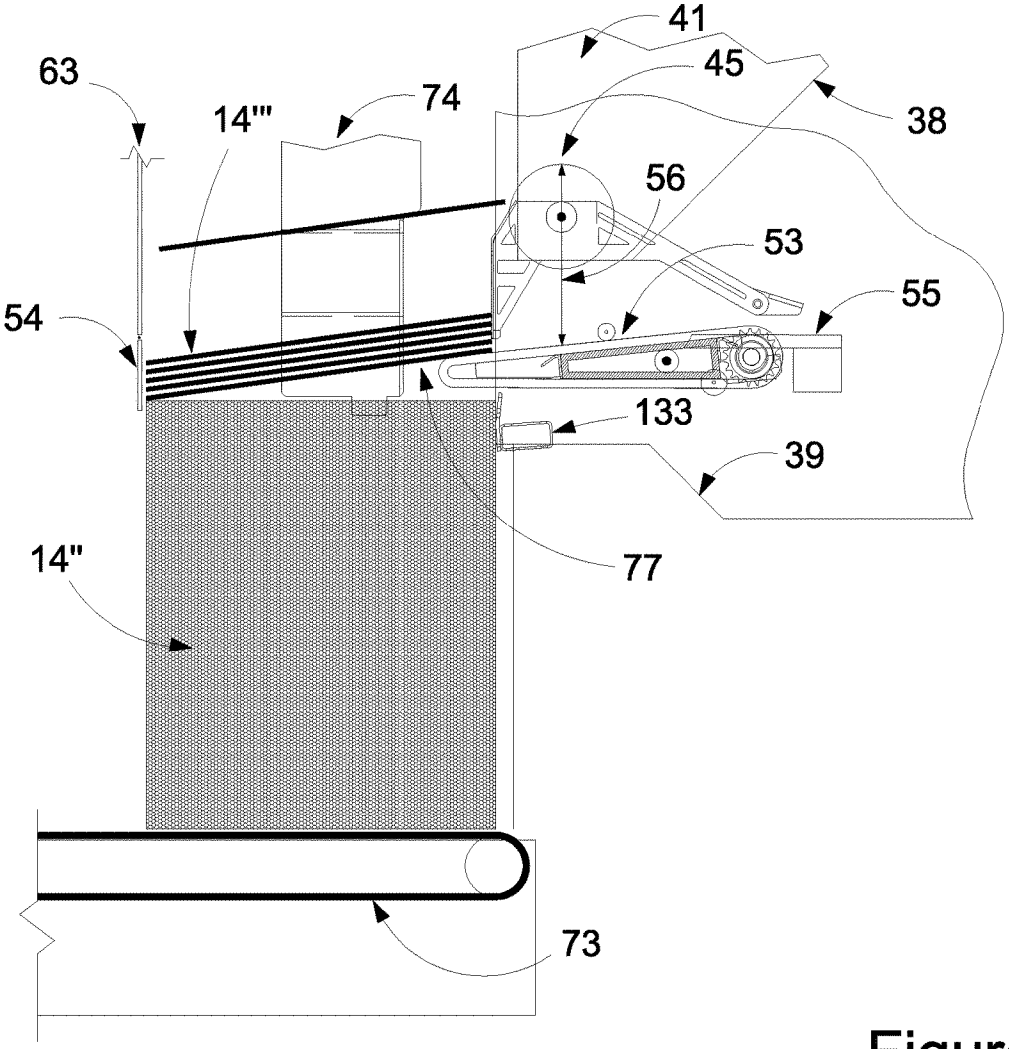

FIG. 53 shows the kinematic overlay state in Load Change Mode with the Backstop Lip 54 vertical, the Accumulator Finger Lead Edges 187 (finger tips) inserted in between the completed Load 14" and the First Sheet 77 of the next Load 14''' but with the Accumulator Fingers 53 now tilted down so as to decrease the inclination angles of the accumulated beginning sheets of the nascent new Load 14'''. The Cross Machine Stack Alignment System 57 is in it Down Position 74 and the Hopper Size 56 is increasing as the Stacking Deck Discharge End 41 rises with the Accumulator Fingers 53 holding their elevational position above the existing Load 14" and the nascent new Load 14''' is continuing to build. Being tilted in the downward tilt position allows a minimum intrusion profile of the Finger Assembly to slice between the existing Load 14" and the nascent new Load 14''' with minimal separation.

Figure 54:
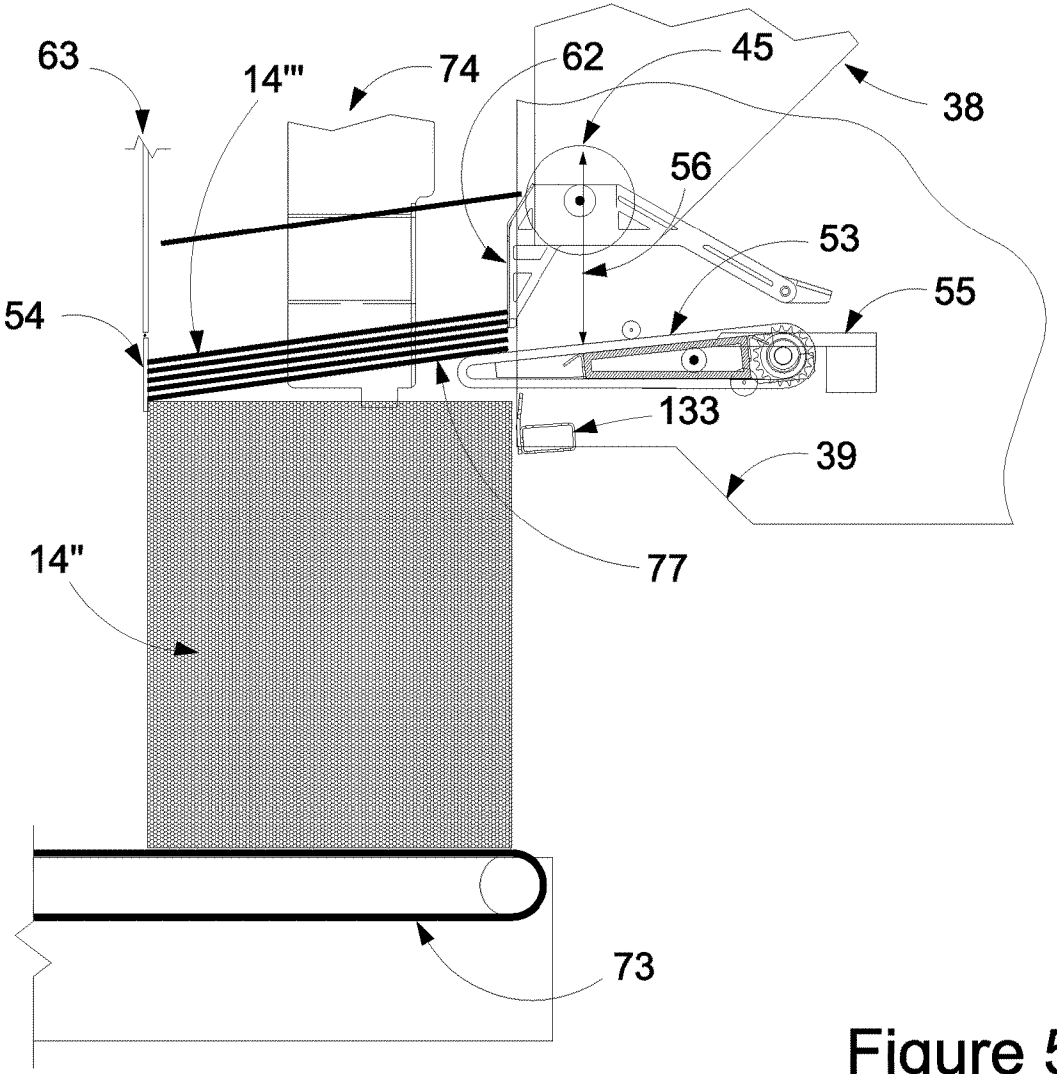

FIG. 54 shows the kinematic overlay state in Load Change Mode with a next incoming sheet of the nascent new Load 14''' guided along an inclined downstream face of the Trail Edge Tamper 62. The Backstop Lip 54 is vertical, the Accumulator Finger Lead Edges 187 (finger tips) in between the completed Load 14" and the First Sheet 77 of the next Load 14''' and is tilted down in the downstream direction because its leading edge rests on the previous Load 14". The Cross Machine Stack Alignment System 57 is in it Down Position 74 and the Hopper Size is increasing as the Accumulator Fingers 53 holding its position above the existing Load 14" and the nascent new Load 14''' is continuing to build. A predetermined minimum amount of the nascent new Load 14''' should be deposited for proper tamping during the upcoming further separation stage.

Figure 55:
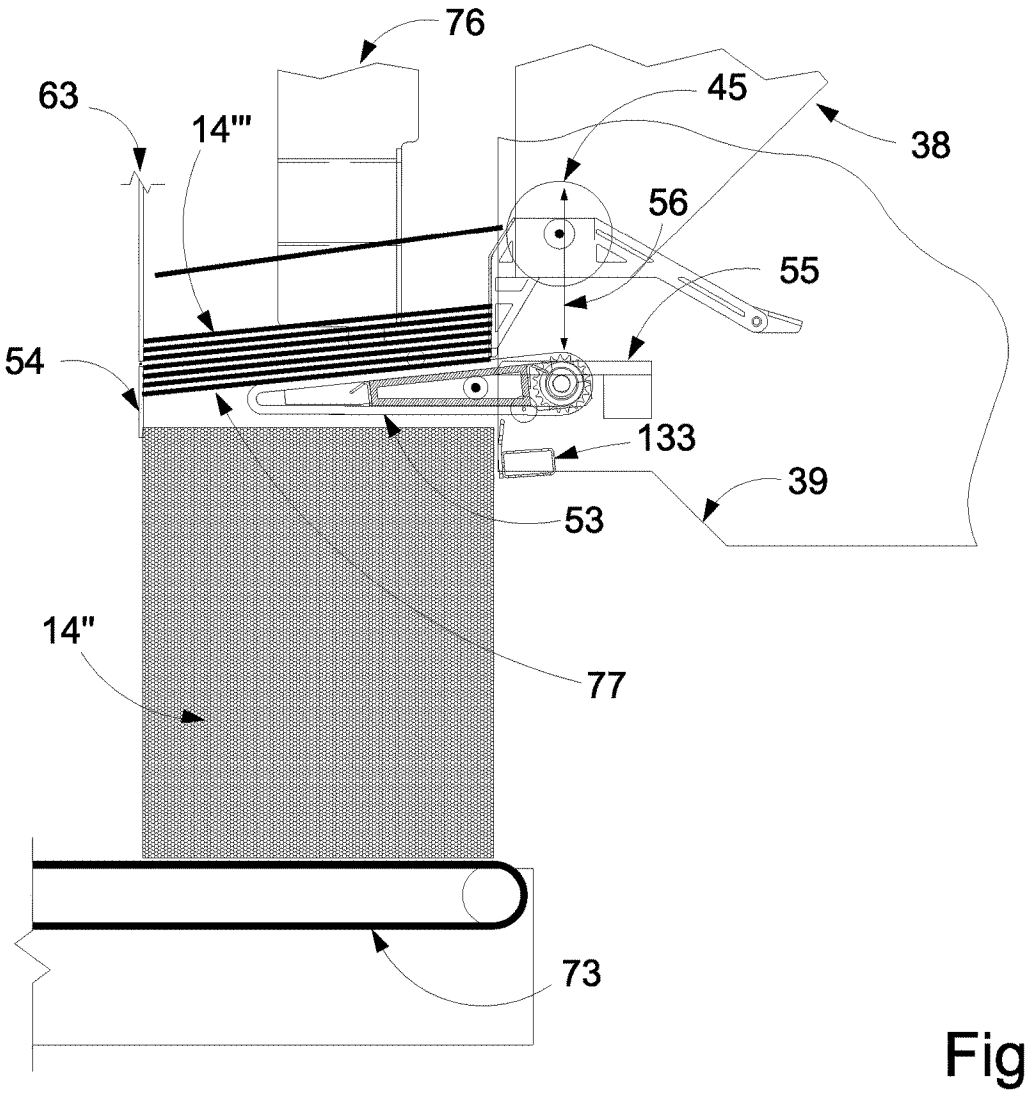

FIG. 55 shows the kinematic overlay state of the system in the Load Change Mode with Backstop Lip 54 near the top of the previously completed Load 14" and still in the vertical orientation. The Accumulator Fingers 53 have advanced horizontally downstream so as to continue their extending between the previously completed Load 14" and the First Sheet 77 of the nascent next Load 14''' with the upper surface of the Accumulator Fingers 53 tilted down. In this state, the Cross Machine Stack Alignment System 57 moves from its Down Position 74 to its Up Position 76 in order to move the side tampers out of the way and allow the Accumulator Fingers 53 to interject deeper into the stacks accumulating region so as to support a more center portion of the First Sheet 77 of the nascent next Load 14'''. Accordingly the lifted side tampers do not interfere with the interjected Accumulator Fingers 53. In this state the Hopper Size 56 is increasing as required for operability based on how fast the nascent new Load 14''' is being built up.

Figure 56:
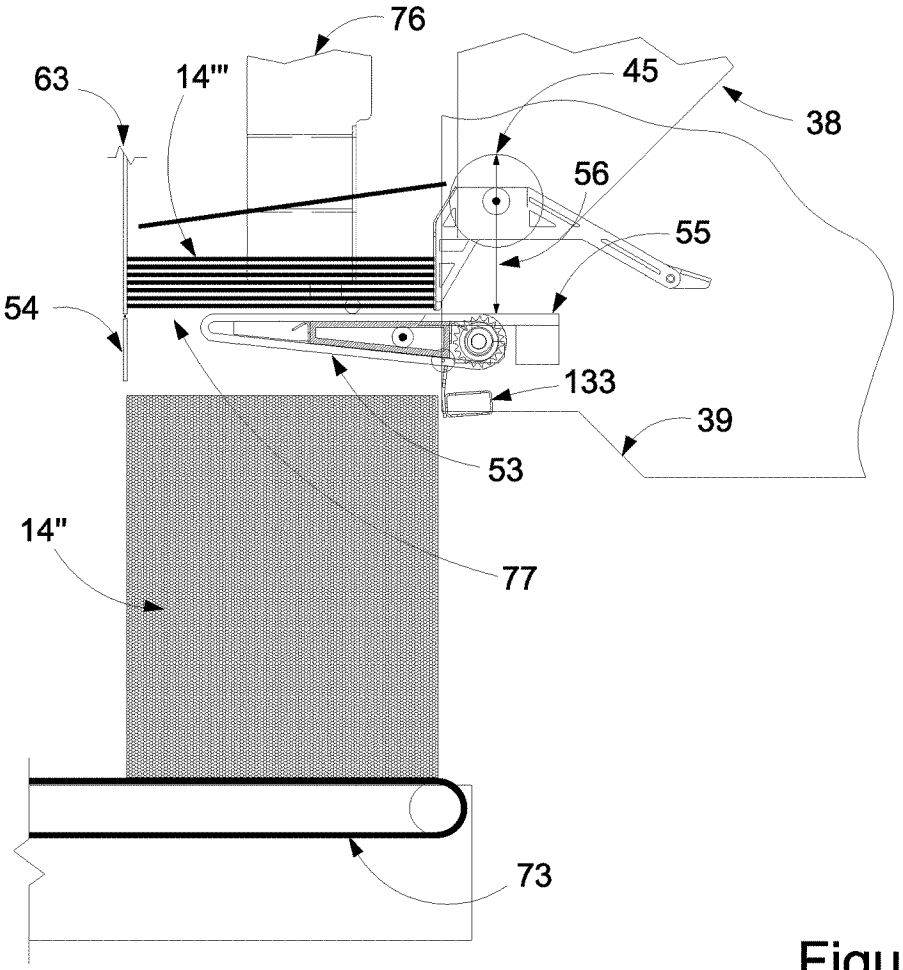

FIG. 56 shows the kinematic overlay state in Load Change Mode with Backstop Lip 54 having cleared the top of the previously completed Load 14" and poised to be interjected into the stacks accumulating region by moving into its horizontally oriented state so as to provide underneath support for the leading edge of the First Sheet 77 of the next Load 14'''. The Accumulator Fingers 53 are extending between the completed Load 14" and the First Sheet 77 of the next Load 14''' and their top surface is flat. The Cross Machine Stack Alignment System 57 is in it Up Position 76 in order to allow the Accumulator Fingers 53 to not interfere with side tamping. The Hopper Size is increasing as required for proper operability based on how fast the nascent new Load 14''' is being built up.

Figure 57:
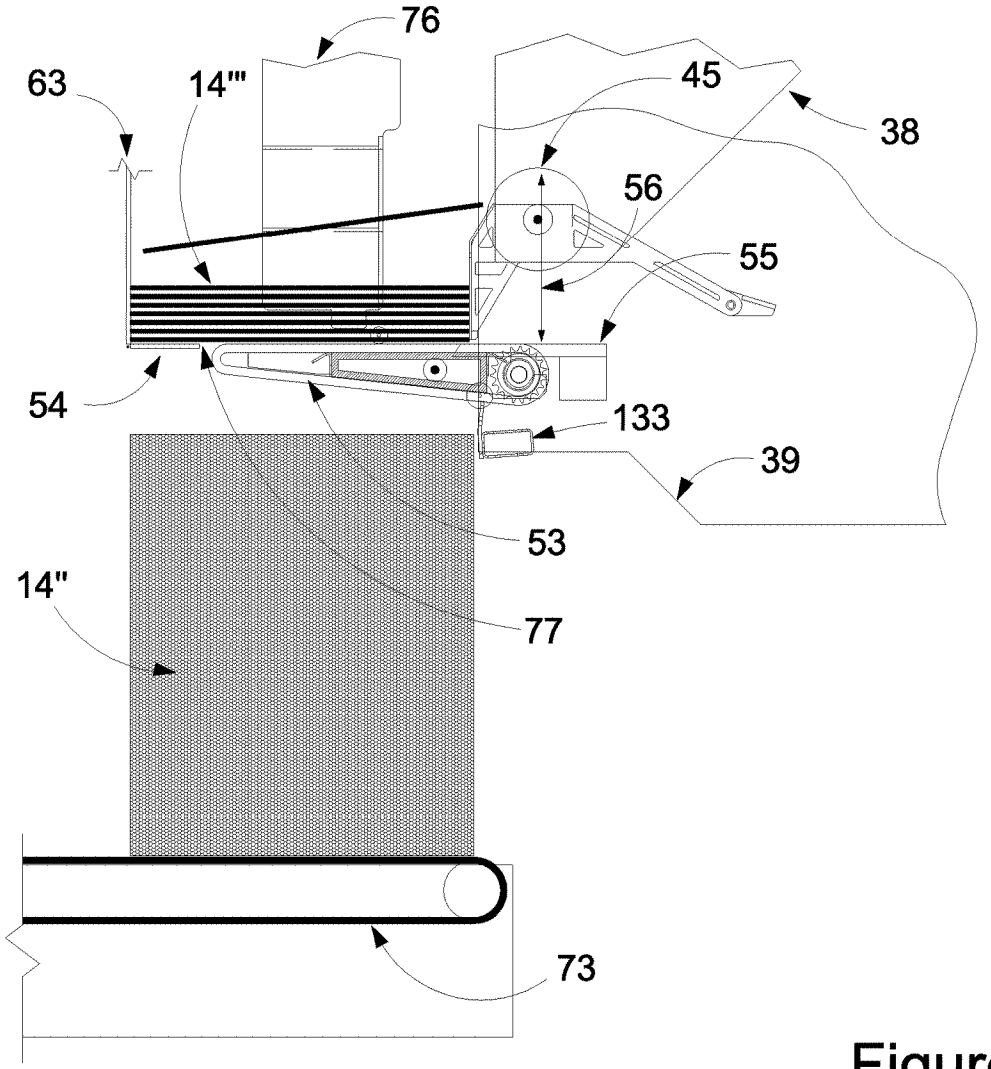

FIG. 57 shows the kinematic overlay state in Load Change Mode with the previously completed Load 14" being discharged in the downstream direction by the Load Conveyor 73 out of the vertical stacks accumulating region. The Backstop Lip 54 has now moved to its horizontal orientation to support the leading edge of the nascent next Load 14'''. The Accumulator Fingers 53 are extending between the discharging completed Load 14'' and the First Sheet 77 of the next Load 14''' and are flat to provide underneath support at least to a central portion of the next Load 14''. The Cross Machine Stack Alignment System 57 is in it Up Position 76 in order to allow the Accumulator Fingers 53 to not interfere with side tamping. The Hopper Size is increasing as required for proper operability based on how fast the nascent new Load 14''' is being built. Accordingly, the nascent new Load 14''' continues to be built without interruption even as the previously completed Load 14'' is ready to be conveyed out of the way by the Load Conveyor 73.

Figure 58:
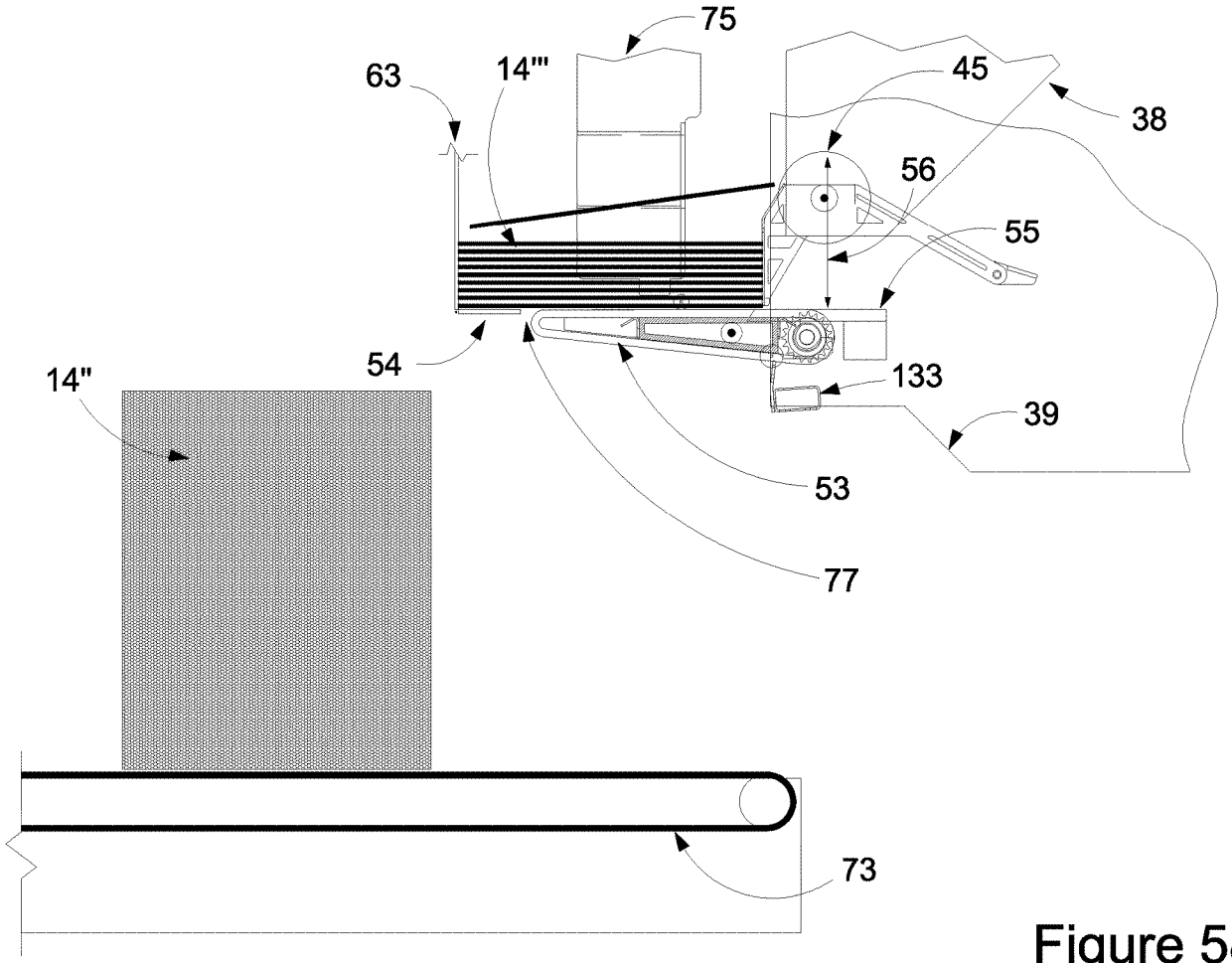

FIG. 58 shows the kinematic overlay state in Load Change Mode after the Load Conveyor 73 has moved the previously completed Load 14'' completely out from the stacks accumulating region. In this state, both the Accumulator Assembly 39 and the Deck Lift Assembly 38 can be lowered due to the cleared space in the stacks accumulating region. The Backstop Lip 54 remains horizontal to support the nascent next Load 14'''. The Accumulator Fingers 53 are extending to provide underneath support at least to a central portion of the First Sheet 77 of the next Load 14''' while in a flat tilt orientation. The Cross Machine Stack Alignment System 57 moves down to its Middle Position 75 since the nascent new Load 14''' has grown tall enough to avoid Finger Assembly interference with side tamping. The Hopper Size is increasing as required for proper operability based on how fast the nascent new Load 14''' is being built. In other words, the conveyed completed Load 14'' is now clear of the stacks accumulating region and both the Accumulator Assembly 39 and the Deck Lift Assembly 38 are lowered to prepare to drop the nascent new Load 14''' down onto the cleared spot on the Load Conveyor 73 similar to what was done in Figures. 45. In some cases it is possible that the lowering of the Deck Lift Assembly 38 may be slower than that of the Accumulator Assembly 39 and the Hopper Size needs to increase for the still growing nascent new Load 14'''.

Figure 59:
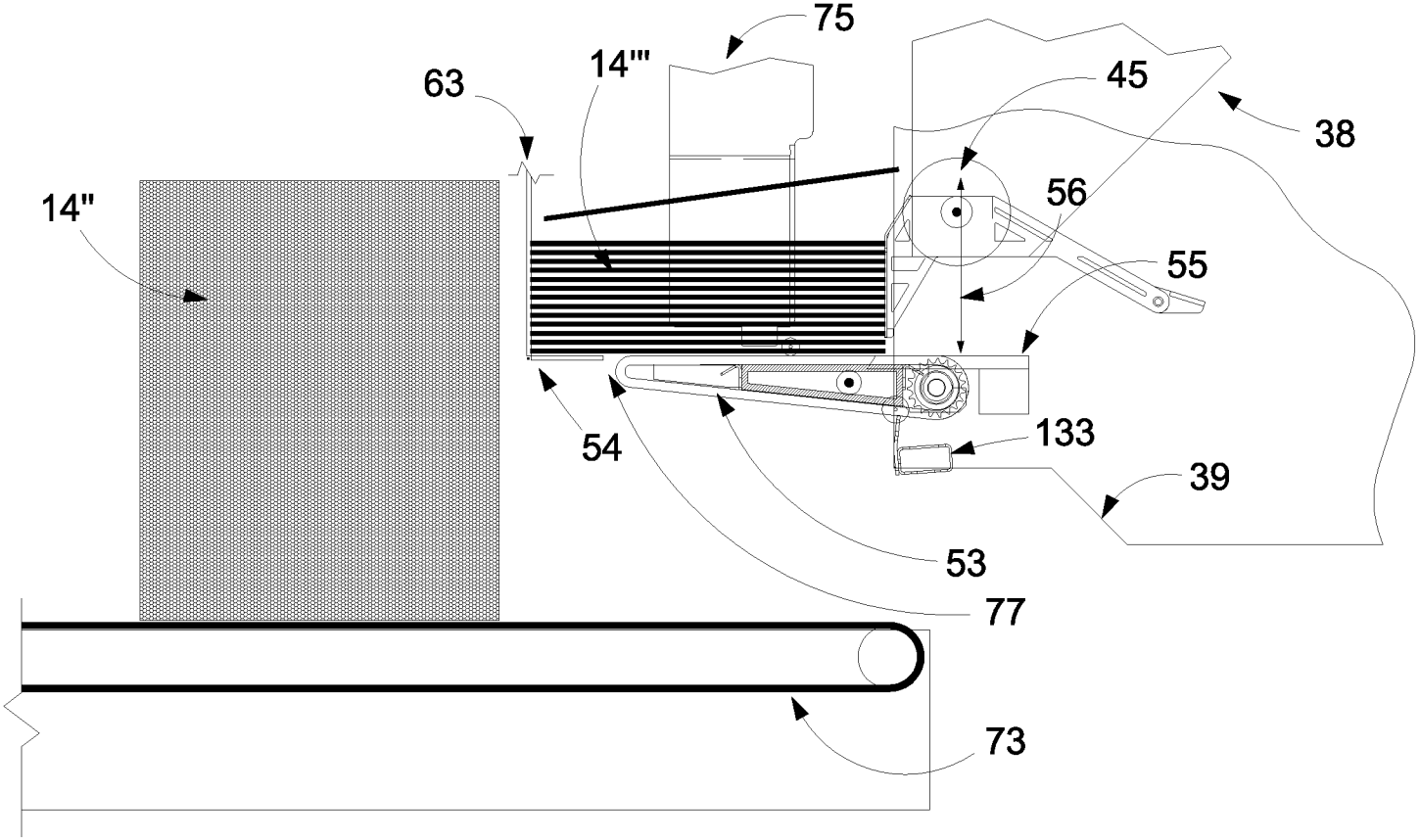

FIG. 59 shows the kinematic overlay state in Load Change Mode after the Load Conveyor 73 has moved the previously completed Load 14'' and the Accumulator Assembly 39 and the Deck Lift Assembly 38 lowering. The Backstop Lip 54 remains horizontal to support the nascent next Load 14''. The Accumulator Fingers 53 are extending to provide underneath support at least to a central portion of the First Sheet 77 of the next Load 14''' while in a flat tilt orientation.

Figure 60:
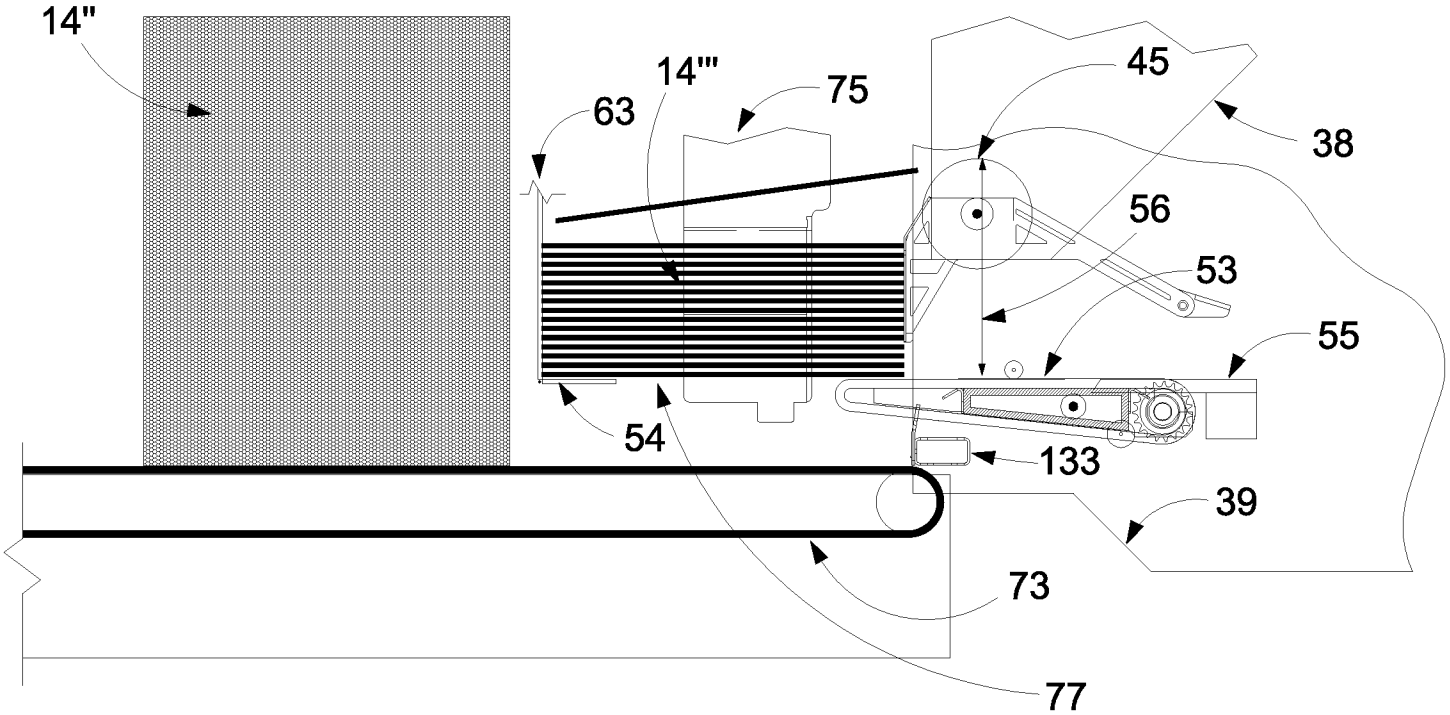

FIG. 60 shows the kinematic overlay state in Load Change Mode as the bottom of the nascent new Load 14''' nears the planned drop area on the Load Conveyor 73. The Backstop Lip 54 is still horizontal, but the Accumulator Fingers 53 have been retracted in the upstream direction so as to just support the trail edge of the next Load 14''' while remaining in the flat support orientation. The Cross Machine Stack Alignment System 57 is in its Middle Position 75 and the Hopper Size 56 is increasing as required for proper operability based on how fast the nascent new Load 14''' is being built.

Figure 61:
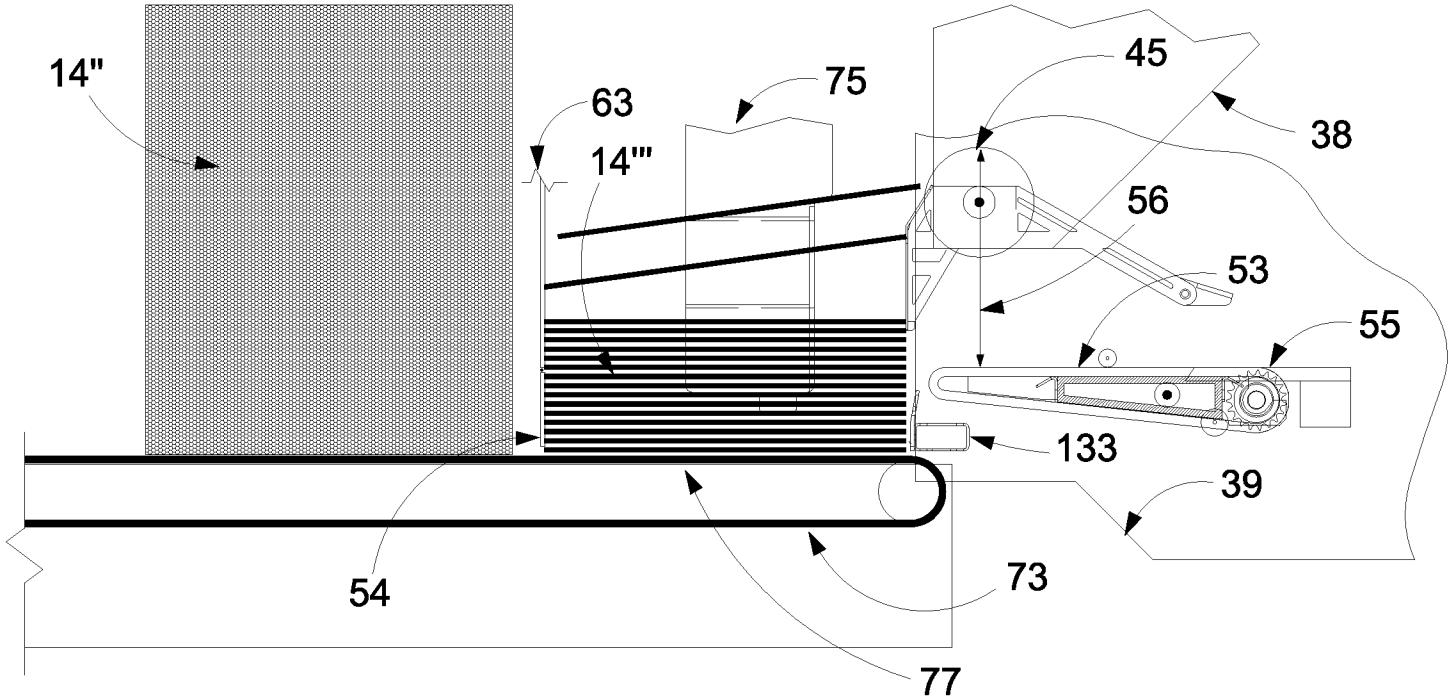

FIG. 61 shows the kinematic overlay state in Load Change Mode after the drop of the nascent new Load 14''' onto the planned drop area of the Load Conveyor 73 has occurred. The Backstop Lip 54 has been retracted out of the stacks accumulating region by shifting into its vertical orientation. During the same transition, the Accumulator Fingers 53 have fully retracted in the upstream direction so as to thereby drop the nascent new Load 14''' onto the Load Conveyor 73. The Cross Machine Stack Alignment System 57 is in its Middle Position 75 and the Hopper Size 56 is increasing as required for proper operability based on how fast the nascent new Load 14''' is still being continuously built (without interruption).

Figure 62:
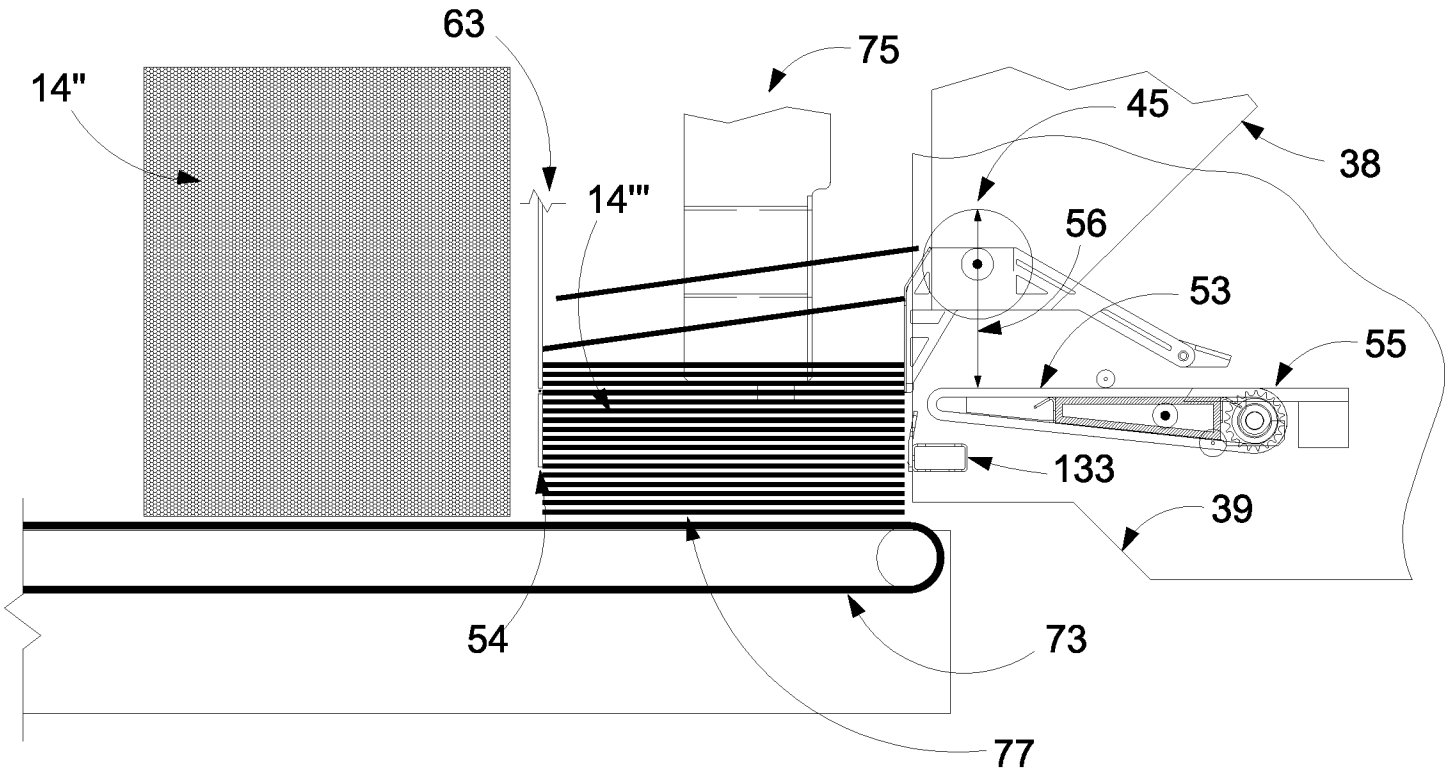

FIG. 62 shows the kinematic overlay state with the Load Change Mode completed and the system now switched into Upstacking Mode similar to the state of FIG. 46. The Backstop Lip 54 is vertical, the Accumulator Fingers 53 are fully retracted and ready to move into their tilt up position, the Cross Machine Stack Alignment System 57 is in it Middle Position 75. This completes a full cycle, which can then repeat for example with the state of FIG. 47 being next.

FIGS. 63-82 are kinematic overlay sequences (motion snapshots) for an exemplary customer order type having relatively long boxes where the Accumulation Sheet Support System is achieved by using the Backstop Lip 54, the Accumulator Fingers 53 and the Trail Edge Comb 55. For clarity, new Boxes 10 falling onto the Load 14'' are not shown and only the size of the Load 14'' is shown to increase in height.

Figure 63:
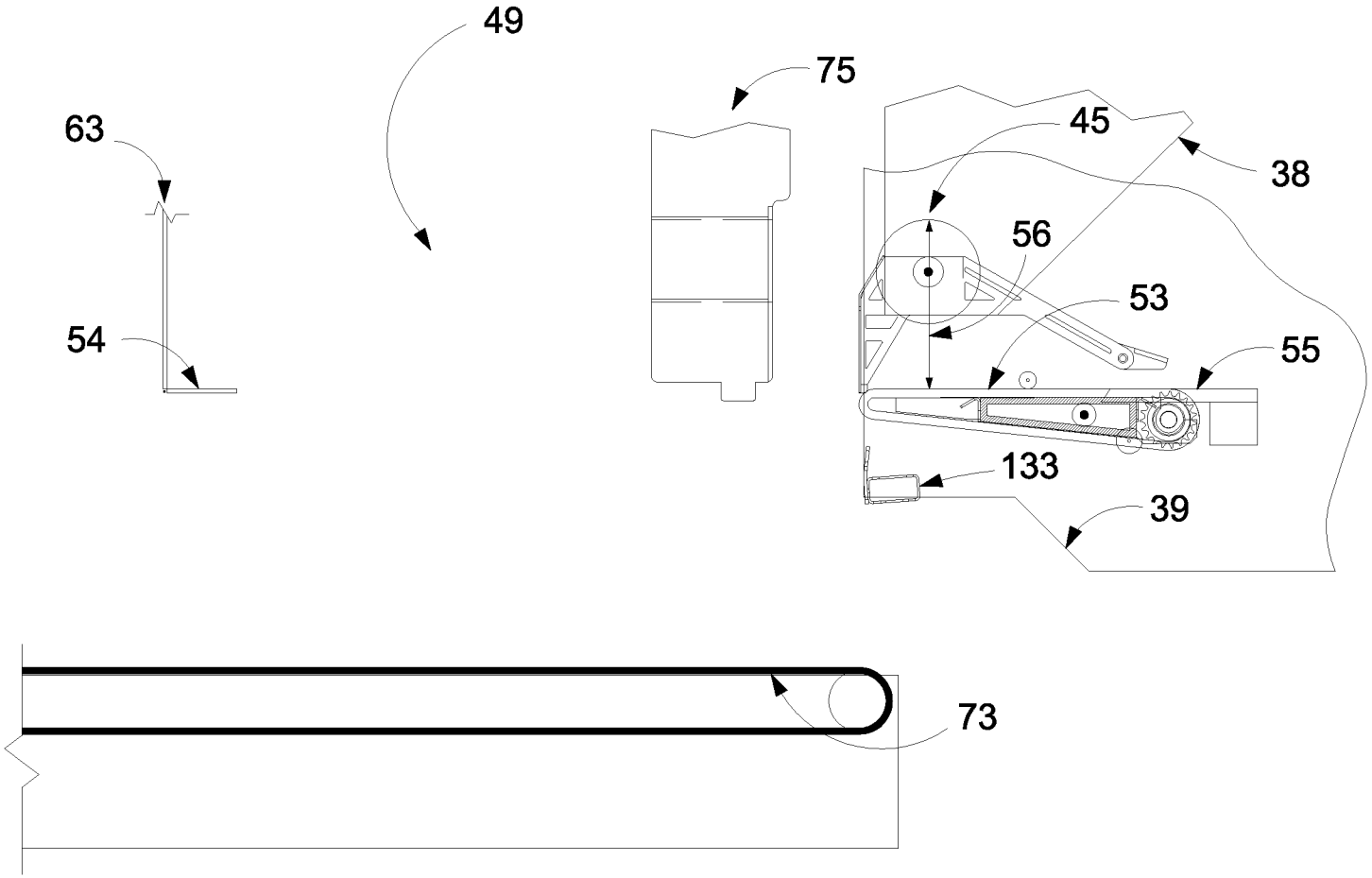
FIGS. 63-82 are kinematic overlay sequences (motion snapshots) for an exemplary customer order type where the Accumulation Sheet Support System is achieved by using by using the Backstop Lip, the Accumulator Fingers and the Trail Edge Comb.

FIG. 63 shows the kinematic overlay state in an example initial state before the start of production (note that the conveyor belt on the bottom left has no boxes on it) where the Backstop Lip 54 is in a horizontal interjected state (interjected into the stacks accumulating region but not supporting any boxes), the Accumulator Fingers 53 is fully retracted (upstream-wise to be parked outside the stacks accumulating region) and level, the Trail Edge Comb 55 is fully retracted while both the Deck Lift Assembly 38 and the Accumulator Assembly 39 are at their closest elevational spacing thus defining a minimum Hopper Size 56. As the Backstop Lip 54 is elevated a substantial distance above the Load Conveyor 73, the Dynamic Hopper 49 will first be used in a Downstacking Mode (e.g., in FIG. 43) before switching to an Upstacking Mode.

FIG. 64 shows the kinematic overlay state soon after the beginning of a nascent new Load 14' whose bottommost sheet is supported by the Backstop Lip 54 being in the horizontal interjected state, the Accumulator Fingers 53 being substantial extended into the stacks accumulating region to support the center region of the nascent new Load 14', the Trail Edge Comb 55 is extended into the stacks accumulation region for trail edge support, the elevation of the Cross Machine Stack Alignment System 57 being in its Middle Position 75 and the vertical distance from the Stacking Deck Discharge Surface 45 to bottom supports 54 and 53 being relatively small so as to define a minimum Hopper Size 56.

FIG. 65 shows the kinematic overlay state in a Downstacking Mode where the Load is built (boxes are accumulated into it) while the Backstop Lip 54 is moving down and kept in its horizontal Load 14'' supporting mode, while the Accumulator Fingers 53 are also moving down and kept substantially extended and the Trail Edge Comb 55 extended for trail edge support, while the Cross Machine Stack Alignment System 57 is in it Middle Position 75 and the Hopper Size 56 being increased because the Accumulator Assembly 39 is lowering. In this embodiment, the Lower Stack Stop Comb 133 has pivoted up and is resting on the Load Conveyor 73 in preparation for receiving and guiding the bottom of the load as it is being dropped.

Figure 66:
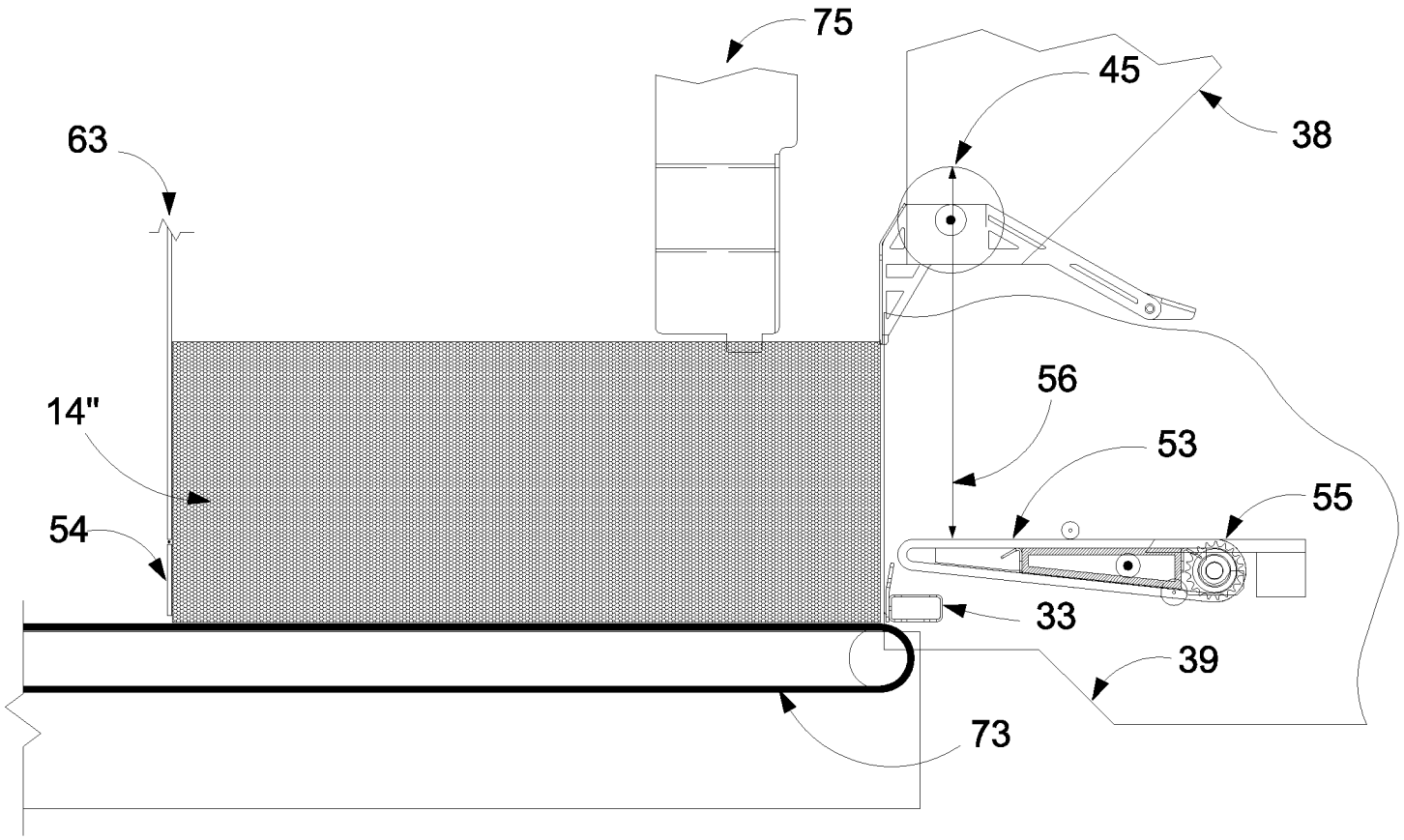

FIG. 66 shows the kinematic overlay state soon after the state of FIG. 65 but for the case where the bottom of the building Load 14'' has been dropped onto the Load Conveyor 73. The dropping has been accomplished by switching the Backstop Lip 54 into its retracted vertical state, by fully retracting the Accumulator Fingers 53 and the Trail Edge Comb 55 out of the vertical stacks accumulating region. The Cross Machine Stack Alignment System 57 is in it Middle Position 75 and the Hopper Size is the same as before the drop. The Lower Stack Stop Comb 133 is still resting on the Load Conveyor 73 for guiding the bottom of the Load as it is being dropped.

Figure 67:
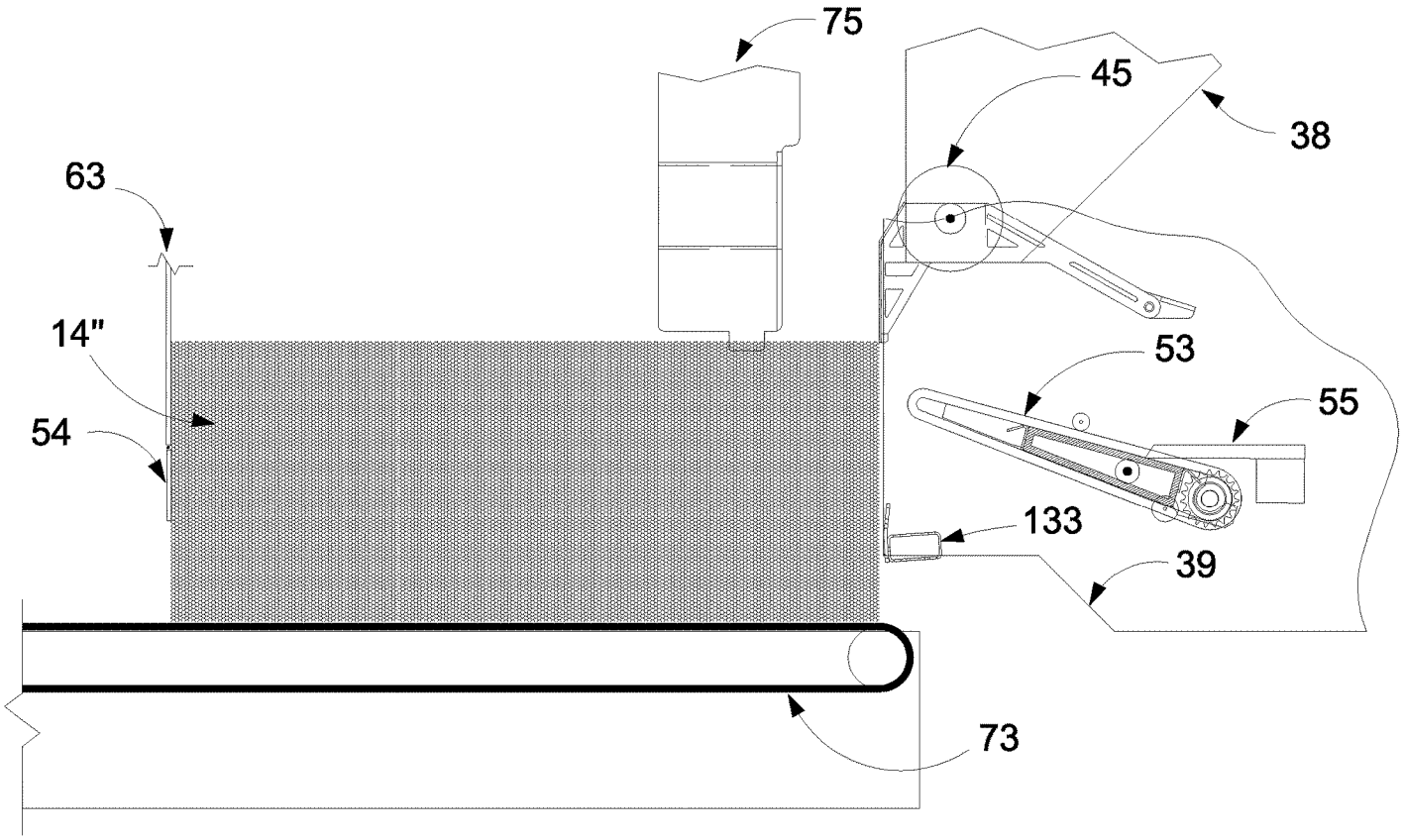

FIG. 67 shows the kinematic overlay state with the system next switched into an Upstacking Mode after the Load 14" has been dropped on the Load Conveyor 73. Here, the Backstop Lip 54 remains in its retracted vertical state as it rises up away from the conveyor, the Accumulator Fingers 53 remain fully retracted but are being rotationally reoriented into their tilt up position, the Trail Edge Comb 55 remains fully retracted, the Cross Machine Stack Alignment System 57 is in its Middle Position 75 and the Hopper Size is being reduced by having the elevation of Accumulator Assembly 39 rising faster than the elevation of Deck Lift Assembly 38.

Figure 68:
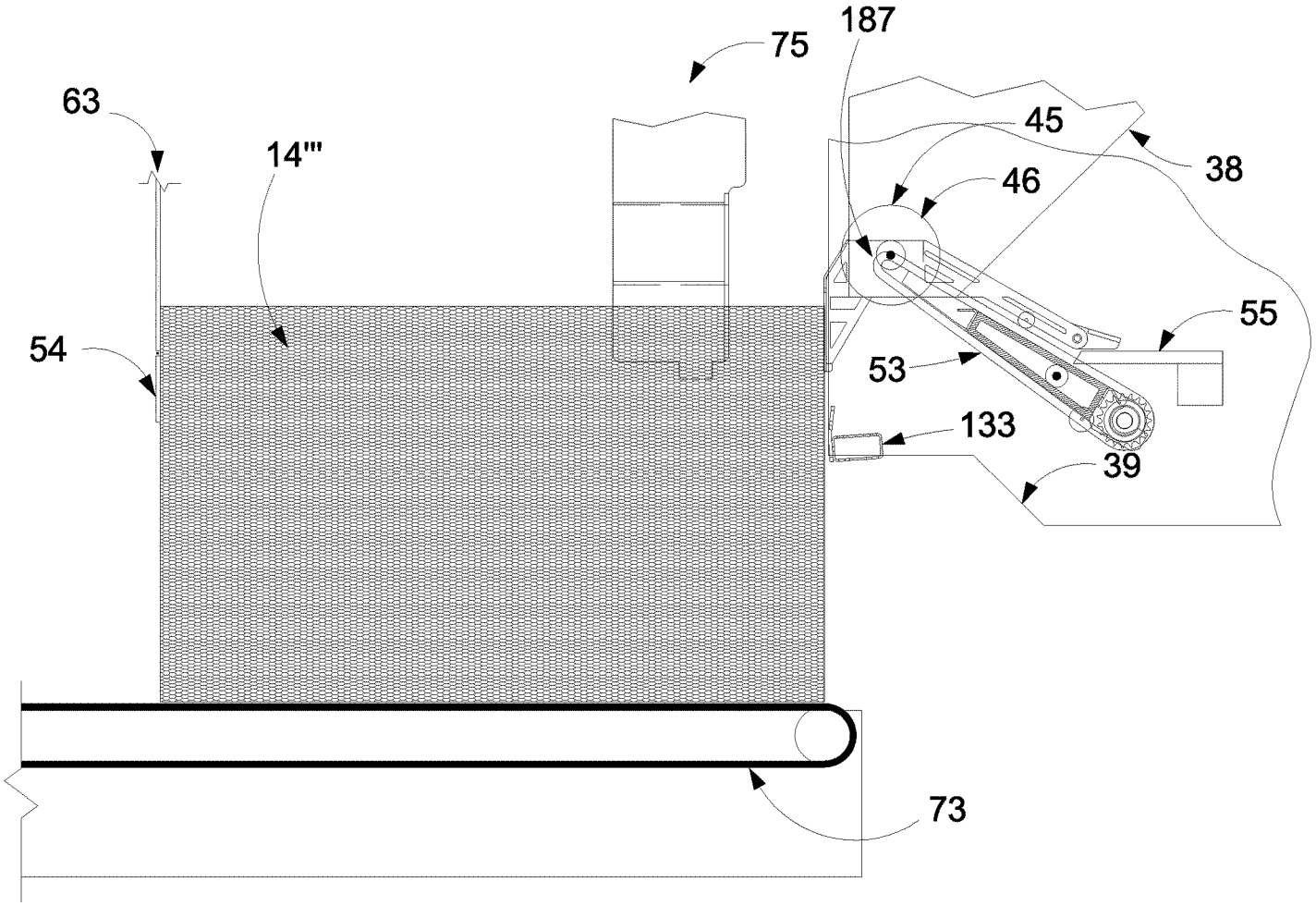

FIG. 68 shows the kinematic overlay state while still in the Upstacking Mode with Backstop Lip 54 still vertical and further raised, the Accumulator Fingers 53 fully retracted, raised together with the Backstop Lip 54 and now in its fully tilt up position, the Trail Edge Comb 55 remains fully retracted, the Cross Machine Stack Alignment System 57 is in its Middle Position 75 and the Hopper Size has decreased back to its minimum. The Accumulator Finger Lead Edges 187 are parked in the gaps between the Stacking Deck Discharge Pulleys 46.

Figure 69:
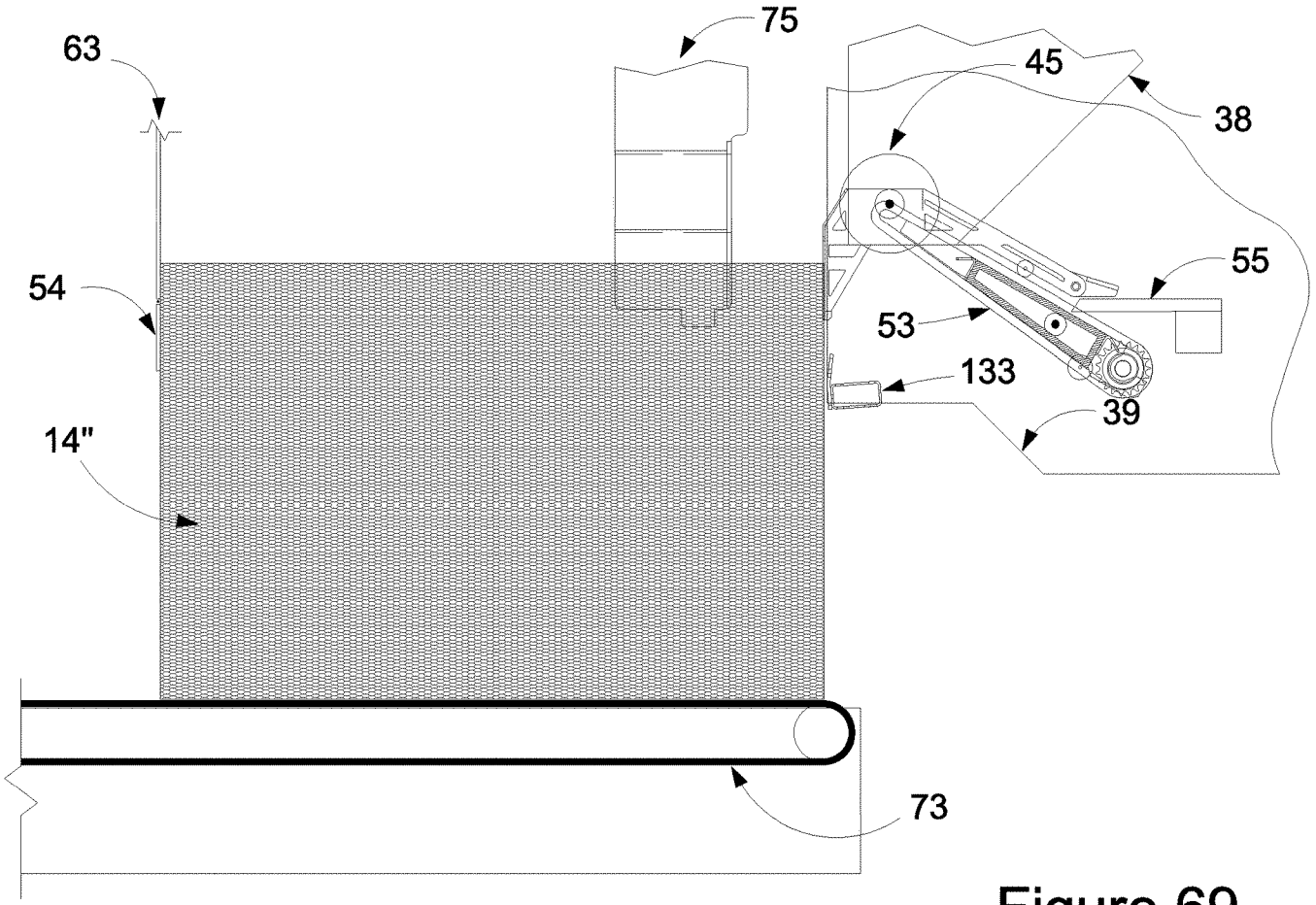

FIG. 69 shows the kinematic overlay state in Upstacking Mode with Backstop Lip 54 is vertical, the Accumulator Fingers 53 fully retracted and now in its fully tilt up position, the Trail Edge Comb 55 remains fully retracted, the Cross Machine Stack Alignment System 57 is in it Middle Position 75 and the Hopper Size back at its minimum and the Computer Control System 50 has decided the currently built Load 14" is complete, meaning an impending Load Change is coming up with the First Sheet 77 (not shown) of the next Load 14''' approaching without interruption of continuous sheet feeding by the Stacking Deck 33.

Figure 70:
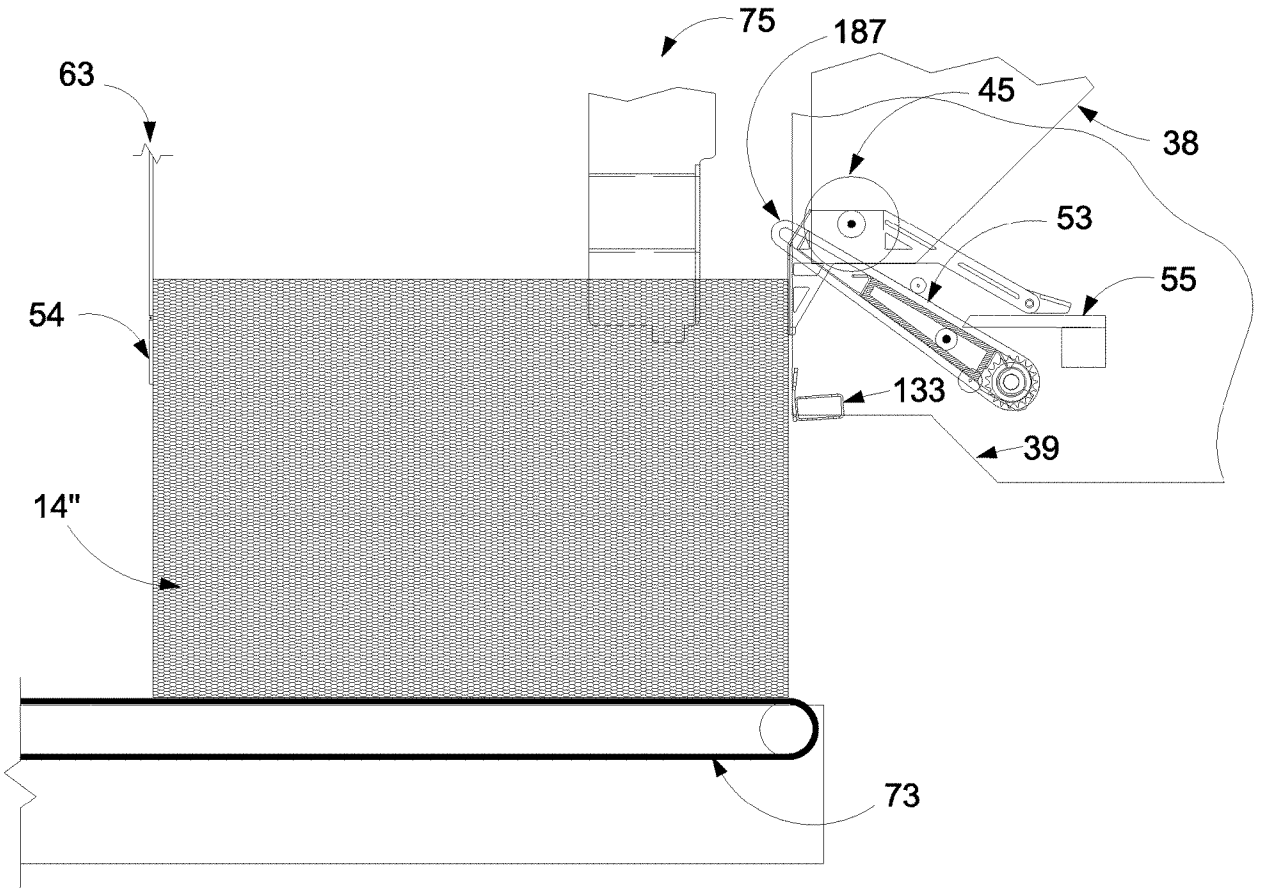

FIG. 70 shows the kinematic overlay state in the Load Change Mode with the Backstop Lip 54 still in vertical, but before the First Sheet 77 (not shown) of the next Load 14''' drops in, the Accumulator Fingers 53 have inserted their Accumulator Finger Lead Edges 187 (finger tips) into the stacks accumulating region so as to be interjected between the completed Load 14" and the First Sheet 77 of the next Load 14". In this state, the Cross Machine Stack Alignment System 57 is in its Middle Position 75 and the Hopper Size is still at its minimum.

Figure 71:
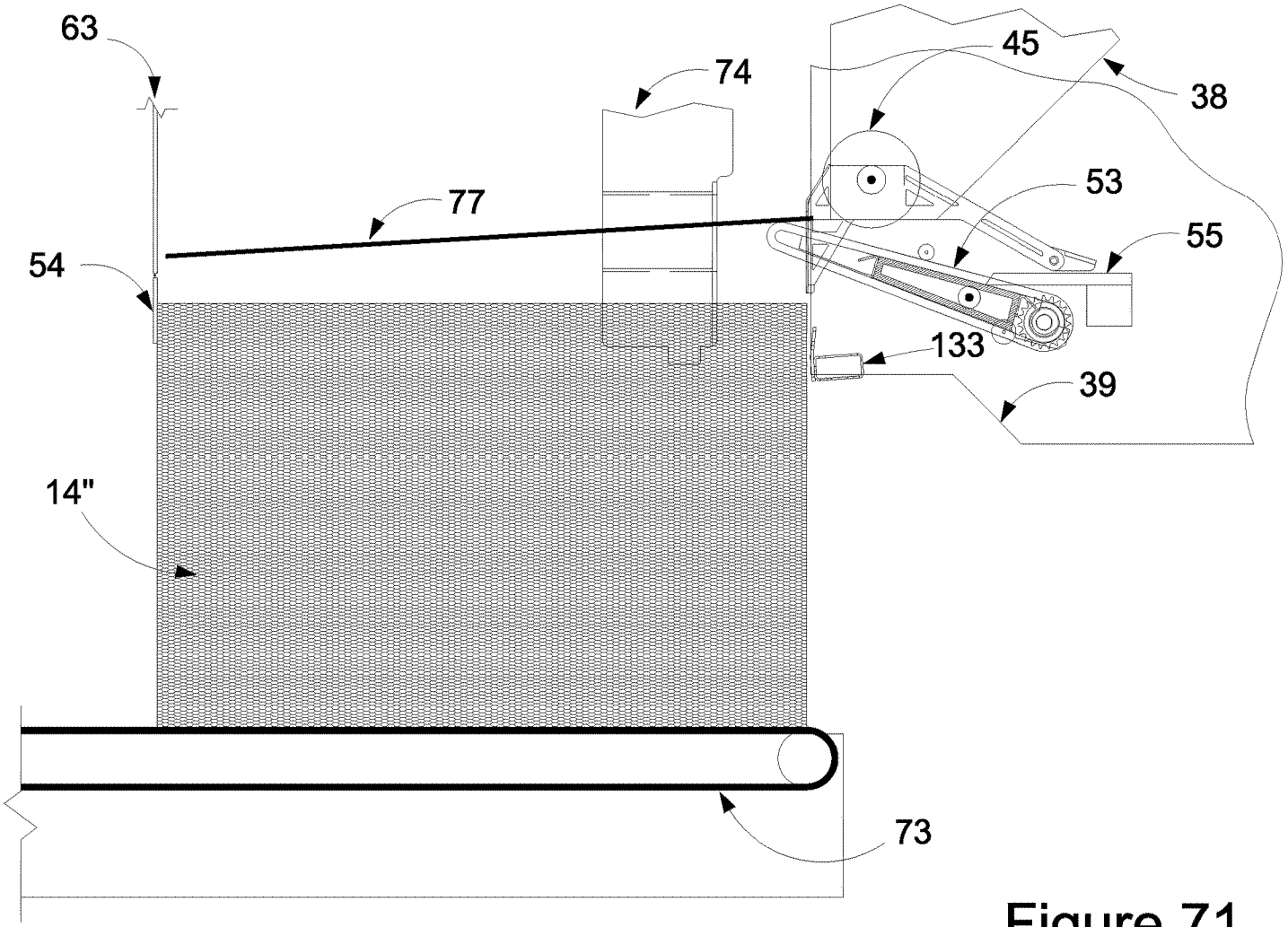

FIG. 71 shows the kinematic overlay state in the Load Change Mode where the First Sheet 77 of the next Load 14''' has begun dropping into the vertical stacks accumulating region. The Backstop Lip 54 is vertical, the Accumulator Finger Lead Edges 187 (finger tips) in between the completed Load 14" and the First Sheet 77 of the next Load 14''' and is now rotating from full tilt up state back around towards its level position as it engages with a trailing portion of the First Sheet 77. The Trail Edge Comb 55 remains fully retracted. The Cross Machine Stack Alignment System 57 is moving at the same time to its Down Position 74 and the Hopper Size 56 is still at its minimum. As this is occurring, coordinate motion control by the Computer Control System 50 is causing a raising of the elevation of both the Accumulator Assembly 39 and the Deck Lift Assembly 38 in order to keep the bottom of the Accumulator Fingers 53 slightly above the completed Load 14". Also, at the same time the Computer Control System 50 is using information from sensor eyes looking across the top of the Load 14" to measure the exact height of the Load 14" in order to make sure the bottom of the Accumulator Fingers 53 is clear of that completed Load 14".

Figure 72:
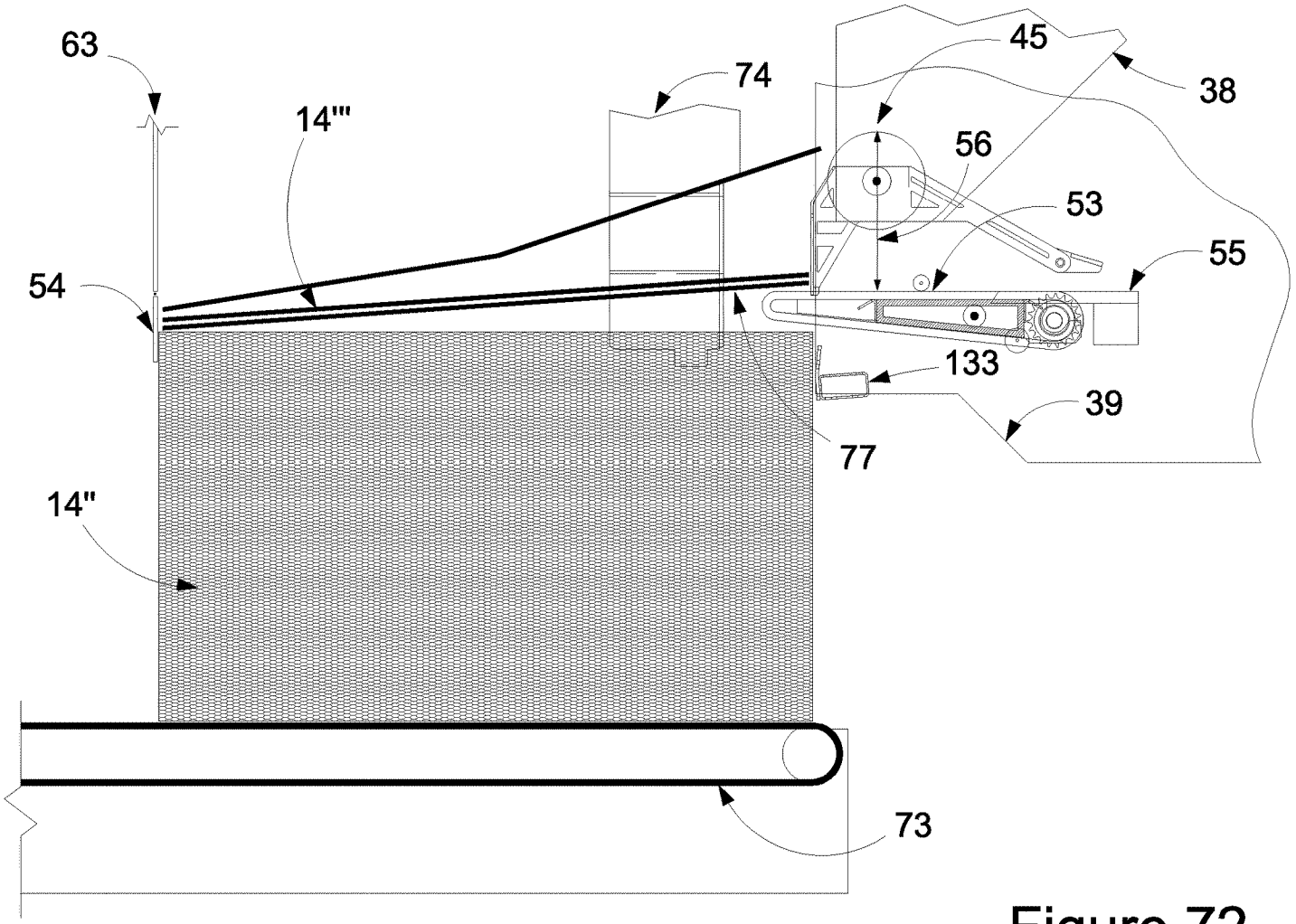

FIG. 72 shows the kinematic overlay state while still in Load Change Mode except that now more sheets of the nascent new Load 14"' besides First Sheet 77 have dropped into the stacks accumulating region. The Backstop Lip 54 is still vertical, the Accumulator Finger Lead Edges 187 (finger tips) inserted in between the completed Load 14" and the First Sheet 77 of the next Load 14''' and is now level. The Trail Edge Comb 55 remains fully retracted. The Cross Machine Stack Alignment System 57 is in it Down Position 74 and the Hopper Size is still at its minimum as the system waits for a minimum amount of the nascent new Load 14''' to build up in the stacks accumulating region in order to keep proper tamping against the sides and trailing face of the nascent new Load 14'''.

Figure 73:
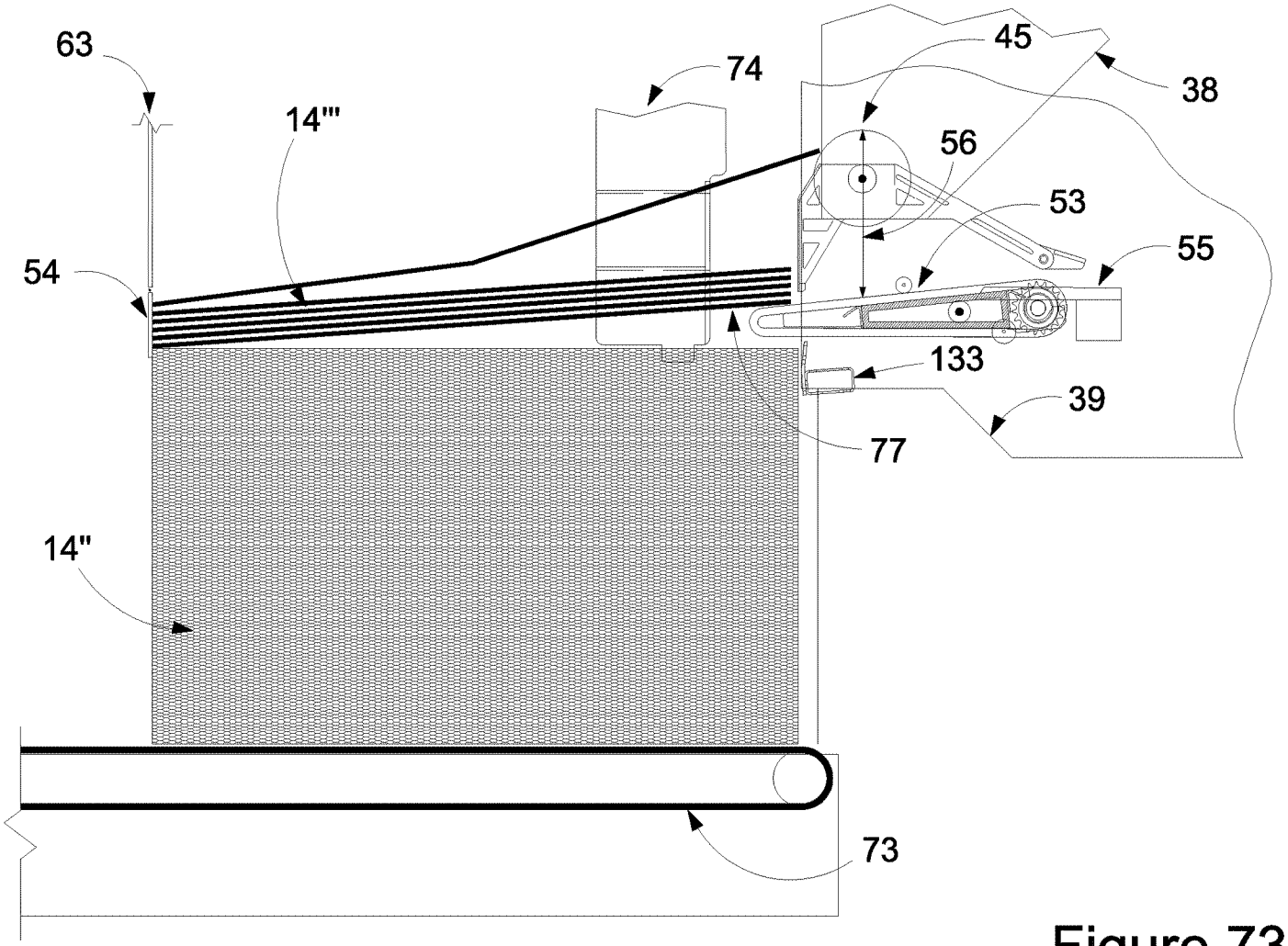

FIG. 73 shows the kinematic overlay state in Load Change Mode with the Backstop Lip 54 vertical, the Accumulator Finger Lead Edges 187 (finger tips) inserted in between the completed Load 14" and the First Sheet 77 of the next Load 14''' but with the Accumulator Fingers 53 now tilted down so as to decrease the inclination angles of the accumulated beginning sheets of the nascent new Load 14'''. The Trail Edge Comb 55 remains fully retracted. The Cross Machine Stack Alignment System 57 is in it Down Position 74 and the Hopper Size 56 is increasing as the Stacking Deck Discharge End 41 rises with the Accumulator Fingers 53 holding their elevational position above the existing Load 14" and the nascent new Load 14''' is continuing to build. Being tilted in the downward tilt position allows a minimum intrusion profile of the Finger Assembly to slice between the existing Load 14" and the nascent new Load 14''' with minimal separation.

Figure 74:
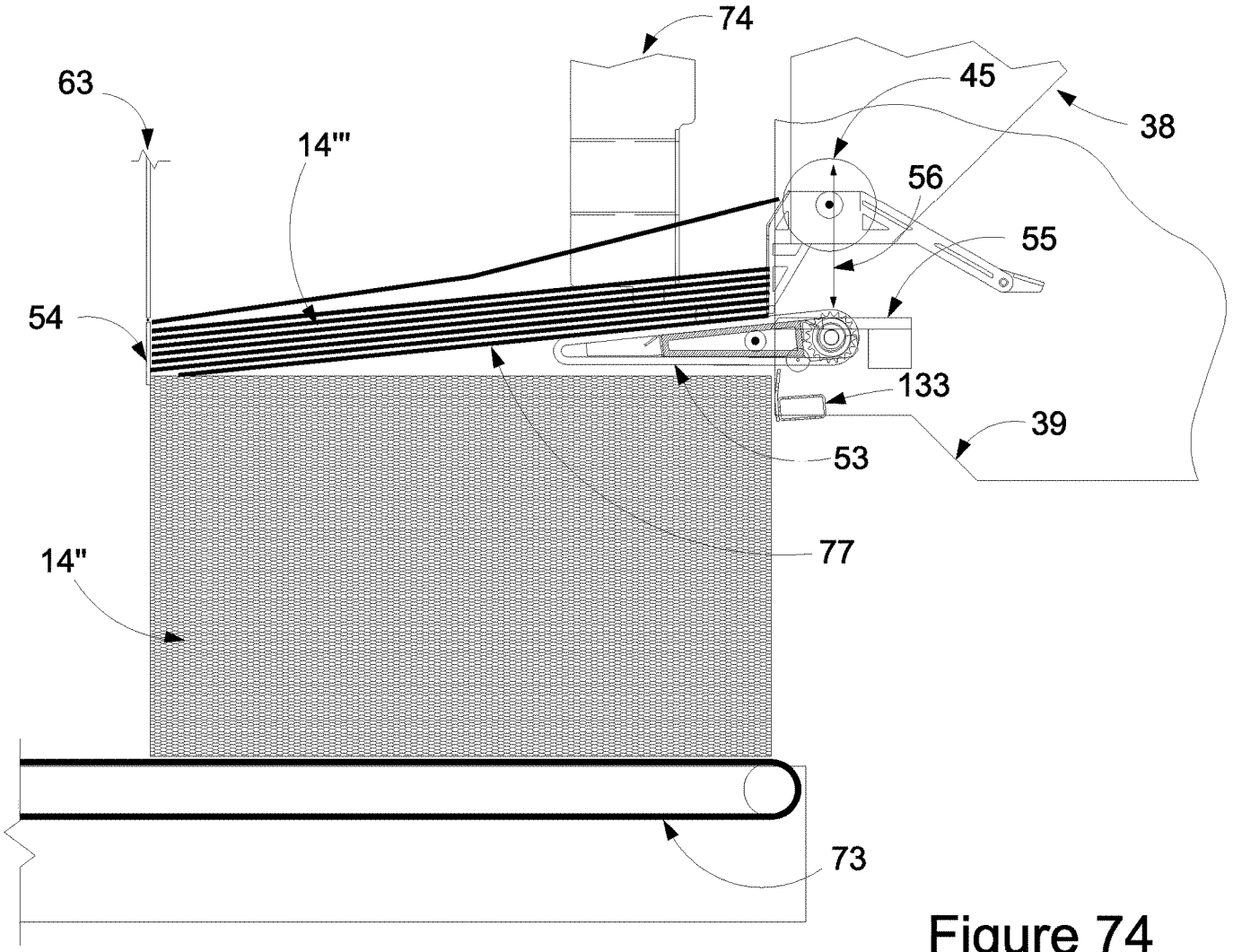

FIG. 74 shows the kinematic overlay state in Load Change Mode with a next incoming sheet of the nascent new Load 14''' guided along an inclined downstream face of the Trail Edge Tamper 62. The Backstop Lip 54 is vertical, the Accumulator Finger Lead Edges 187 (finger tips) in between the completed Load 14" and the First Sheet 77 of the next Load 14''' and is tilted down in the downstream direction because its leading edge rests on the previous Load 14". The Accumulator Fingers 53 and the Trail Edge Comb 55 are being inserted between the previous Load 14" and the nascent new Load 14'''. The Cross Machine Stack Alignment System 57 is in it Down Position 74 and the Hopper Size is increasing as the Accumulator Fingers 53 holding its position above the existing Load 14" and the nascent new Load 14''' is continuing to build. A predetermined minimum amount of the nascent new Load 14''' should be deposited for proper tamping during the upcoming further separation stage.

Figure 75:
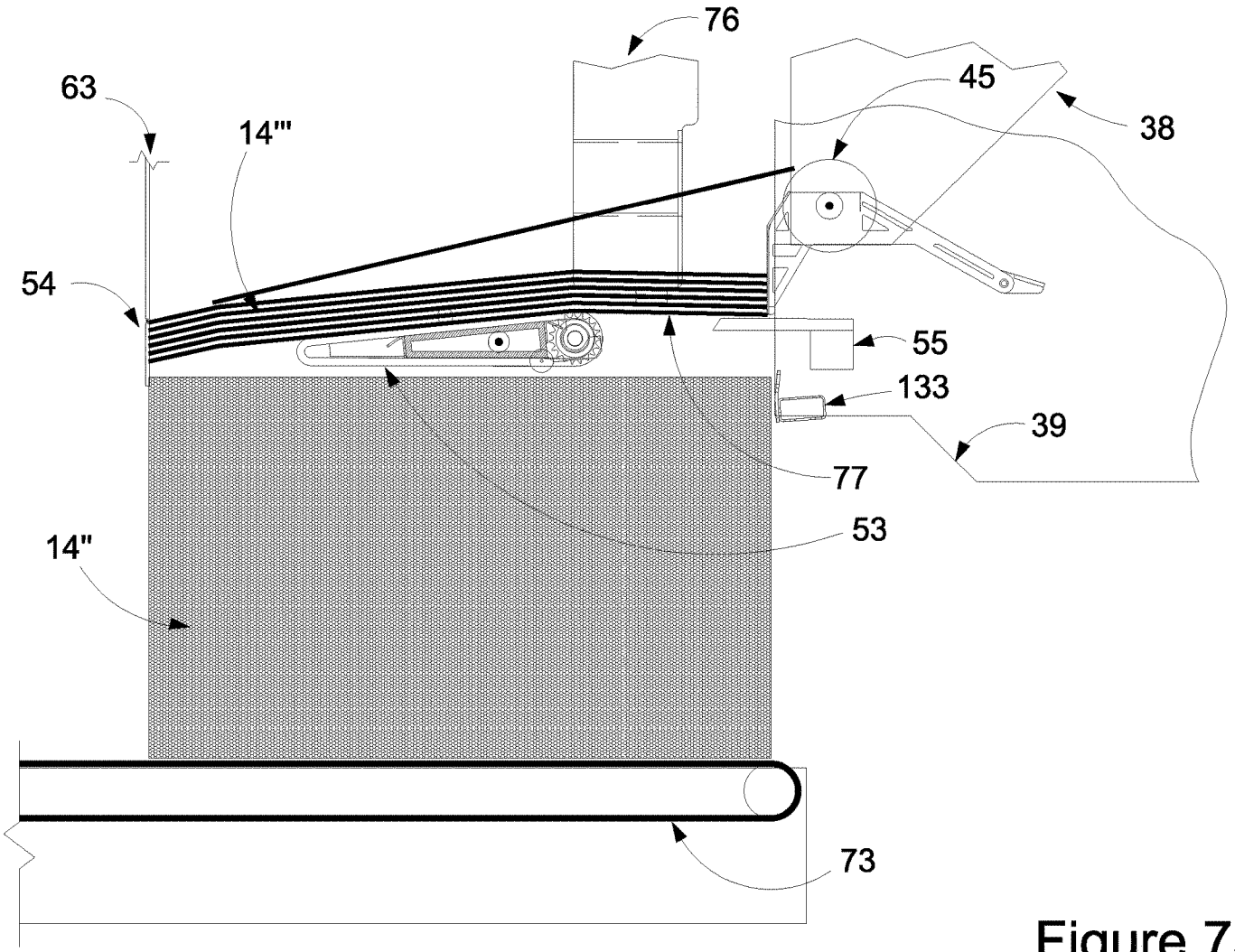

FIG. 75 shows the kinematic overlay state of the system in the Load Change Mode with Backstop Lip 54 near the top of the previously completed Load 14" and still in the vertical orientation. The Accumulator Fingers 53 have advanced substantially horizontally downstream so as to continue their extending between the previously completed Load 14" and the First Sheet 77 of the nascent next Load 14''' with the upper surface of the Accumulator Fingers 53 tilted down providing support for the central region of the nascent new Load 14". In this state, the Trail Edge Comb 55 is advanced downstream so as to be now positioned to support to the trail edge of the relatively long boxes of the nascent new Load 14''', the Cross Machine Stack Alignment System 57 moves from its Down Position 74 to its Up Position 76 in order to move the side tampers out of the way and allow the Accumulator Fingers 53 to interject deeper into the stacks accumulating region so as to support a more center portion of the First Sheet 77 of the nascent next Load 14'''. Accordingly the lifted side tampers do not interfere with the interjected Accumulator Fingers 53. In this state the Hopper Size 56 is increasing as required for operability based on how fast the nascent new Load 14''' is being built up.

Figure 76:
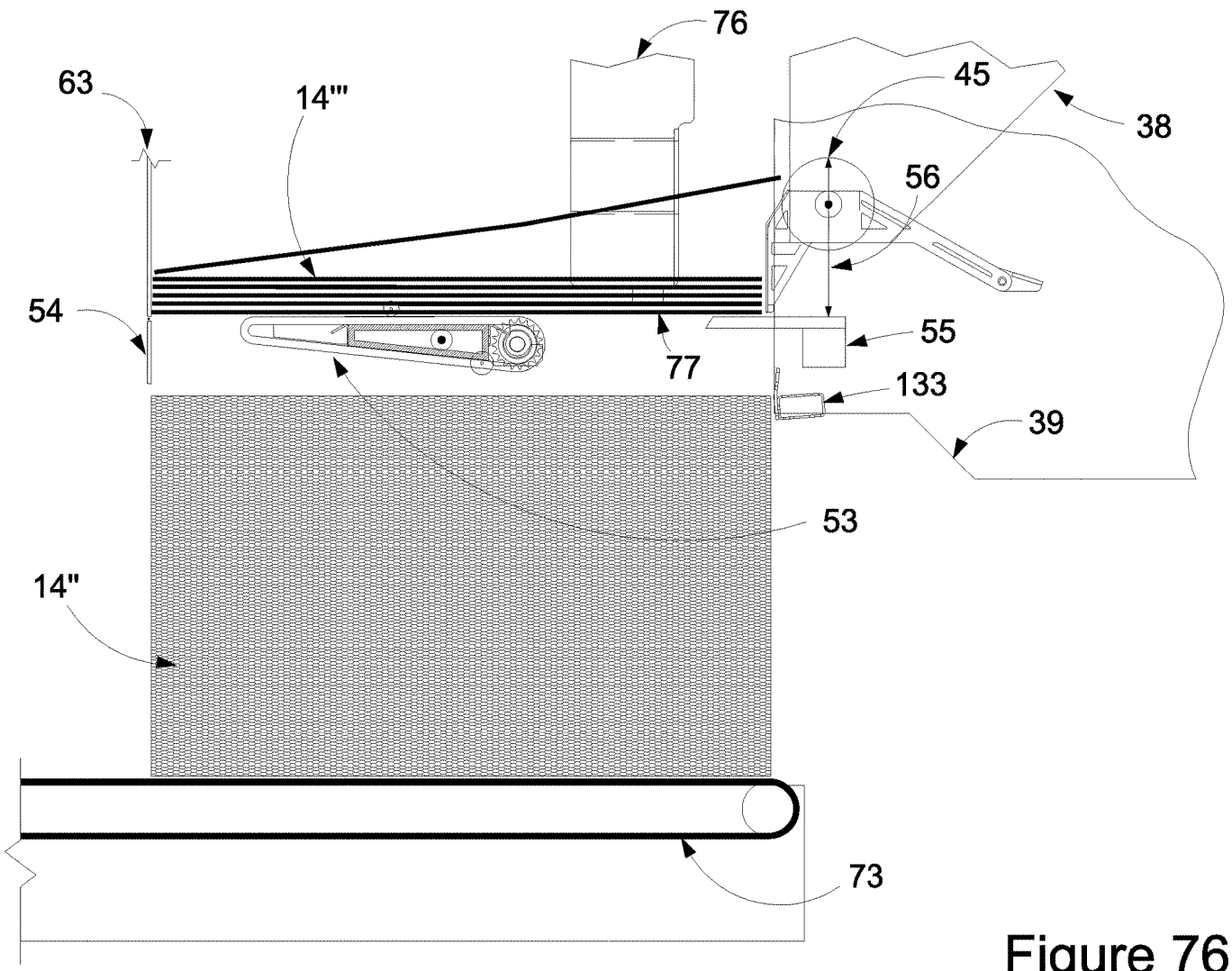

FIG. 76 shows the kinematic overlay state in Load Change Mode with Backstop Lip 54 having cleared the top of the previously completed Load 14'' and poised to be interjected into the stacks accumulating region by moving into its horizontally oriented state so as to provide underneath support for the leading edge of the First Sheet 77 of the next Load 14'''. The Accumulator Fingers 53 are extending between the completed Load 14'' and the First Sheet 77 of the next Load 14''' and their top surface is flat providing support for the central region of the nascent new Load 14'''. The Trail Edge Comb 55 positioned to support to the trail edge of the nascent new Load 14'''. The Cross Machine Stack Alignment System 57 is in it Up Position 76 in order to allow the Accumulator Fingers 53 to not interfere with side tamping. The Hopper Size is increasing as required for proper operability based on how fast the nascent new Load 14''' is being built up.

Figure 77:
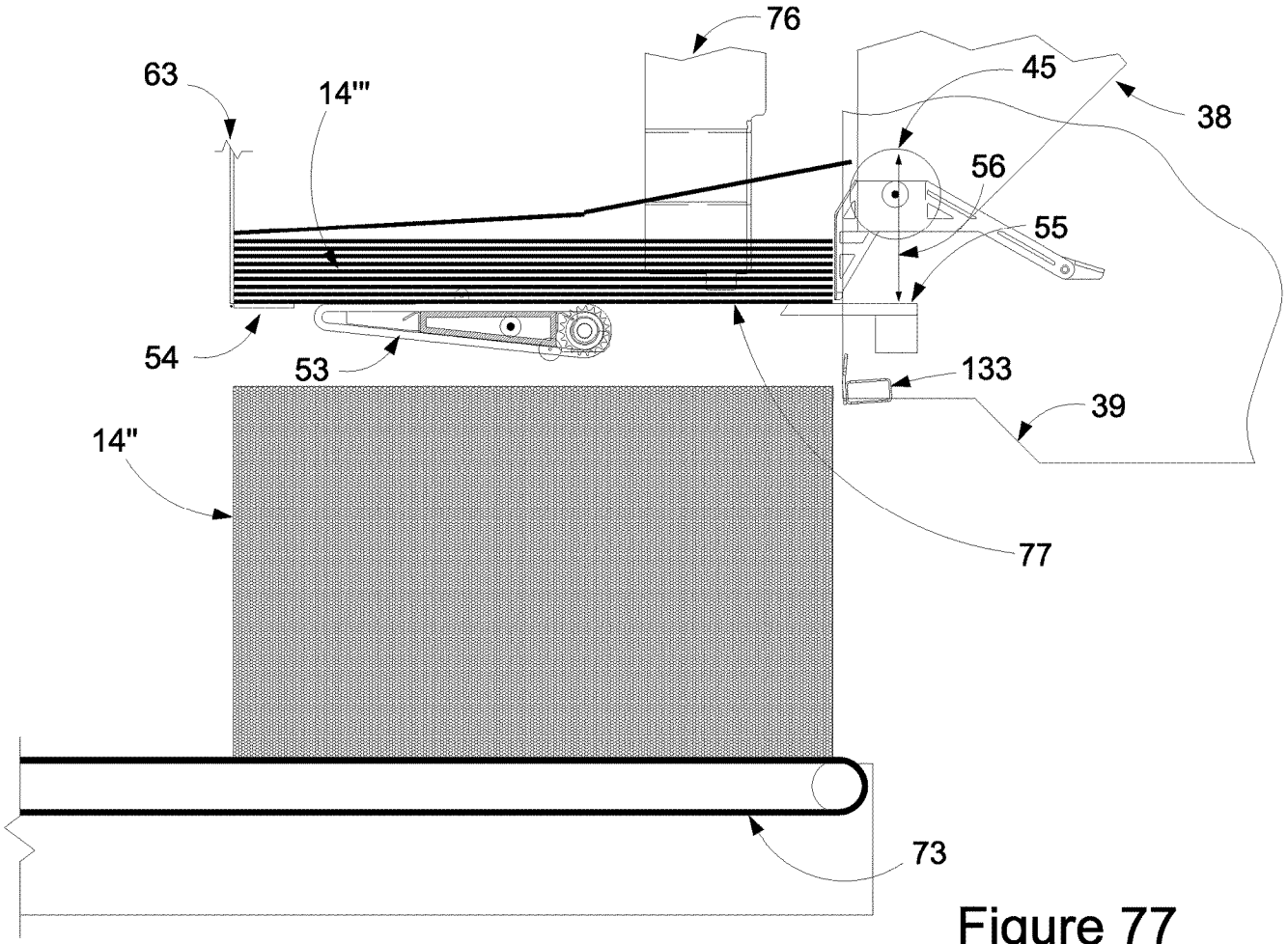

FIG. 77 shows the kinematic overlay state in Load Change Mode with the previously completed Load 14'' being discharged in the downstream direction by the Load Conveyor 73 out of the vertical stacks accumulating region. The Backstop Lip 54 has now moved to its horizontal orientation to support the leading edge of the nascent next Load 14'''. The Accumulator Fingers 53 are extending between the discharging completed Load 14'' and the First Sheet 77 of the next Load 14''' and are flat providing support for the central region of the nascent new Load 14'''. The Trail Edge Comb 55 is positioned to support to the trail edge of the nascent new Load 14'''. The Cross Machine Stack Alignment System 57 is in its Up Position 76 in order to allow the Accumulator Fingers 53 to not interfere with side tamping. The Hopper Size is increasing as required for proper operability based on how fast the nascent new Load 14''' is being built. Accordingly, the nascent new Load 14''' continues to be built without interruption even as the previously completed Load 14'' is ready to be conveyed out of the way by the Load Conveyor 73.

Figure 78:
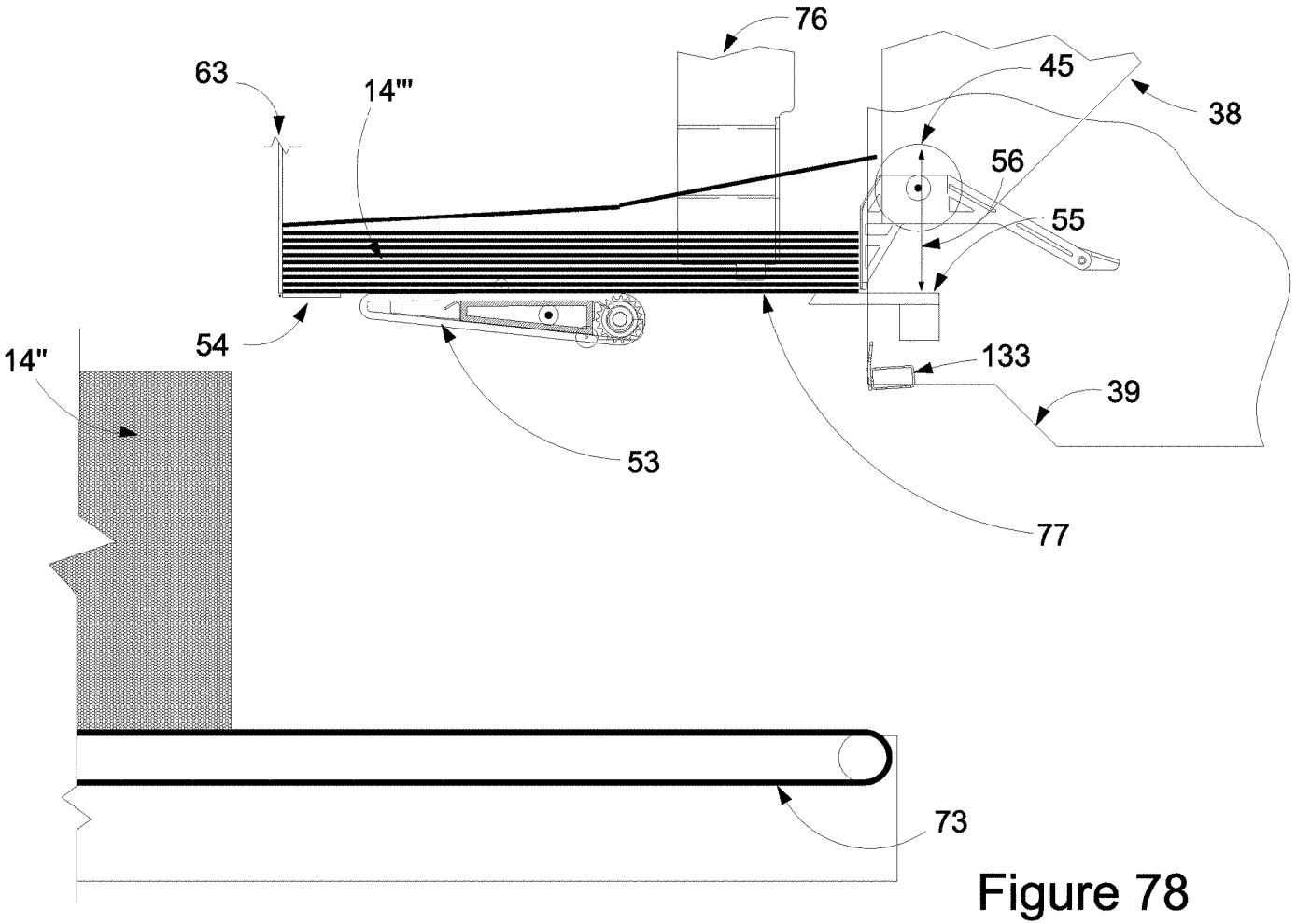

FIG. 78 shows the kinematic overlay state in Load Change Mode after the Load Conveyor 73 has moved the previously completed Load 14'' completely out from the stacks accumulating region. In this state, both the Accumulator Assembly 39 and the Deck Lift Assembly 38 can be lowered due to the cleared space in the stacks accumulating region. The Backstop Lip 54 remains horizontal to support the nascent next Load 14'''. The Accumulator Fingers 53 are extending between the discharging completed Load 14'' and the First Sheet 77 of the next Load 14''' and are flat providing support for the central region of the nascent new Load 14' while in a flat tilt orientation. The Trail Edge Comb 55 is positioned to support to the trail edge of the nascent new Load 14'''. The Cross Machine Stack Alignment System 57 moves down to its Middle Position 75 since the nascent new Load 14''' has grown tall enough to avoid Finger Assembly interference with side tamping. The Hopper Size is increasing as required for proper operability based on how fast the nascent new Load 14'is being built. In other words, the conveyed completed Load 14'' is now clear of the stacks accumulating region and both the Accumulator Assembly 39 and the Deck Lift Assembly 38 are lowered to prepare to drop the nascent new Load 14''' down onto the cleared spot (load receiving surface) on the Load Conveyor 73 similar to what was done in FIG. 45. In some cases it is possible that the lowering of the Deck Lift Assembly 38 may be slower than that of the Accumulator Assembly 39 and the Hopper Size needs to increase for the still growing nascent new Load 14'''.

Figure 79:
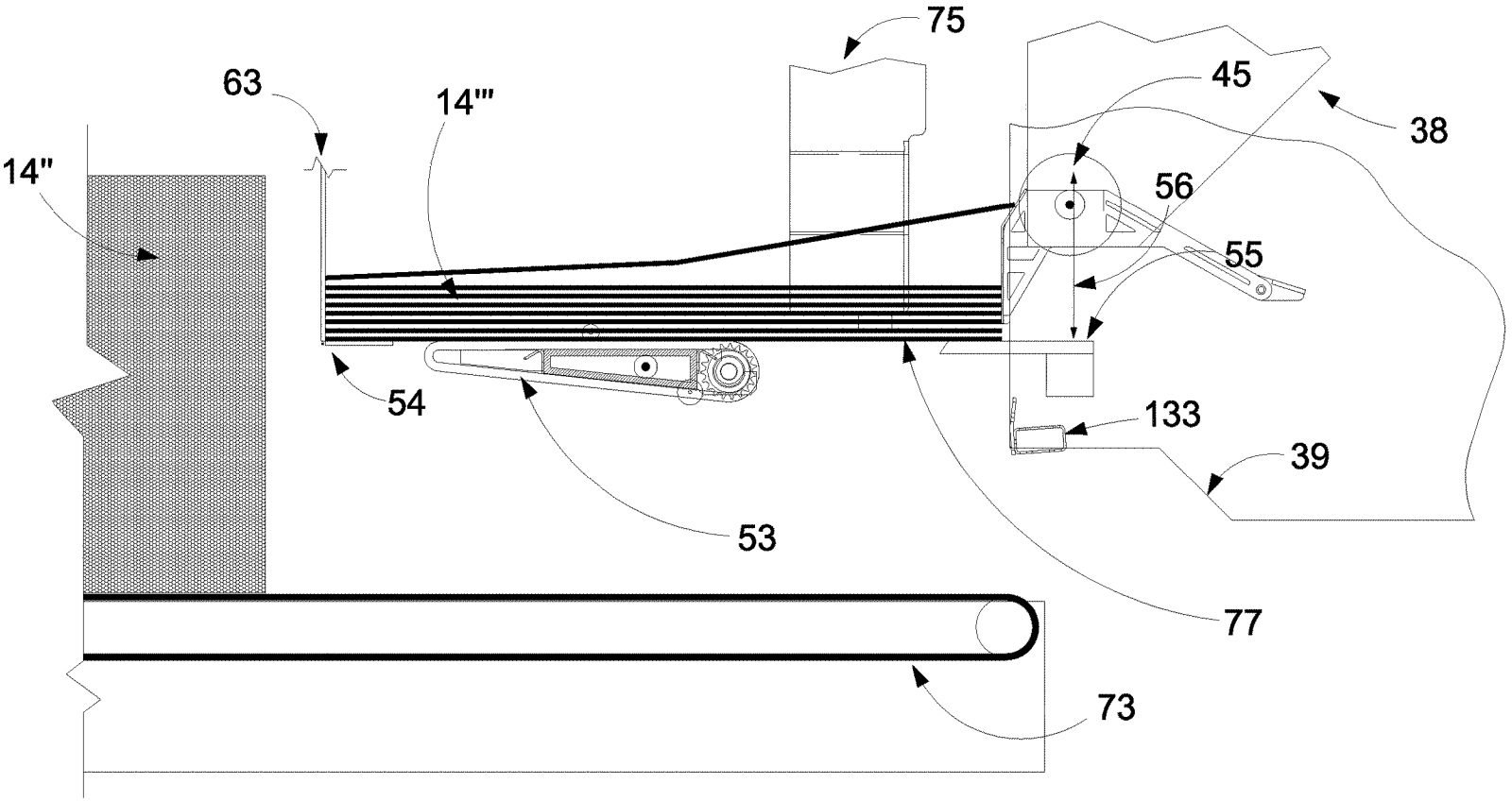

FIG. 79 shows the kinematic overlay state in Load Change Mode after the Load Conveyor 73 has moved the previously completed Load 14'' and the Accumulator Assembly 39 and the Deck Lift Assembly 38 are lowering. The Backstop Lip 54 remains horizontal to support the nascent next Load 14'''. The Accumulator Fingers 53 are extending between the discharging completed Load 14'' and the First Sheet 77 of the next Load 14''' and are flat providing support for the central region of the nascent new Load 14''' while in a flat tilt orientation. The Trail Edge Comb 55 is positioned to support to the trail edge of the nascent new Load 14'''.

Figure 80:
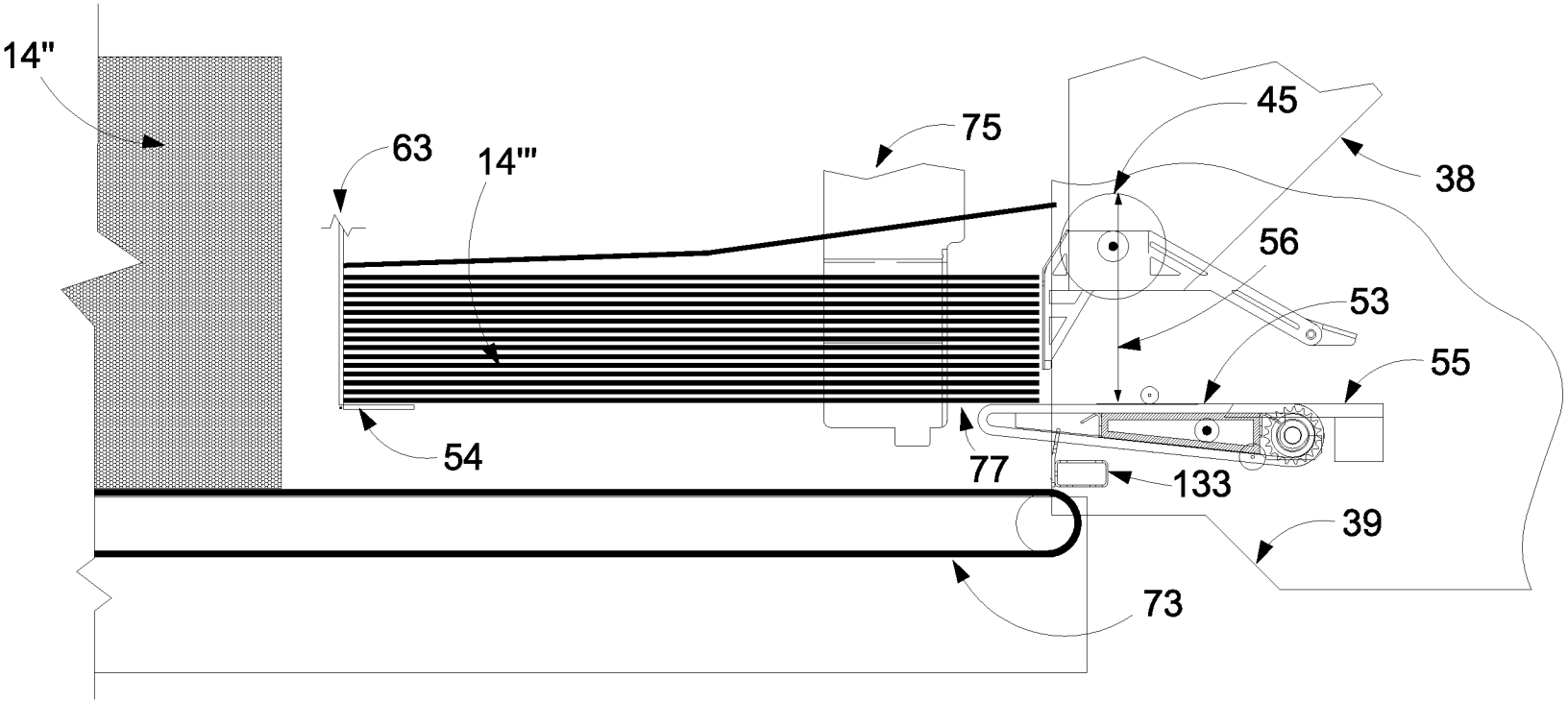

FIG. 80 shows the kinematic overlay state in Load Change Mode as the bottom of the nascent new Load 14''' nears the planned drop area on the Load Conveyor 73. The Backstop Lip 54 is still horizontal, but the Accumulator Fingers 53 have been retracted in the upstream direction so as to just support the trail edge of the next Load 14''' while remaining in the flat support orientation and the Trail Edge Comb 55 has been fully retracted. The Cross Machine Stack Alignment System 57 is in its Middle Position 75 and the Hopper Size 56 is increasing as required for proper operability based on how fast the nascent new Load 14''' is being built.

Figure 81:
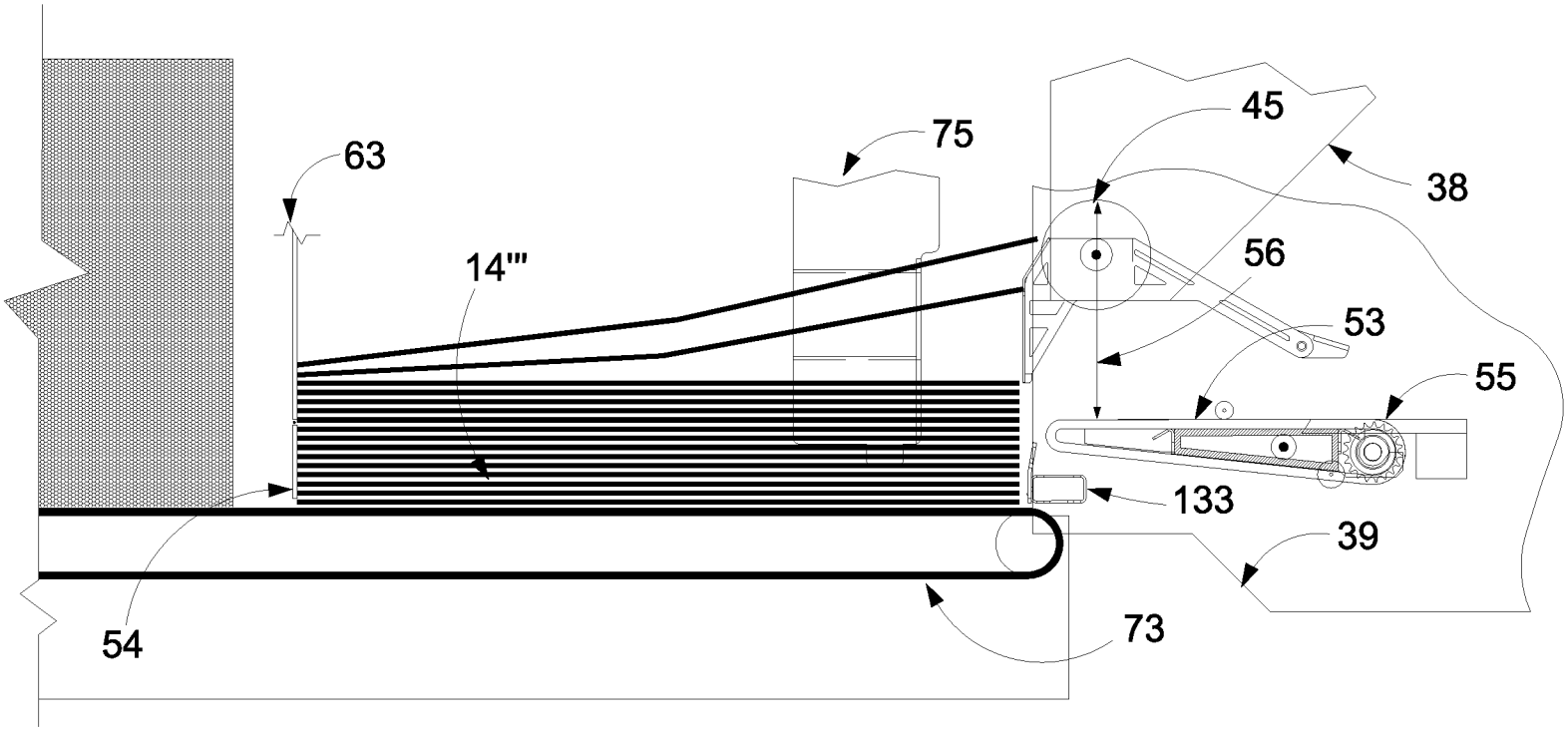

FIG. 81 shows the kinematic overlay state in Load Change Mode after the drop of the nascent new Load 14''' onto the planned drop area of the Load Conveyor 73 has occurred. The Backstop Lip 54 has been retracted out of the stacks accumulating region by shifting into its vertical orientation. During the same transition, the Accumulator Fingers 53 have fully retracted in the upstream direction so as to thereby drop the nascent new Load 14''' onto the Load Conveyor 73. The Cross Machine Stack Alignment System 57 is in its Middle Position 75 and the Hopper Size 56 is increasing as required for proper operability based on how fast the nascent new Load 14''' is still being continuously built (without interruption).

Figure 82:
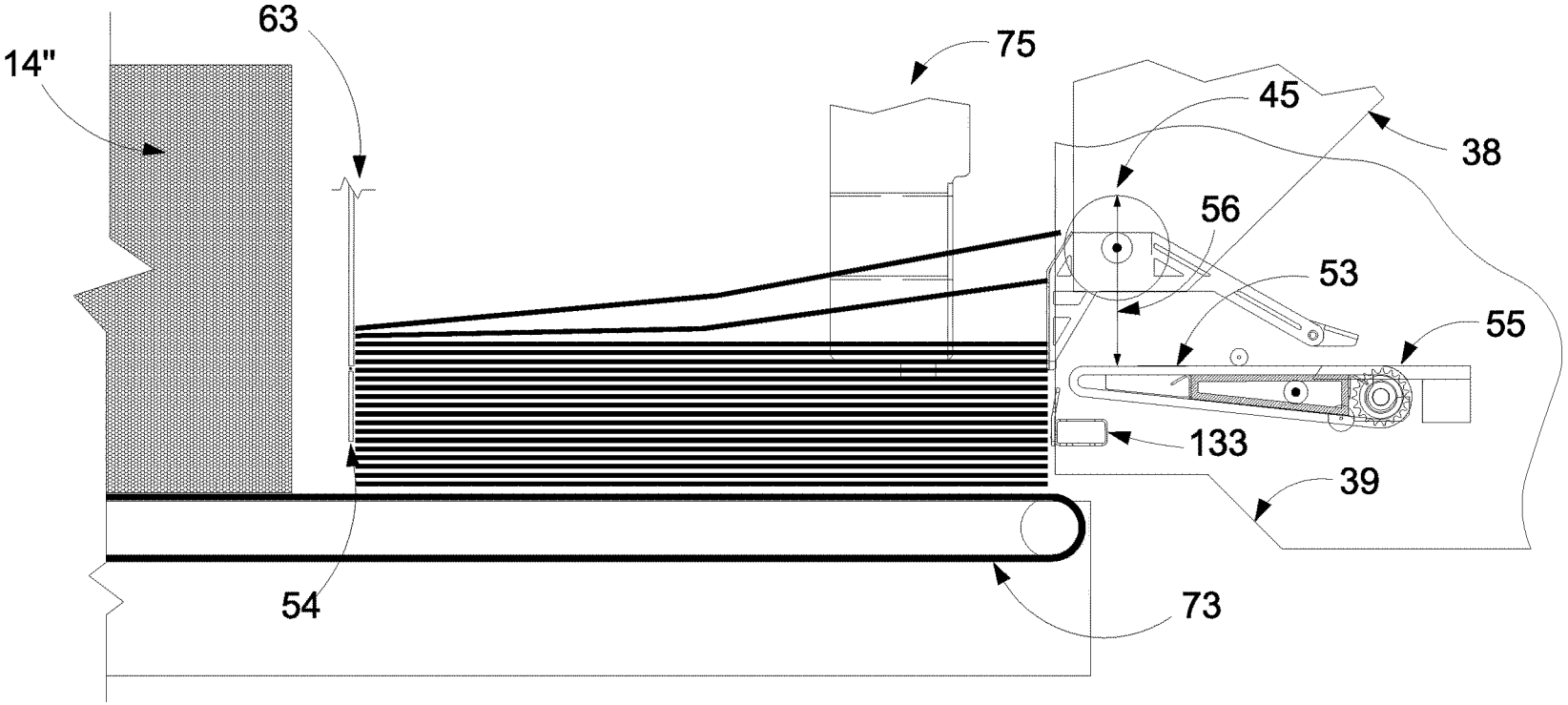

FIG. 82 shows the kinematic overlay state with the Load Change Mode completed and the system now switched into Upstacking Mode similar to the state of FIG. 66. The Backstop Lip 54 is vertical, the Accumulator Fingers 53 are fully retracted and ready to move into their tilt up position, the Cross Machine Stack Alignment System 57 is in it Middle Position 75. This completes a full cycle, which can then repeat for example with the state of FIG. 67 being next.

The foregoing detailed description has been presented for purposes of illustration and description. It is not intended to be exhaustive or to limit the present teachings and disclosure of invention to the precise forms here disclosed. Many modifications and variations are possible in light of the above teachings. The described embodiments were chosen in order to best explain corresponding principles in accordance with the present disclosure of invention and their practical application to thereby enable others skilled in the art to best utilize the present disclosure of invention in various embodiments and with various modifications as are suited to the particular uses contemplated.

What is claimed is:

1. A sheets streaming and stacking apparatus comprising:

(a) a Stacking Deck having a Stacking Deck Discharge End disposed downstream of an opposed Stacking Deck Entry End, the Stacking Deck Discharge End being positioned above a Load Conveyor and configured to discharge therefrom a continuous stream of sheets that are to be subdivided into plural spaced-apart stacks, the Load Conveyor being capable of moving completed stacks downstream once completed, at least one of the Stacking Deck Discharge End and the Load Conveyor being vertically movable such that vertical distance between a Stacking Deck Discharge Surface of the Stacking Deck Discharge End and a load-receiving, Load Conveyor Surface of the Load Conveyor is variable, the Stacking Deck Discharge End being disposed over a vertical stacks accumulating region and configured to discharge the continuous stream of sheets downwardly into the stacks accumulating region; and (b) an Accumulation Sheet Support System that is selectively interjectable into the stacks accumulating region to provide at least first, second and third Sheet Support Surfaces, the first Sheet Support Surface being defined by a downstream-wise retractable Lead Edge Support, the second Sheet Support Surface being defined by an upstream-wise retractable Trail Edge Support and the third Sheet Support Surface being defined by an upstream-wise retractable Center Support, where the Center Support is at least selectively moveable laterally within the stacks accumulating region to provide underneath support to a bottommost sheet of a nascent stack forming in the stacks accumulating region as being separated from and above a completed previous stack also present within the stacks accumulating region, the underneath support provided by the third Sheet Support Surface being disposed in an area between opposed leading and trailing edges of the bottommost sheet of the nascent stack.

2. The apparatus of claim 1 wherein the Accumulation Sheet Support System is configured to be elevationally re-positionable up or down relative to the Load Conveyor Surface, the elevational re-positioning including a re-positioning that increases vertical separation distance between the bottommost sheet of the nascent stack forming in the stacks accumulating region and the topmost sheet of the previous stack such that the previous stack can be laterally conveyed out of the stacks accumulating region while the Accumulation Sheet Support System provides underneath support for the nascent stack forming in the stacks accumulating region.

3. The apparatus of claim 2 wherein the Center Support is elongated in the downstream direction to have a downstream finger tip and an opposed upstream end and the Center Support is configured to be selectively pivoted such that the downstream finger tip can be parked in a tilted up orientation in a gap area of the Stacking Deck Discharge End while the Center Support is retracted out of the stacks accumulating region such that upon being first interjected into the stacks accumulating region, the tilted up finger tip can, due to its proximity to the Stacking Deck Discharge Surface, quickly engage with the bottommost sheet of the nascent stack as that bottommost sheet begins to fall off the Stacking Deck Discharge Surface of the Stacking Deck Discharge End and into the stacks accumulating region.

4. The apparatus of claim 3 wherein the third Sheet Support Surface which provides underneath support to the bottommost sheet of the nascent stack in an area between the opposed leading and trailing edges of the bottommost sheet moves counter to movements of the Center Support such that there is minimal relative motion between the third Sheet Support Surface and the bottommost sheet of the nascent stack even while the Center Support is being repositioned horizontally.

5. The apparatus of claim 3 wherein the Stacking Deck Discharge End has a plurality of parking gaps defined between spaced apart Stacking Deck Discharge Surfaces of the Stacking Deck Discharge End and the Center Support comprises a plurality of Accumulator Fingers that are pivotally park-able into respective ones of the parking gaps and moveable out of those parking gaps to thereby quickly engage with the bottommost sheet of the nascent stack as that bottommost sheet begins to fall off the Stacking Deck Discharge End and into the stacks accumulating region.

6. The apparatus of claim 5 wherein the third Sheet Support Surface includes a plurality of circumferential Finger Belts disposed about respective circumferences of the Accumulator Fingers and which provide underneath support to the bottommost sheet of the nascent stack in an area between the opposed leading and trailing edges of the bottommost sheet, where the Finger Belts move counter to movements of the Center Support such that there is minimal relative motion between sheet contacting portions of the Finger Belts and the bottommost sheet of the nascent stack even while the Accumulator Fingers are being repositioned horizontally.

7. The apparatus of claim 2 wherein:

the Load Conveyor Surface and the Accumulation Sheet Support System are configured to be selectively brought within close proximity of one another after the previous stack is laterally conveyed out of the stacks accumulating region; and the apparatus further comprises:

a Lower Stack Stop Assembly configured to guide a side of the previous stack as the previous stack is being deposited onto a Load Conveyor Surface within the stacks accumulating region.

8. The apparatus of claim 2 further comprising:

a Cross Machine Stack Alignment System configured to provide selective vertical positioning of Stack Side Dividers thereof and of Stack Side Tampers thereof relative to the Sheet Support Surfaces.

9. The apparatus of claim 1 wherein the Trail Edge Support and the Center Support are retractable out of the stacks accumulating region and park-able within close horizontal proximity to one another in a parking space disposed under the Stacking Deck Discharge End so as to thereby minimize a separation distance between a Stacking Deck Discharge Surface of the Stacking Deck Discharge End and the third Sheet Support Surface.

10. The apparatus of claim 1 wherein the third Sheet Support Surface which provides underneath support to the bottommost sheet of the nascent stack in an area between the opposed leading and trailing edges of the bottommost sheet moves counter to movements of the Center Support such that there is minimal relative motion between the third Sheet Support Surface and the bottommost sheet of the nascent stack even while the Center Support is being repositioned horizontally.

11. The apparatus of claim 1 wherein the Stacking Deck is tilt-able and the Stacking Deck Discharge End is movable elevationally relative to the Stacking Deck Entry End so as to define a tilt angle of the tilt-able Stacking Deck.

12. A method of separating stacks of sheets while continuously feeding sheets into a vertical stacks accumulating region, the method comprising:

(a) parking a horizontally reciprocal first cross bar having one or more sheet supporting elements in a parking space disposed under and proximate to a downstream end of a tiltable sheet feeder, the downstream end of the tiltable sheet feeder being configured to selectively rise and fall relative to an upstream end of the tiltable sheet feeder, the disposition of the parking space being configured to remain proximate within a prespecified minimal distance to the downstream end as it rises and falls, the tiltable sheet feeder being configured to uninterruptedly feed sheets out of and in a downstream direction from its downstream end for discharge into the stacks accumulating region;

(b) while the tiltable sheet feeder continues to uninterruptedly feed sheets out from its downstream end, advancing the first cross bar in the downstream direction such that the one or more sheet supporting elements of the advanced first cross bar project at least partially out from the parking space beyond the downstream end of the tiltable sheet feeder and such that the projected one or more sheet supporting elements of the advanced first cross bar define and maintain a separation gap between a topmost sheet of a completed first stack in the stacks accumulating hopper region and a bottommost sheet of a nascent second stack beginning to form in the stacks accumulating region above the completed first stack, the downstream projected one or more sheet supporting elements providing at least partial underneath support to at least a central portion of the nascent second stack;

(c) while the downstream projected one or more sheet supporting elements begin to provide said at least partial underneath support for at least a central portion of the nascent second stack, maintaining a lead edge supporting lip that is extendable upstream to be under a leading bottom edge of the nascent second stack retracted out of the stacks accumulating region so that the nascent second stack is at least partially supported underneath by a lead edge of the first stack; and (d) after the separation gap has been initially defined and maintained, advancing the one or more sheet supporting elements further downstream and interjecting the lead edge supporting lip under the leading bottom edge of the nascent second stack so that the first stack is not needed for support and can be move out of the stacks accumulating region.

13. The method of claim 12 and further comprising:

(e) interjecting a second cross bar into the stacks accumulating region to provide at least partial underneath support to a trailing edge portion of the nascent second stack.

14. The method of claim 13 and further comprising:

(f) pivoting the one or more sheet supporting elements.

15. The method of claim 12 and further comprising:

(e) pivoting the one or more sheet supporting elements.

16. A Stacker Load Change Cycle Apparatus configured to allow uninterrupted feeding of sheets there into while loads are changed, the Stacker Load Change Cycle Apparatus comprising:

a Deck Lift Assembly including a Stacking Deck Discharge Surface and an Accumulator Assembly, the Accumulator Assembly comprising at least three support surfaces adapted for supported accumulation of new sheets of a nascent Load there onto during a Load Change Cycle while a completed Load also resides in a vertical stacks accumulating region under and separated from the new sheets, the Deck Lift Assembly and the Accumulator Assembly being elevationally repositionable independently of each other to thereby provide variable distancing between the Stacking Deck Discharge Surface and the accumulation support surfaces;

wherein the at least three support surfaces include a leading edge support surface operable to provide underneath support for a leading edge of a bottommost sheet of the nascent Load, a trailing edge support surface operable to provide underneath support for an opposed trailing edge of a bottommost sheet and a center support surface operable to provide underneath support for a part of the bottommost sheet between its opposed leading and trailing edges.

17. The Stacker Load Change Cycle Apparatus of claim 16 wherein the Accumulator Assembly is configured to be lowered to a Load Conveyor Surface at a bottom of the stacks accumulating region.

18. The Stacker Load Change Cycle Apparatus of claim 16 wherein the Accumulator Assembly is configured to be lowered to meet with a Load Conveyor Surface that can be raised up from a bottom of the stacks accumulating region.

19. The Stacker Load Change Cycle Apparatus of claim 18 wherein the Deck Lift Assembly is reciprocally movable in the vertical direction so as to selectively define an elevational state of the Stacking Deck Discharge Surface relative to the Load Conveyor Surface.

20. A Stacker Load Change Cycle Apparatus configured to allow uninterrupted feeding of sheets there into while loads are changed, the Stacker Load Change Cycle Apparatus comprising:

a trailing edge tamping system including a plurality of Trail Edge Tampers interleavingly disposed adjacent to sheet discharge surfaces of a Stacking Deck Discharge End of a Stacking Deck, each of the Trail Edge Tampers having a laterally reciprocal vertical surface configured for providing vertical alignment tamping against Trail Edges of sheets that as the sheets feed into a vertical stacks accumulating region of the Stacker Load Change Cycle Apparatus.

* * * * *